US012478230B2

(12) United States Patent
Harmelink et al.

(10) Patent No.: US 12,478,230 B2
(45) Date of Patent: Nov. 25, 2025

(54) MODULAR HEAD SYSTEM FOR HANDHELD EXTRACTION CLEANER, DRY VACUUM ACCESSORY FOR HANDHELD EXTRACTION CLEANER, AND HANDHELD EXTRACTION CLEANER

(71) Applicant: BISSELL Inc., Grand Rapids, MI (US)

(72) Inventors: Chris Harmelink, Wyoming, MI (US); Derek Smith, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 5 days.

(21) Appl. No.: 18/347,695

(22) Filed: Jul. 6, 2023

(65) Prior Publication Data

US 2024/0008697 A1 Jan. 11, 2024

Related U.S. Application Data

(60) Provisional application No. 63/449,144, filed on Mar. 1, 2023, provisional application No. 63/367,841, filed on Jul. 7, 2022.

(51) Int. Cl.
*A47L 5/24* (2006.01)
*A47L 7/00* (2006.01)

(52) U.S. Cl.
CPC ..... *A47L 5/24* (2013.01); *A47L 7/0009* (2013.01)

(58) Field of Classification Search
CPC ..... A47L 7/0004; A47L 7/0009; A47L 7/009; A47L 7/02; A47L 11/00; A47L 11/20; A47L 11/201; A47L 11/204; A47L 11/40; A47L 11/4011; A47L 11/4094; A47L 11/34; A47L 5/24; A47L 5/225
USPC ..... 15/320–322, 328, 344
See application file for complete search history.

(56) References Cited

U.S. PATENT DOCUMENTS

| | | | |
|---|---|---|---|
| 2,627,937 | A | 2/1953 | Martinet |
| 3,443,366 | A | 5/1969 | Schwab |
| 3,513,500 | A | 5/1970 | Hori |
| 3,591,888 | A | 7/1971 | Takeda et al. |
| 3,621,640 | A | 11/1971 | Ohno et al. |

(Continued)

FOREIGN PATENT DOCUMENTS

| | | | |
|---|---|---|---|
| CN | 1838907 | A | 9/2006 |
| CN | 201683850 | U | 12/2010 |

(Continued)

*Primary Examiner* — Brian D Keller
*Assistant Examiner* — Sidney D Full
(74) *Attorney, Agent, or Firm* — Price Heneveld LLP

(57) ABSTRACT

A handheld extraction cleaner system includes a wet cleaning head including a wet suction nozzle, a dry cleaning head including a dry suction nozzle. A handheld base includes a modular receiver configured to interchangeably couple to the wet cleaning head and the dry cleaning head. A suction source is configured to generate a suction air stream through the wet suction nozzle when the wet cleaning head is coupled to the modular receiver and through the dry suction nozzle when the dry cleaning head is coupled to the modular receiver. A fluid delivery system includes a fluid distributor configured to dispense a cleaning solution on a surface to be cleaned, where at least one of the handheld base and the dry cleaning head is configured to at least partially prevent the fluid delivery system from dispensing the cleaning solution when the dry cleaning head is coupled to the modular receiver.

12 Claims, 28 Drawing Sheets

(56) References Cited

U.S. PATENT DOCUMENTS

| | | | | |
|---|---|---|---|---|
| 3,653,189 | A | 4/1972 | Miyake et al. | |
| 4,209,875 | A | 7/1980 | Pugh et al. | |
| 4,592,764 | A | 6/1986 | Ikezaki et al. | |
| 4,745,654 | A | 5/1988 | Yamamoto et al. | |
| 4,800,614 | A | 1/1989 | Kopco et al. | |
| 4,831,685 | A | 5/1989 | Bosyj et al. | |
| 4,920,608 | A | 5/1990 | Hult et al. | |
| 4,967,443 | A | 11/1990 | Krasznai et al. | |
| 5,020,187 | A | 6/1991 | Kosten et al. | |
| 5,065,473 | A | 11/1991 | Krasznai et al. | |
| 5,248,323 | A | 9/1993 | Stevenson | |
| 5,375,293 | A | 12/1994 | Gilbertson | |
| 5,584,656 | A | 12/1996 | Rose | |
| 5,605,233 | A | 2/1997 | Hauch | |
| 5,681,363 | A | 10/1997 | Tucker et al. | |
| 5,799,362 | A * | 9/1998 | Huffman | A47L 11/4083 15/328 |
| 6,101,668 | A | 8/2000 | Grey | |
| 6,108,864 | A | 8/2000 | Thomas et al. | |
| 6,110,248 | A | 8/2000 | Liu | |
| 6,125,501 | A | 10/2000 | Lun | |
| 6,192,550 | B1 | 2/2001 | Hamada et al. | |
| 6,256,834 | B1 | 7/2001 | Meijer et al. | |
| 6,546,592 | B1 | 4/2003 | Cockburn et al. | |
| 6,598,263 | B2 | 7/2003 | Boles et al. | |
| 6,709,495 | B1 | 3/2004 | Storer | |
| 6,758,874 | B1 | 7/2004 | Hunter | |
| 6,839,934 | B2 | 1/2005 | Houghton et al. | |
| 6,910,245 | B2 | 6/2005 | Hawkins et al. | |
| 7,070,636 | B2 | 7/2006 | Mccormick et al. | |
| 7,135,051 | B2 | 11/2006 | Baldinger et al. | |
| 7,228,592 | B2 | 6/2007 | Hawkins et al. | |
| 7,267,704 | B2 | 9/2007 | Allgeier | |
| 7,318,249 | B2 | 1/2008 | Lin | |
| 7,334,290 | B2 | 2/2008 | Hawkins et al. | |
| 7,370,387 | B2 | 5/2008 | Walker et al. | |
| 7,386,916 | B2 | 6/2008 | Bone | |
| 7,412,749 | B2 | 8/2008 | Thomas et al. | |
| 7,418,763 | B2 | 9/2008 | Shaver et al. | |
| RE40,542 | E | 10/2008 | Coburn et al. | |
| 7,484,265 | B2 | 2/2009 | Kasper et al. | |
| 7,507,269 | B2 | 3/2009 | Murphy et al. | |
| 7,572,307 | B2 | 8/2009 | Coburn | |
| 7,731,770 | B2 | 6/2010 | Strutt et al. | |
| 7,799,103 | B2 | 9/2010 | Coburn | |
| 7,845,046 | B2 | 12/2010 | Milligan et al. | |
| 7,882,593 | B2 | 2/2011 | Beskow et al. | |
| 7,908,706 | B2 | 3/2011 | Hawkins et al. | |
| 7,931,716 | B2 | 4/2011 | Oakham | |
| 7,958,597 | B2 | 6/2011 | Frantzen et al. | |
| 8,028,373 | B2 | 10/2011 | Rowntree | |
| 8,032,984 | B2 | 10/2011 | Rowntree et al. | |
| RE42,873 | E | 11/2011 | Walker et al. | |
| 8,091,168 | B2 | 1/2012 | Holm et al. | |
| 8,117,712 | B2 | 2/2012 | Dyson et al. | |
| 8,151,411 | B2 | 4/2012 | Beskow et al. | |
| 8,152,877 | B2 | 4/2012 | Greene | |
| 8,225,456 | B2 | 7/2012 | Hkan et al. | |
| 8,230,550 | B2 | 7/2012 | Krebs et al. | |
| RE43,603 | E | 8/2012 | Coburn et al. | |
| RE43,804 | E | 11/2012 | Walker et al. | |
| 8,302,251 | B2 | 11/2012 | Beskow et al. | |
| 8,308,831 | B2 | 11/2012 | Coburn | |
| 8,402,601 | B2 | 3/2013 | Fahlstrm | |
| 8,424,154 | B2 | 4/2013 | Beskow et al. | |
| 8,539,639 | B2 | 9/2013 | Engstrom et al. | |
| 8,549,704 | B2 | 10/2013 | Milligan et al. | |
| 8,572,801 | B2 | 11/2013 | Engstrm et al. | |
| 8,607,406 | B2 | 12/2013 | Miefalk et al. | |
| 8,615,844 | B2 | 12/2013 | Van Raalte et al. | |
| 8,671,510 | B2 | 3/2014 | Han et al. | |
| 8,782,849 | B2 | 7/2014 | ?gren et al. | |
| 8,918,952 | B2 | 12/2014 | Rowntree | |
| 8,918,953 | B2 | 12/2014 | Sjberg et al. | |
| 9,078,550 | B2 | 7/2015 | Pruitt et al. | |
| 9,314,140 | B2 | 4/2016 | Eriksson | |
| 9,474,424 | B2 | 10/2016 | Moyher et al. | |
| 9,622,637 | B1 | 4/2017 | Hsieh et al. | |
| 9,833,115 | B2 | 12/2017 | Eriksson | |
| 9,839,335 | B2 | 12/2017 | Eriksson | |
| 10,117,553 | B2 | 11/2018 | Eriksson | |
| 10,694,914 | B2 | 6/2020 | Mcgee et al. | |
| 2009/0229070 | A1 | 9/2009 | Medema et al. | |
| 2011/0056045 | A1 | 3/2011 | Sepke et al. | |
| 2012/0204377 | A1 * | 8/2012 | White | A47L 9/0653 15/322 |
| 2018/0140159 | A1 | 5/2018 | Tran et al. | |
| 2022/0142445 | A1 | 5/2022 | Johnson et al. | |

FOREIGN PATENT DOCUMENTS

| | | | |
|---|---|---|---|
| CN | 201683851 | U | 12/2010 |
| CN | 201759500 | U | 3/2011 |
| CN | 201790738 | U | 4/2011 |
| CN | 201790739 | U | 4/2011 |
| CN | 201790744 | U | 4/2011 |
| CN | 201790747 | U | 4/2011 |
| CN | 201814508 | U | 5/2011 |
| CN | 201821128 | U | 5/2011 |
| CN | 201855226 | U | 6/2011 |
| CN | 201861557 | U | 6/2011 |
| CN | 202699031 | U | 1/2013 |
| CN | 202699032 | U | 1/2013 |
| CN | 203841629 | U | 9/2014 |
| CN | 104840150 | B | 8/2016 |
| CN | 104799760 | B | 5/2018 |
| CN | 208677252 | U | 4/2019 |
| CN | 208677256 | U | 4/2019 |
| CN | 211066435 | U | 7/2020 |
| CN | 111936023 | A | 11/2020 |
| CN | 112890670 | A | 6/2021 |
| DE | 3325336 | A1 | 1/1985 |
| EP | 3841939 | A1 | 6/2021 |
| EP | 4183301 | A1 | 5/2023 |
| GB | 1262121 | A | 2/1972 |
| JP | 58008887 | B2 | 2/1983 |
| JP | 3265462 | B2 | 3/2002 |
| WO | 02085495 | A1 | 10/2002 |

* cited by examiner

MODULAR HEAD SYSTEM FOR HANDHELD EXTRACTION CLEANER, DRY VACUUM ACCESSORY FOR HANDHELD EXTRACTION CLEANER, AND HANDHELD EXTRACTION CLEANER

CROSS-REFERENCE TO RELATED APPLICATIONS

This application claims priority to and the benefit under 35 U.S.C. § 119(e) of U.S. Provisional Application No. 63/367,841, filed on Jul. 7, 2022, entitled MODULAR HEAD SYSTEM FOR HANDHELD EXTRACTION CLEANER, and U.S. Provisional Application No. 63/449,144, filed on Mar. 1, 2023, entitled HANDHELD EXTRACTION CLEANER, the disclosure of each is hereby incorporated herein by reference in its entirety.

TECHNICAL FIELD

The present disclosure relates to handheld extraction cleaner systems that include a cleaning solution supply tank and a recovery tank. These extraction cleaners typically have a suction source including a vacuum motor that powers an impeller to create low pressure on one side of the impeller and higher pressure on the other side thereof. The recovery tank is typically positioned between the low pressure side of the impeller and a suction nozzle to remove fluid and debris from a surface and deposit it in the recovery tank.

BACKGROUND

Extraction cleaners may be configured to rely upon a suction source to generate a suction air stream through a cleaning head for purposes of extracting debris, liquids, and/or other substances away from a surface to be cleaned. Some extraction cleaners may additionally include a fluid delivery system configured to dispense a cleaning solution on the cleaning surface to enhance cleaning with application of a stain remover, water, compositions, detergents, etc. to the cleaning surface before debris extraction. As opposed to upright or canister extraction cleaners, handheld extraction cleaners may be generally characterized as extraction cleaners having a relatively small size and weight to facilitate being hand-carried to a cleaning location. Handheld extraction cleaners may be correspondingly transported and used without the assistance of supporting wheels or other supportive or propulsion mechanisms typically included with uprights and canister type of cleaners. The portability of handheld extraction cleaners is believed to be beneficial in enabling users to quickly and easily clean various types of surfaces without having to accommodate heavier and larger cleaning devices, such as when cleaning smaller areas or performing spot cleaning after a pet or child makes a small mess.

BRIEF SUMMARY OF THE DISCLOSURE

According to one aspect of the present disclosure, a handheld extraction cleaner system includes a wet cleaning head including a wet suction nozzle and a dry cleaning head including a dry suction nozzle. A handheld base includes a modular receiver configured to interchangeably couple to the wet cleaning head and the dry cleaning head. A suction source is configured to generate a suction air stream through the wet suction nozzle when the wet cleaning head is coupled to the modular receiver and through the dry suction nozzle when the dry cleaning head is coupled to the modular receiver. A fluid delivery system includes a fluid distributor configured to dispense a cleaning solution on a surface to be cleaned. At least one of the handheld base and the dry cleaning head is configured to at least partially prevent the fluid delivery system from dispensing the cleaning solution when the dry cleaning head is coupled to the modular receiver.

According to another aspect of the present disclosure, a modular handheld extraction cleaner and a base include a suction source configured to generate a suction air stream for recovering debris from a surface to be cleaned. A fluid delivery system is configured to dispense a cleaning solution from a fluid distributor to the surface to be cleaned. A modular receiver and a dry cleaning head are selectively coupled to the modular receiver. The dry cleaning head includes a dry suction nozzle in fluid communication with the suction source to draw the debris into the at least one dry cleaning head with the suction air stream, a recovery tank for capturing the debris from the suction air stream, and an override feature for preventing the cleaning solution from being dispensed when the dry cleaning head is coupled to the modular receiver.

According to another aspect of the present disclosure, a handheld extraction cleaner includes a dry cleaning head including a dry suction nozzle and a recovery tank. A base includes a suction source configured to generate a suction air stream for recovering debris from a surface to be cleaned through the dry suction nozzle, the debris being collected from the suction air stream in the recovery tank. A fluid delivery system includes a spray actuator, where the fluid delivery system is configured to dispense a cleaning solution on the surface to be cleaned upon actuation of the spray actuator. A modular receiver is configured to selectively couple with the dry cleaning head. A control system is configured to disable use of the spray actuator when the dry cleaning head is coupled to the modular receiver.

These and other features, advantages, and objects of the present disclosure will be further understood and appreciated by those skilled in the art by reference to the following specification, claims, and appended drawings.

BRIEF DESCRIPTION OF THE DRAWINGS

The accompanying drawings, which are incorporated into and constitute a part of this specification, illustrate implementations of the disclosure and together with the description, serve to explain the principles of the disclosure.

DETAILED DESCRIPTION

Figure 1:
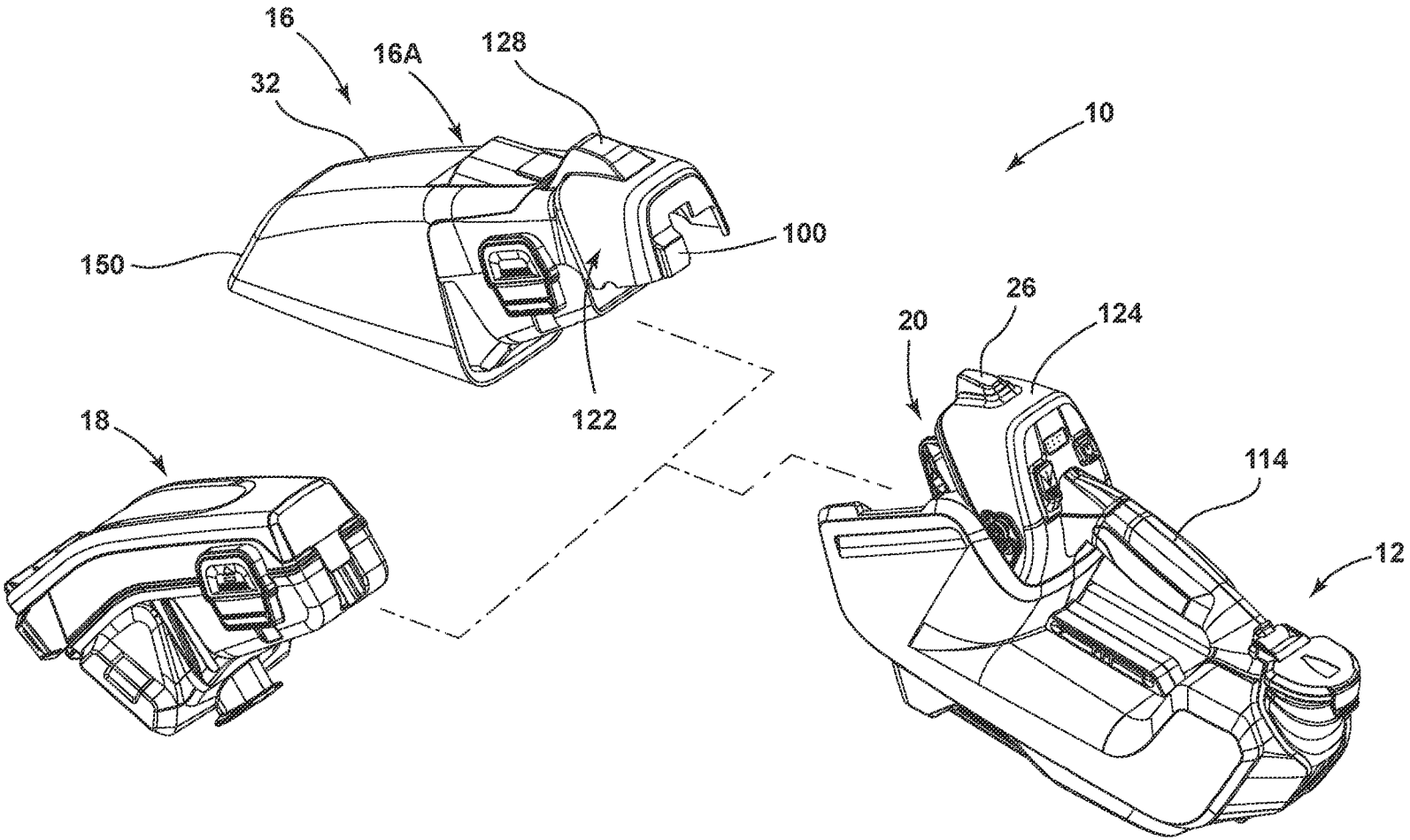
FIG. 1 illustrates a side perspective assembly view of a handheld extraction cleaner system, according to the present disclosure.

The present illustrated embodiments reside primarily in combinations of method steps and apparatus components related to a handheld extraction cleaner. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof, shall relate to the disclosure as oriented in FIG. 1. Unless stated otherwise, the term "front" shall refer to a surface closest to an intended viewer, and the term "rear" shall refer to a surface furthest from the intended viewer. However, it is to be understood that the disclosure may assume various alternative orientations, except where expressly specified to the contrary. It is also to be understood that the specific structures and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

With reference to FIGS. 1-31, reference numeral 10 generally designates a handheld extraction cleaner system. The extraction cleaner system 10 may be configured to provide a tailored solution whereby a user can quickly and easily perform multiple types of cleaning with a single apparatus and fewer steps for a more efficient cleaning process. In this way, the cleaning process with the extraction cleaner system 10 does not utilize multiple cleaners, and the user does not perform many steps. The extraction cleaner system 10 may be configured to provide wet and dry cleaning capabilities in a handheld manner suitable to enabling users to quickly and easily clean various types of surfaces and messes without having to accommodate heavier and larger cleaning devices when cleaning up smaller areas or performing spot cleaning should a pet or child make a small mess. The extraction cleaner system 10 generally includes a handheld base 12 configured to be interchangeably coupled with multiple cleaning heads, including dry cleaning heads 16A-16E, collectively referred to herein as dry cleaning heads 16, and a wet cleaning head 18, constructed to perform different types of cleaning, such as with the wet cleaning head 18 configured to perform wet extraction cleaning and the dry cleaning heads 16 configured to perform dry cleaning.

The base 12 may be configured in accordance with the unitary body described in U.S. Provisional Application No. 63/280,176, filed Nov. 17, 2021, entitled Handheld Extraction Cleaner, and U.S. patent application Ser. No. 17/985,050, filed Nov. 14, 2022, entitled Handheld Extraction Cleaner, the disclosures of each are hereby incorporated by reference in their entirety herein. The base 12 may include a modular receiver 20 configured to removably and selectively couple the wet and/or dry cleaning heads 16, 18 to the handheld base 12 in an easy, efficient motion whereby the user can attach the selected or desired cleaning head 16, 18 and immediately commence cleaning.

The base 12 generally includes a suction source 22 (see FIG. 3) configured to generate a suction air stream or vacuum effect through the coupled cleaning head 16, 18 to extract material (debris, liquid, liquid-entrained debris, etc.) from a cleaning surface. The base 12 may additionally include a fluid or liquid delivery system 24 that has a fluid distributor 26 configured to dispense a cleaning solution on the cleaning surface. The fluid delivery system 24 may include a pump 28 fluidly coupled with a cleaning solution tank 30 for delivering a cleaning solution to the fluid distributor 26. The pump 28 is generally controlled via a control system of the handheld base 12 to dispense the cleaning solution. The extraction cleaner system 10 may optionally include additional cleaning heads in addition to or in replacement of the wet and/or dry cleaning heads 16, 18. A user may correspondingly couple one of the available cleaning heads 16, 18 with the base 12 to quickly and efficiently perform wet, dry, and/or other types of extraction cleaning and interchange the cleaning heads 16, 18 to perform different cleaning processes.

Referring still to FIG. 1, the present disclosure is predominantly described for exemplary and non-limiting purposes with respect to wet and dry extraction cleaning using the coupled one of the wet and dry cleaning heads 16, 18. The wet cleaning head 18 may be configured in accordance with a recovery assembly, such as the recovery assembly described in U.S. Provisional Application No. 63/280,176 and U.S. patent application Ser. No. 17/985,050, the disclosures of which are incorporated by reference in their entirety herein. The wet cleaning head 18 may be correspondingly configured to facilitate wet extraction cleaning for cleaning liquid spills/stains and/or other cleaning processes where a cleaning solution may be applied to the cleaning surface, such as on a stain, (either manually with a spray bottle and/or using the fluid delivery system 24) before extraction of the liquid and entrained debris. The dry cleaning head 16 may be configured in accordance with the present disclosure to perform dry extraction cleaning for cleaning spills or messes that contain mostly dry debris and/or cleaning processes that may not involve the addition of a cleaning solution (e.g., dry cleaning may be used with spills that include some small amount of liquid and/or moist debris, like spilled oats with some water).

The present disclosure differentiates between the terms "wet" and "dry" merely for illustrative purposes and to highlight improved functionality with respect to enabling a user to switch between "wet" and "dry" types of cleaning processes depending on whether the coupled cleaning head 16, 18 is intended to recover wet debris or dry debris. The materials recovered with the handheld extraction cleaner system 10 may include debris such as liquid, fluids, dirt, dust, soil, hair, and/or combinations thereof depending on the type of mess being cleaned. The differentiation between wet and dry components and/or wet and dry debris is used herein without limitation as some dry debris may include liquids and/or fluids, including cleaning fluids, while some wet debris may include non-liquid substances entrained with liquid substances. As such, the wet cleaning head 18 may be used to clean dry debris and the dry cleaning head 16 may be used to clean wet debris. The differentiation between wet and dry debris, accordingly, is intended merely for expediency and clarification in identifying the different types of cleaning heads 16, 18 and not as a representation or limitation of the debris being cleaned.

While both of the wet and dry cleaning heads 16, 18 may be capable of cleaning wet and/or dry debris, the present disclosure contemplates the dry cleaning head 16 may be more suitable for dry or drier debris and the wet cleaning head 18 may be more suitable for wet or wetter debris due to differences in the separation processes each cleaning head 16, 18 uses to separate recovered material (debris and/or liquid) from the suction air stream. The differentiation between wet and dry cleaning heads 16, 18, or other types of cleaning heads, accordingly, may be based on the separation processes each cleaning head 16, 18 uses and/or other aspects of the associated cleaning, rather than whether the recovered debris is characterized as wet, dry, or some combination thereof. By way of example, one non-limiting aspect of the present disclosure contemplates the wet cleaning head 18 relying upon a torturous and/or unfiltered pathway to facilitate separating recovered debris from the suction air stream, whereas the dry cleaning head 16 may instead rely upon a non-torturous and/or filtered pathway to do the same.

Figure 2:
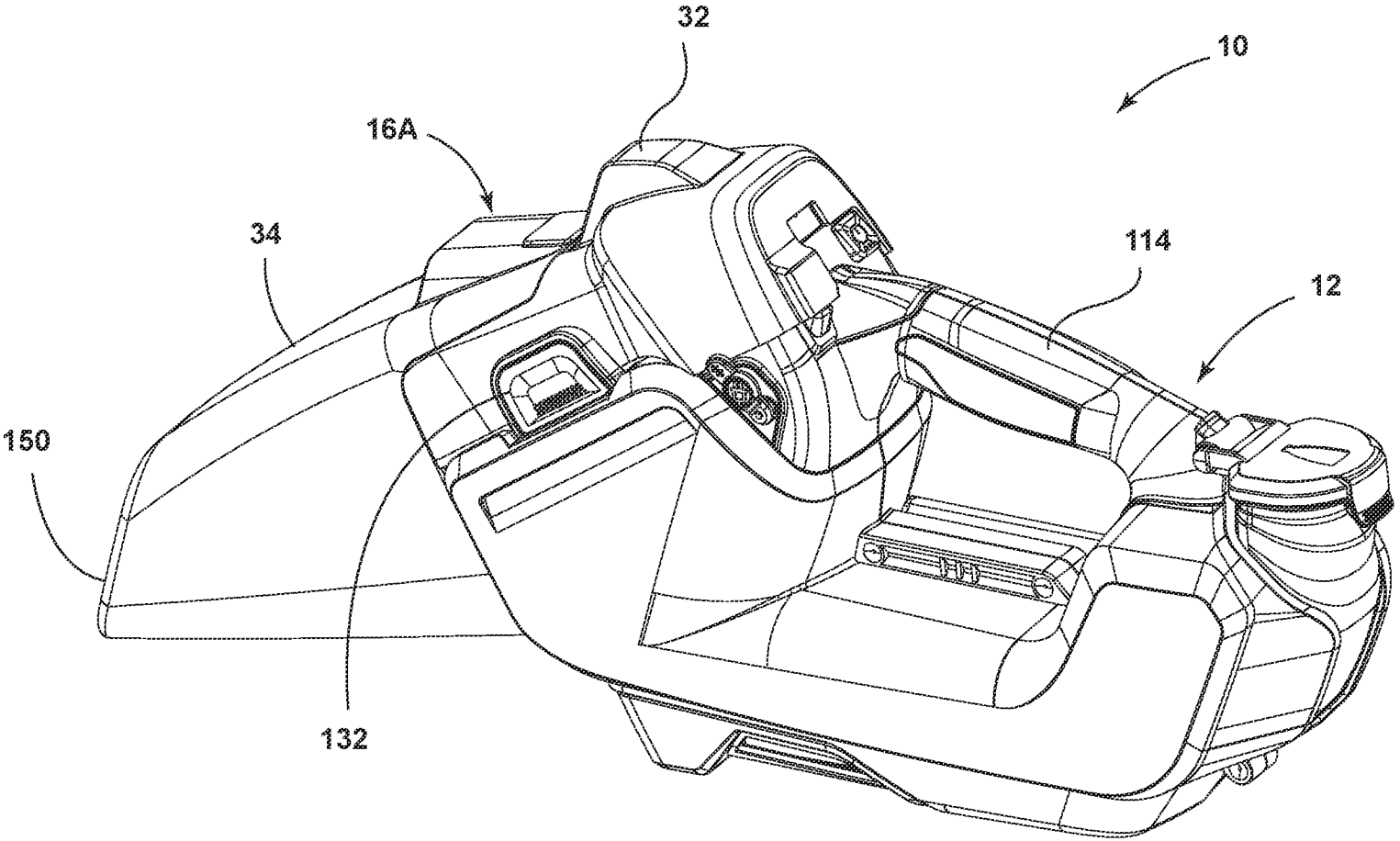
FIG. 2 is a side perspective view of a handheld extraction cleaner system with a dry cleaning head, according to the present disclosure.
Figure 3:
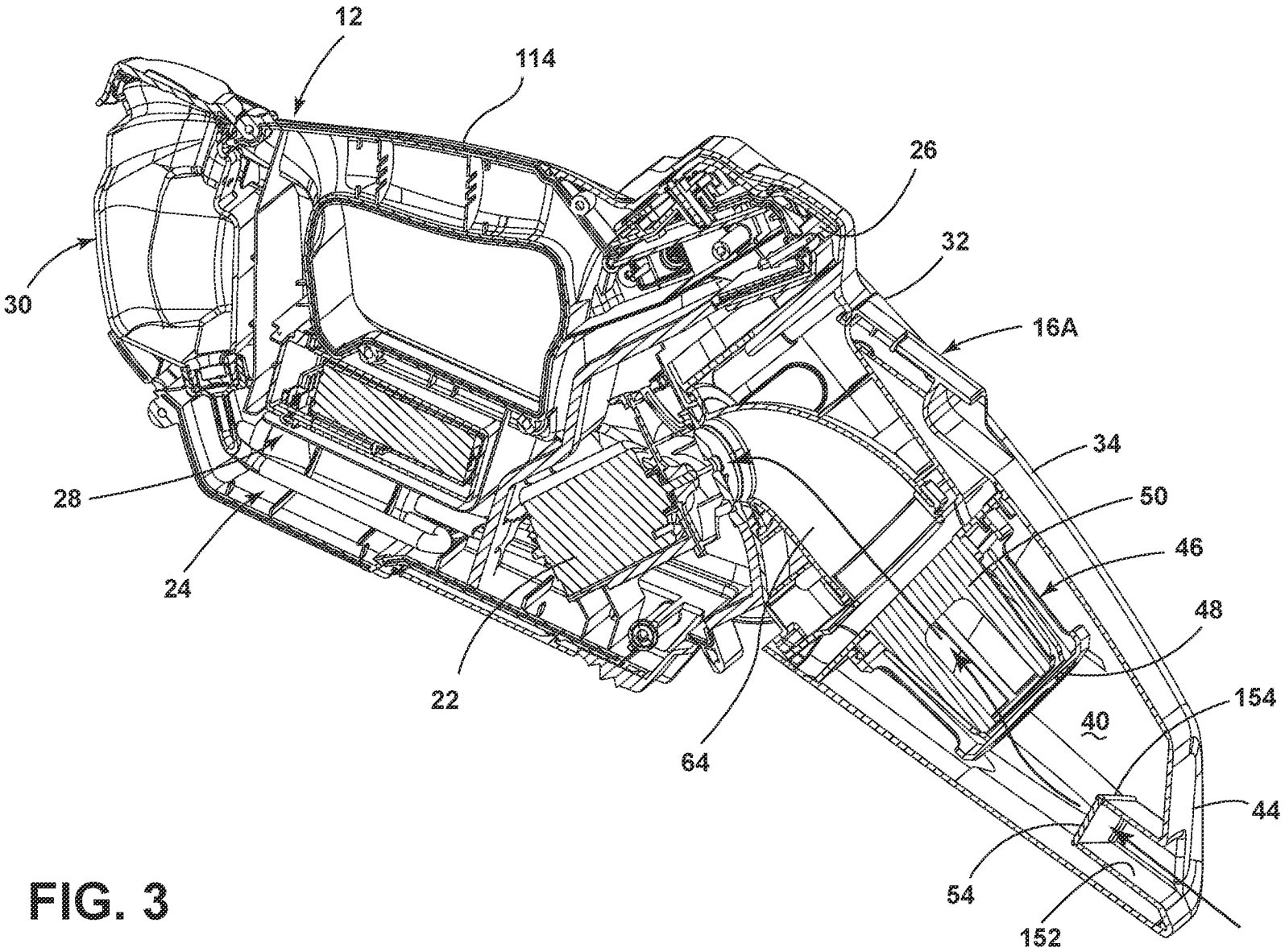
FIG. 3 is a cross-sectional view of a handheld extraction cleaner system with a dry cleaning head, according to the present disclosure.
Figure 4:
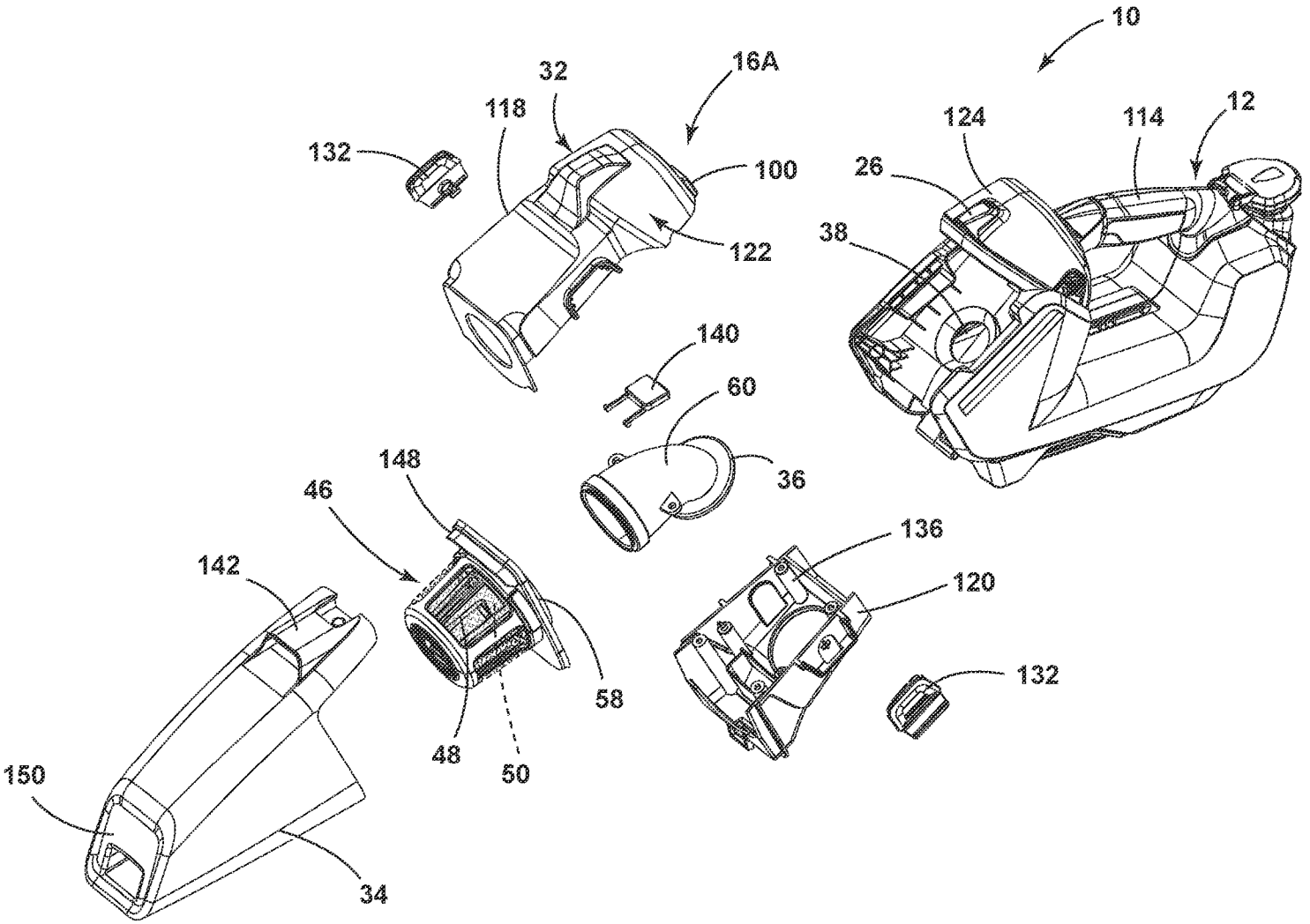
FIG. 4 is an exploded side perspective view of a handheld extraction cleaner system with a dry cleaning head, according to the present disclosure.

With reference to FIGS. 2-4, the handheld extraction cleaner system 10 is illustrated with the dry cleaning head 16A coupled with the base 12 in accordance with one non-limiting aspect of the present disclosure. The dry cleaning head 16A includes a housing 32 configured to interconnect a dry recovery tank 34 with the base 12. As shown in FIG. 4, the housing 32 may be configured to facilitate positioning an outlet 36 of the dry cleaning head 16A relative to an inlet 38 of the base 12 wherethrough the suction air stream flows to facilitate extracting debris into a collection chamber 40 of the dry recovery tank 34 via a suction nozzle 44. The alignment of the inlet 38 of the base 12 with the outlet 36 of the dry cleaning head 16A provides fluid communication between the suction nozzle 44 and the suction source 22 to draw the material into the collection chamber 40 with the suction or vacuum effect.

The suction nozzle 44 is intended to be used to remove debris from the surface. Typically, the term "suction nozzle" is reserved for the feature that interacts with the surface to extract debris. In some examples, the suction nozzle 44 may be configured to directly engage the surface being cleaned. The dry recovery tank 34 may include a separator 46 configured to perform a separation process where the recovered debris may be separated from the suction air stream for collection before reaching the suction source 22 and the suction air stream can be exhausted from the extraction cleaner system 10.

As illustrated in FIG. 4, the separator 46 is shown as having a pre-filter 48, also referred to as a coarse filter, such as a mesh screen, and a fine filter 50 cooperating to facilitate separating the debris from the suction air stream. The pre-filter 48 and the fine filter 50 are exemplary of one type of separator 46 particularly suitable for separating dry or essentially dry debris from the suction air stream. Other filters, media, and cyclonic and non-cyclonic separation processes may be similarly used to separate debris from the suction air stream without departing from the teachings herein.

The suction air stream through the dry cleaning head 16A may pass through the suction nozzle 44, through a tank inlet flap 54 configured to rotatably cover and uncover the suction nozzle 44, and then through the separator 46 before passing through a portal 58 between the separator 46 and a conduit 60. The conduit 60 is configured to provide a pathway 64 through the housing 32 between the separator 46 and the inlet 38 of the base 12. The pathway 64 through the dry cleaning head 16A may correspondingly be considered as a non-torturous pathway 64 due to bending and other curving of the air flow imposed thereupon being minimal and/or shaped in such a manner that a suction force generated with the suction source 22 remains relatively high, and thereby capable of maximizing an amount of debris that can be recovered from the cleaning surface. The pathway 64 through the dry cleaning head 16A may also be considered as a filtered pathway due to the recovered debris being separated from the suction air stream using separation provided with the separator 46, or optionally through another configuration whereby physical media may be placed within the pathway 64 to separate debris from the suction air stream.

Figure 5:
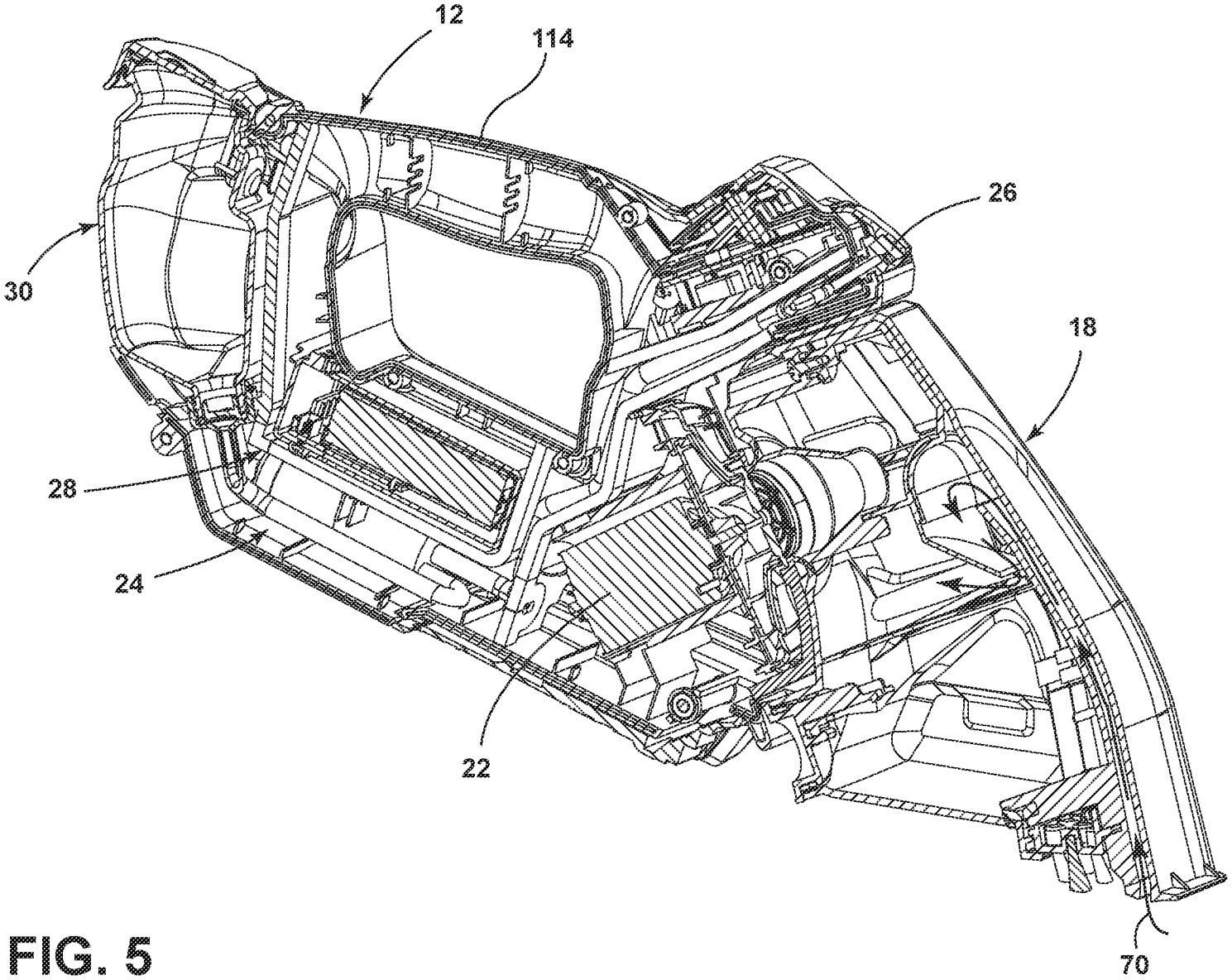
FIG. 5 is a cross-sectional view of a handheld extraction cleaner system with a wet cleaning head, according to the present disclosure.
Figure 6:
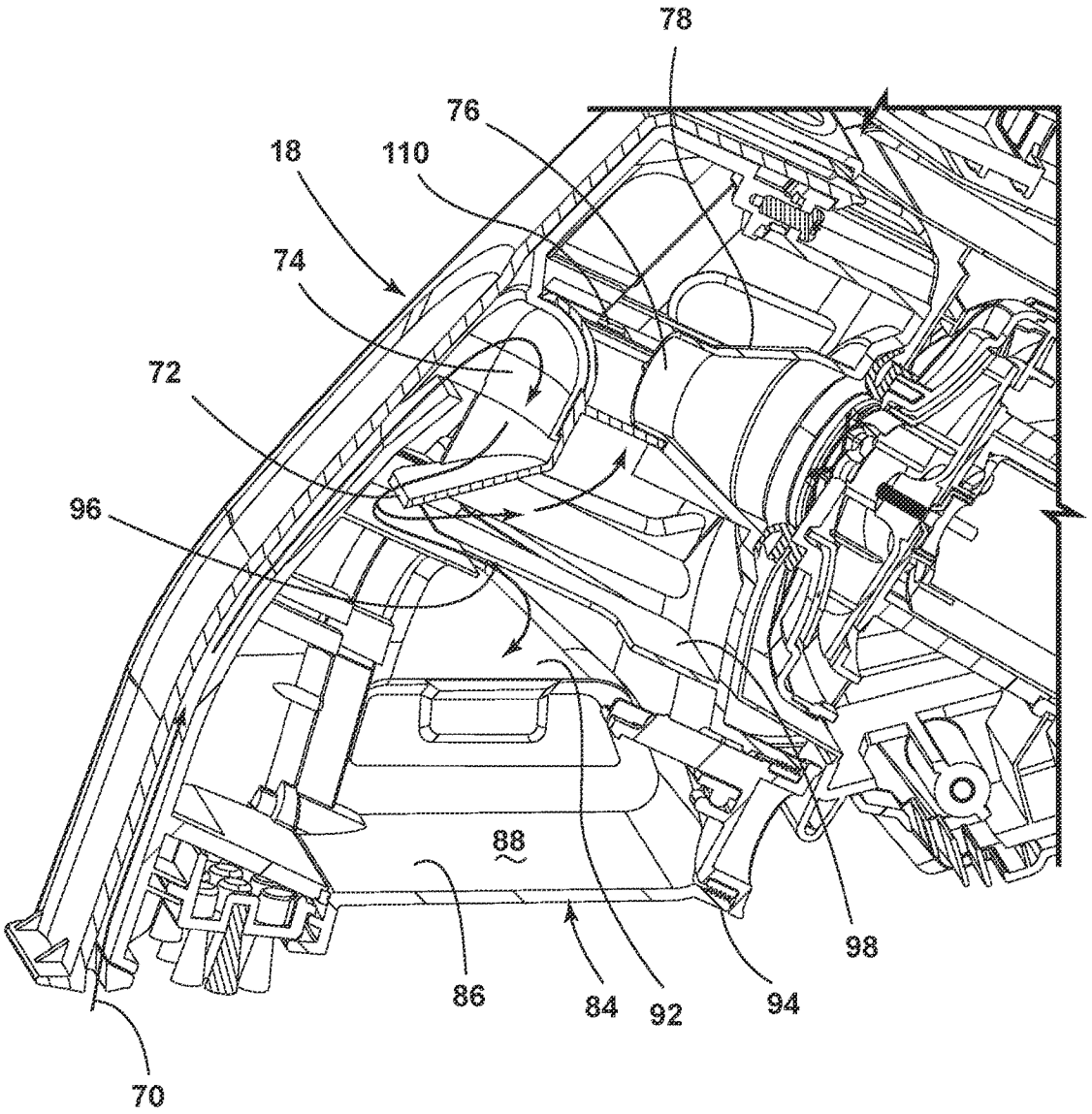
FIG. 6 is an enlarged cross-sectional view of a handheld extraction cleaner system with a wet cleaning head, according to the present disclosure.

With reference to FIGS. 5 and 6, the wet cleaning head 18 is coupled with the base 12 with the suction air stream passing from a wet suction nozzle and through a pathway 70 connecting an outlet 72 of a separator 74 with an inlet 76 of a diffuser conduit 78, which can be formed by various conduits, ducts, housings, connectors, etc. The pathway 70 may be described as tortuous due to the inclusion of baffles, guides, and other air-turning features that direct the airflow and increase the length of the pathway 70. In at least one example, the pathway 70 can include a baffle 110 blocking a lower portion of the inlet 76 of the diffuser conduit 78 so that working air is forced to flow around and over the baffle 110 to enter the inlet 76.

A recovery tank 84 may include a hollow tank body 86 defining a collection chamber 88 for holding recovered liquid and/or debris, with a tank inlet 92 that is in fluid communication with the separator outlet 72 and a tank outlet 94. The tank outlet 94 is formed in the tank body 86 for emptying any liquid or debris in the recovery tank 84 that may be collected in the collection chamber 88. The tank inlet 92 can be formed as an opening 96 through a baffle wall 98 separating the collection chamber 88 from the tortuous air pathway 70, with debris and liquid that is separated from the suction air stream being transferrable into the recovery tank 84 through the opening 96.

The pathway 70 through the wet cleaning head 18 may be considered torturous due to curvatures imposed upon the resulting airflow being somewhat extreme (e.g., sharper, with a higher degree of curvature) and/or shaped in such a manner that a suction force generated with the suction source 22 may be less than that provided with the dry cleaning head 16A (i.e., the force available to recover debris from the cleaning surface being less as a result of the repeated directional changes and tight curves). This results in a trade-off with suction force, which may be beneficial in enabling the wet cleaning head 18 to separate entrained debris without the use of filtered media (i.e., in an unfiltered manner), such that spills or greater quantities of liquid can be recovered without repeatedly replacing filtering components. While the present disclosure is described with respect to the wet cleaning head 18 having a torturous, unfiltered pathway 70 and the dry cleaning head 16A having a non-torturous, filtered pathway 64, this description is done merely for exemplary purposes to distinguish one type of cleaning head 16, 18 from another as the present disclosure fully contemplates different cleaning heads 16, 18 having other types of pathways 64, 70 and the optional inclusion or omission of filters.

One non-limiting aspect of the present disclosure relates to the base 12 and/or one or more of the cleaning heads 16, 18 being configured to selectively disable or prevent use of one or more systems onboard the base 12, such as to prevent use of the fluid delivery system 24 when the dry cleaning head 16 is in use. The capability to selectively disable or prevent use of systems included onboard the base 12 may be beneficial for the user to easily perform quick cleanups without undertaking additional steps associated with adjusting or otherwise configuring the base 12 or other components of the system 10 according to the connected cleaning head 16, 18. In other words, the user can simply and efficiently attach the desired cleaning head 16, 18 to the base 12 and commence cleaning without having to correspondingly manipulate systems onboard the base 12. It may be less desirable, for example, to use the dry cleaning head 16 to perform wet cleaning due to components of the dry cleaning head 16 being less suitable than the wet cleaning head 18 for cleaning liquids or other fluids. Accordingly, the automatic disablement/prevention may be desirable or advantageous in constraining systems of the base 12 according to the coupled cleaning head 16, 18, such as to protect components of the wet and/or dry cleaning heads 16, 18 and/or to prevent the use thereof with incompatible or less compatible debris.

Figure 8:
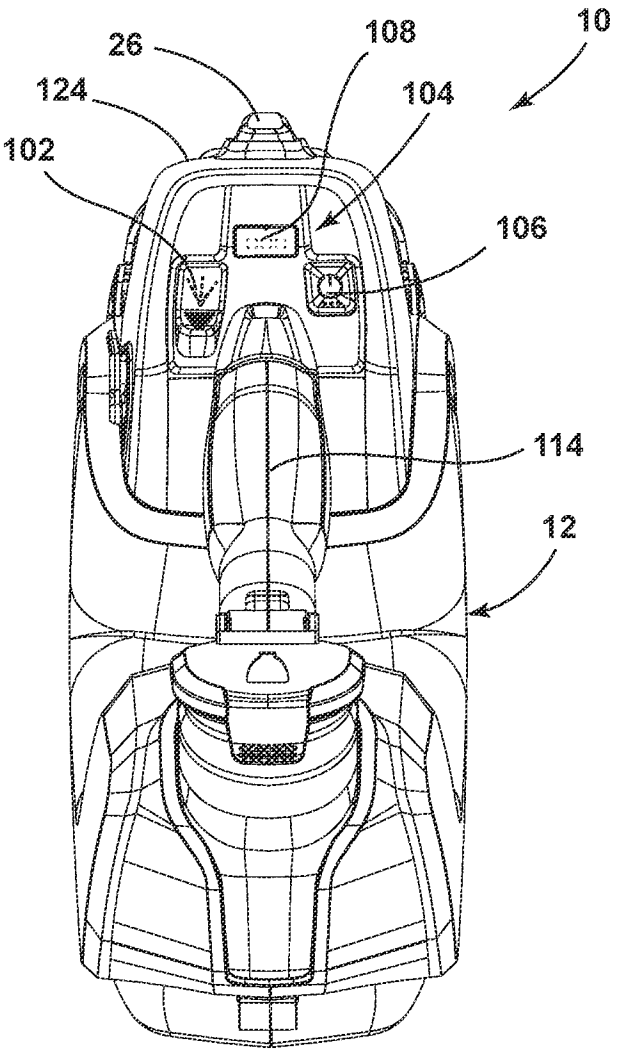
FIG. 8 is a rear perspective view of a handheld extraction cleaner system with a dry cleaning head being removed, according to the present disclosure.
Figure 7:
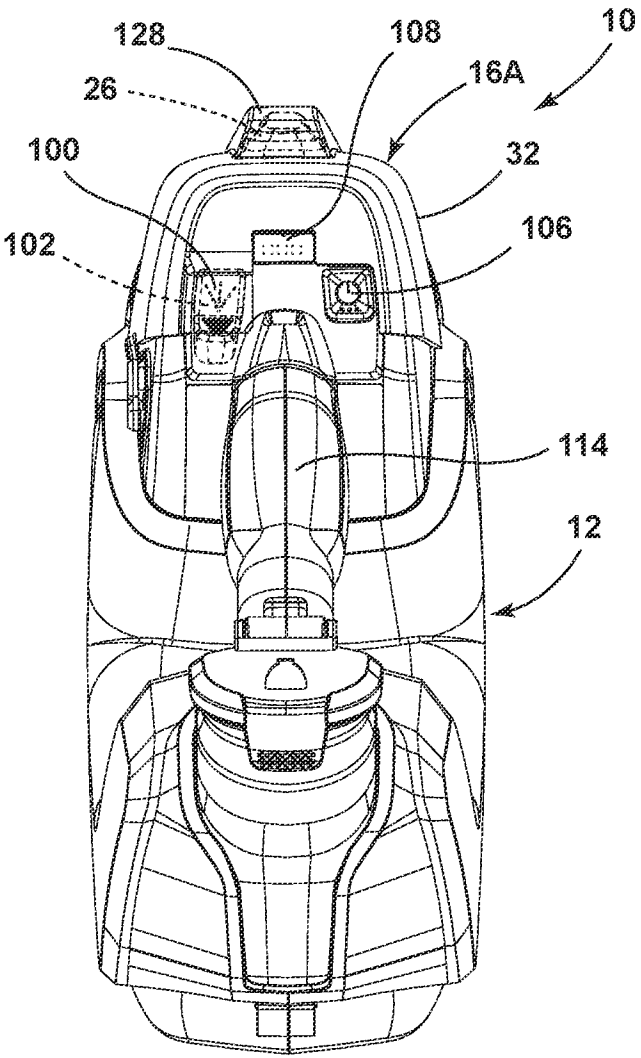
FIG. 7 is a rear perspective view of a handheld extraction cleaner system with a dry cleaning head, according to the present disclosure.

Referring to FIGS. 7 and 8, the handled extraction cleaner system 10 includes a cover 100 for blocking or preventing the use of the fluid delivery system 24. FIG. 7 illustrates an end view of the handheld extraction cleaner system 10 with the dry cleaning head 16A coupled with the base 12, and FIG. 8 illustrates the end view with the dry cleaning head 16A removed from the base 12. When the dry cleaning head 16A is coupled with the base 12, cover 100 included on the housing 32 of the dry cleaning head 16A is configured to disable or prevent use of a spray actuator 102.

The base 12 may include a user interface 104 associated with the control system to facilitate controlling operations of the base 12, such as the suction source 22 and the fluid delivery system 24. The user interface 104 may include the spray actuator 102 for controlling the fluid delivery system 24 to dispense a cleaning fluid to the cleaning surface. The user interface 104 may additionally include a power actuator 106 to control the powering of the suction source 22, such as in a binary manner whereby the suction source 22 is turned off and on or in an incremental manner whereby an amount of suction provided is proportional to an amount of pressure applied to the power actuator 106. The user interface 104 may also include a display 108 or other indicators for indicating a status or other operations for the base 12. The actuators 102, 106, and/or display 108 may be optionally configured as triggers, toggles, keys, switches, touch screens, or the like. The user interface 104 is shown for exemplary purposes as being positioned forwardly of a carrying handle 114 such that a user's thumb may depress or otherwise interact with the user interface 104 while the same hand grips the carry handle 114.

Referring again to FIG. 4, the housing 32 of the dry cleaning head 16A may include an upper housing 118 and a lower housing 120, with the cover 100 being included as part of a rearward end 122 of the upper housing 118 to extend over an upper section 124 of the base 12. The cover 100 may be shaped to cover an entirety of or overlay the spray actuator 102 such that a user is effectively prevented from using the spray actuator 102 with the same hand used to grip the carry handle 114. While it may be possible for a user to overcome the protection of the cover 100, it is believed that the integration of the cover 100 with the dry cleaning head 16A may be beneficial in thwarting or hindering use of the fluid distributor 26 under normal circumstances. This capability to prevent and/or disable use of the spray actuator 102 may be beneficial in ameliorating the likelihood of a user applying a cleaning solution while using the dry cleaning head 16A.

Referring still to FIG. 4 and again to FIG. 5, the wet cleaning head 18 may be configured to avoid obstructing or otherwise interfering with the spray actuator 102, thereby enabling the user to readily ascertain whether the appropriate cleaning head 16, 18 is attached for the desired cleaning operation. In other words, should the user desire application of the cleaning solution via the fluid distributor 26 while the dry cleaning head 16 is attached, the user may be able to readily recognize the need to switch to the wet cleaning head 18.

Referring still to FIGS. 4 and 5, the rearward end 122 of the housing 32 is shown as being shaped to cover most of the user interface 104 other than portions associated with the indicator or display 108 and the power actuator 106. The housing 32 may be shaped in other ways to facilitate covering the spray actuator 102. The illustrated configuration, however, may be advantageous in allowing the housing 32 to fit snugly over the base 12 to ameliorate the likelihood of the cover 100 being accidentally displaced and/or to limit vibration or other movements inducing squeaks or rattles while in use.

The rearward end 122 may be configured to fit over top of and to be disposed forwardly of the user interface 104 such that the fluid distributor 26 is retained within a cavity or other enclosure 128 of the housing 32. The housing 32 may optionally include clips or other retaining features 132 (see FIGS. 2 and 4) configured to facilitate removable attachment of the dry cleaning head 16 to the base 12. One non-limiting aspect of the present disclosure contemplates the upper housing 118 being coupled with or attached to the lower housing 120 with binders or other fasteners 136, which may be removable for servicing, but that may otherwise be intended to provide a relatively fixed and permanent connection.

The latches 132 may be configured to removably couple with the modular receiver 20 of the base 12. The latches 132 may be push-actuated latches or other removable connections amenable to permitting a user to conveniently switch out the dry cleaning head 16A. The latches 132 can be the same such that the different heads 16, 18 may be uncoupled/coupled in a similar manner.

As shown in FIG. 4, the housing 32 may include a flange 140 operable with a release 142 on the recovery tank 34 to facilitate removably connecting the recovery tank 34 thereto. In this manner, the recovery tank 34 may be removably connected to the housing 32, and the housing 32 may in turn be removably connected to the base 12. The recovery tank 34 may include a tank connector configured to removably connect to the mesh screen 48, such as through a threaded connection or a snap-fit. The mesh screen 48 may additionally or instead optionally be removably connected to the filter 50, such as with a clip.

The filter 50 may include a filter housing 148 configured to removably connect the filter 50 to the housing 32 or alternatively to the recovery tank 34. The separator 46 (i.e., the mesh screen 48 and the filter 50) is predominately described as being removably connected for purposes of enabling the replacement and/or cleaning thereof. The present disclosure, however, fully contemplates other components and configurations for the separator 46, including the separator 46 being an integrated unit of the type whereby the mesh screen 48 and/or the filter may be permanently connected to the housing 32.

A leading end 150 of the recovery tank 34 forming the suction nozzle 44 may be sloped in a rearward manner to facilitate scooping debris from the cleaning surface. As shown in FIG. 3, the suction air stream may be configured to facilitate extracting the debris through a channel 152 associated with the suction nozzle 44. The channel 152 may optionally include an accessory tool, such as a hose extension, configured to extend into and out of the outboard of the suction nozzle 44 when pushed and pulled. The tank inlet flap 54 may be positioned relative to an output of the channel 152 to rotatably cover and uncover the suction nozzle 44.

A biasing member 154 may be configured to bias the inlet flap 54 toward covering the suction nozzle 44, such as with a spring or other biasing member 154 configured to permit the flap 54 to uncover or swing outwardly of the suction nozzle 44 when the suction air stream is active. Upon cessation of the suction air stream, the inlet flap 54 may return to covering the suction nozzle 44 and thereby prevent collected debris from exiting the recovery tank 34 through the suction nozzle 44. The debris retained within the recovery tank 34 may thereafter be removed by actuating the release 142 and pivoting the recovery tank downwardly away from the flanges 140 or other securing elements of the housing 32. The recovery tank 34 may optionally be threadably connected or attached to the housing 32 in another manner, such as with a quarter turn cup whereby the cup may be rotated to disengage the recovery tank 34 for debris removal. While the leading end 150 of the recovery tank 34 is illustrated as being sloped in a rearward manner, it is within the scope of the present disclosure for the leading end 150 to be sloped in a forward manner or to have no slope.

Figure 9:
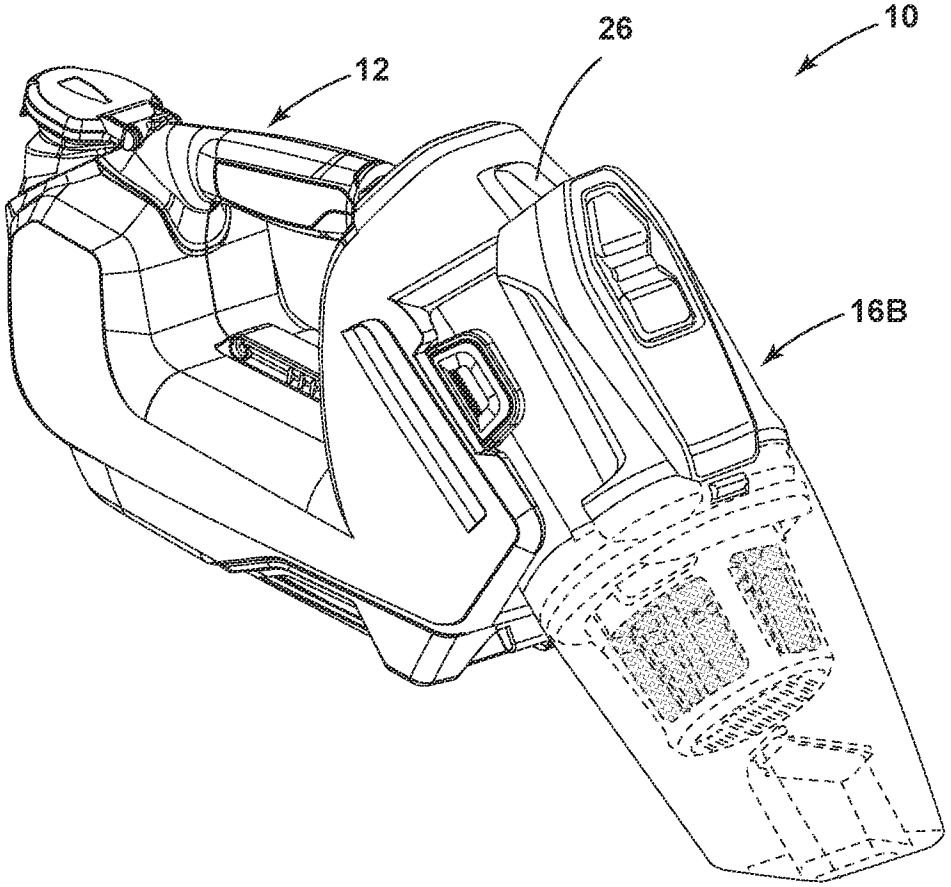
FIG. 9 is a front perspective view of a handheld extraction cleaner system with a second dry cleaning head, according to the present disclosure.
Figure 10:
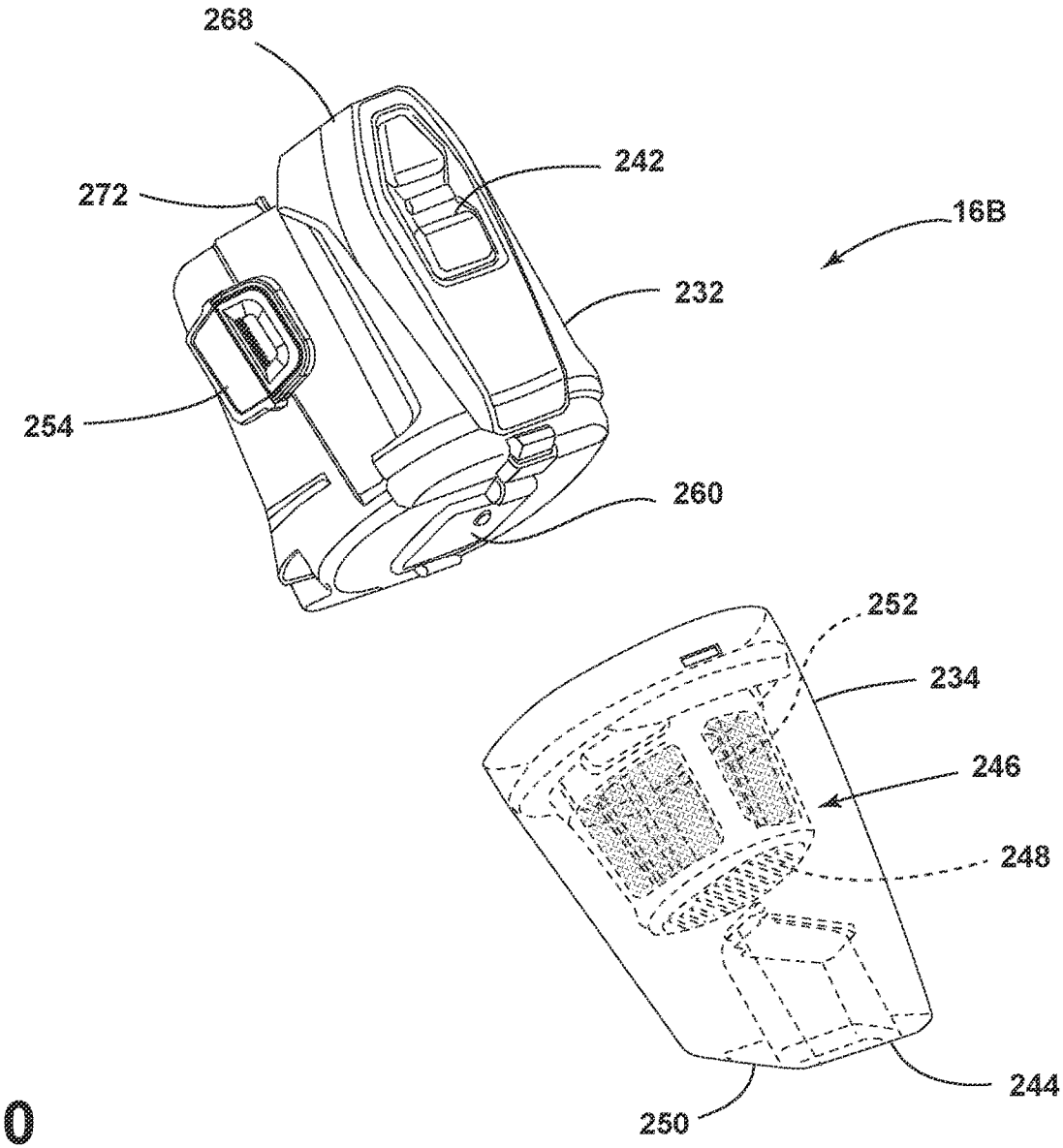
FIG. 10 is an exploded front perspective view of a second dry cleaning head, according to the present disclosure.

With reference to FIGS. 9 and 10 illustrate the handheld extraction cleaner system 10 is illustrated with the second dry cleaning head 16B coupled with the base 12 in accordance with one non-limiting aspect of the present disclosure. The dry cleaning head 16B may be similar to the above-described dry cleaning head 16A insofar as having a housing 232 configured to interconnect a recovery tank 234 with the base 12. A release 242 may be configured to removably connect to the recovery tank 234 with the housing 232. The interconnection between the recovery tank 234, the housing 232, and the base 12 permits a suction air stream provided from the suction source 22 to extract debris from a cleaning surface via a nozzle 244. The recovery tank 234 may include a separator 246 having a pre-filter 248 disposed proximate to a leading end 250 of the recovery tank 234, which forms the nozzle 244. The leading end 250 may be sloped differently than the above-described suction nozzle 44 so as to be forward sloping and/or parallel with the cleaning surface.

The recovery tank 234 may include the separator 246 having the pre-filter 248, such as a mesh screen, for example, and a fine filter 252 to facilitate separate debris from the air suction stream. The release 242 may be configured to removably connect to the recovery tank 234 and/or the separator 246 to the housing 232, optionally with an additional filter 260 disposed therebetween. One or more latches 254 may be configured to removably connect the housing 232 to the base 12 to facilitate removable attachment of the dry cleaning head 16B to the base 12 in a manner similar to that of the latches 132 discussed herein. In this way, the recovery tank 234 is coupled to the housing 232 via the release 242, and the housing 232 is coupled to the base 12 with the latches 254. The housing 232 may be configured to provide upper and lower portions for enclosing a conduit configured to provide a non-torturous pathway between the recovery tank 234 and the suction source 22.

The dry cleaning head 16B may be differentiated from the above-described dry cleaning head 16A at least insofar as the housing 232 does not include a cover portion extending over the base 12 to cover features of the user interface 104 for purposes of preventing or disabling the use thereof. The dry cleaning head 16B, instead, may include a protuberance or other blocking feature 268 in abutment with the fluid distributor 26 on the base to mechanically prevent applying the cleaning solution to the cleaning surface. The blocking feature 268 need not necessarily prevent any or all fluid from dispensing through the fluid distributor 26 and nonetheless may operate to effectively prevent or disable use of the fluid delivery system 24 as any fluid dispensing from the fluid distributor 26 would leak along the sides of the base 12 or in an inconsistent manner such that the user would readily ascertain a different form of operation. The user would then understand a corrective action being needed (e.g., switching out the dry cleaning head 16 for the wet cleaning head 18).

The dry cleaning heads 16 are described above with respect to covering or configured to overlay the spray actuator 102 and/or blocking the fluid distributor 26 as exemplary features for disabling or preventing use of systems onboard the base 12. These features may be considered as overrides included on the dry cleaning heads 16 configured to automatically override use of systems onboard the base 12. This is done for exemplary and non-limiting purposes as the present disclosure fully contemplates the use of overrides included on the base 12, rather than or in addition to the dry cleaning heads 16, which may optionally operate in cooperation with corresponding features included on the dry cleaning heads 16.

Figure 11:
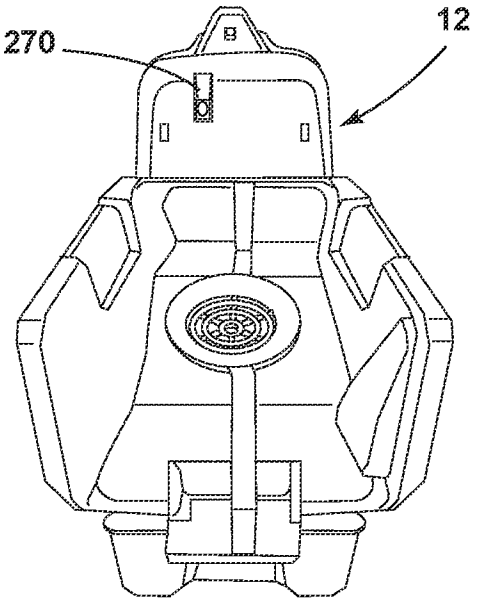
FIG. 11 is a rear perspective view of a base of a handheld extraction cleaner system that includes a switch, according to the present disclosure.

FIG. 11 illustrates a switch 270 included on the base 12 in accordance with one non-limiting aspect of the present disclosure. The switch 270 may cooperate with an actuator 272 included on one of the dry cleaning heads 1616B, which may be considered an override feature that facilitates disabling the fluid delivery system 24. The switch 270 may be configured as part of the control system of the base 12 whereby actuation of the switch 270 directs the control system to disable use of the fluid delivery system 24, or optionally another system included on the base 12. The switch 270 may be configured as a mechanical type of device whereby a key or a ramp included on an end of the housings 32, 232 may be configured to act as the actuator 272 for purposes of actuating the switch 270. The switch 270 may optionally be configured as a sensor, such as a pressure sensor, an optical sensor, a magnetic sensor, or a proximity sensor configured to detect the presence of one of the dry cleaning heads 16, 16B.

The switch 270 is described as being actuatable in response to contact, proximity, etc. with the dry cleaning head 16 for exemplary purposes as the present disclosure fully contemplates the switch 270 being operable with the wet cleaning head 18. The switch 270, for example, may be used with the wet cleaning head 18 to enable liquid spraying whereby the liquid spraying may be disabled unless the wet cleaning head 18 is coupled with the base 12. The switch 270 (e.g., the attendant sensors, detectors, etc.) may, at least in this sense, be considered as associated with the wet cleaning head 18 insofar as the liquid spraying is disabled when the dry cleaning head 16 is coupled.

The base 12 may optionally include multiple switches 270, such as on different sides of the base 12, configured to interact with the dry cleaning heads 16 and the wet cleaning head 18. For example, one switch 270 may be included on the left side of the base 12 to interact with the dry cleaning head 16 and another switch 270 may be included on the right side of the base 12 to interact with the dry cleaning head 18. Such a configuration for multiple switches 270 may be useful for the control system in differentiating between the dry cleaning head 16 and the wet cleaning head 18, and based thereon, in implementing corresponding or related control of the base 12. In such examples, the control system may disable the fluid delivery system 24 when the first switch 270 is engaged by the dry cleaning head 16 and activate the fluid delivery system, 24 when the second switch 270 is engaged by the wet cleaning head 18. The present disclosure fully contemplates any of the spray disabling/prevention features described herein being operable in a similar manner with this dry cleaning head 16B. The switches 270 may physically prevent the dispensing of fluid from the fluid delivery system 24 or electronically temporarily prevent or disable the function of the fluid delivery system 24 (such as the activation of the pump 28) to prevent the fluid from being dispensed.

Figure 12:
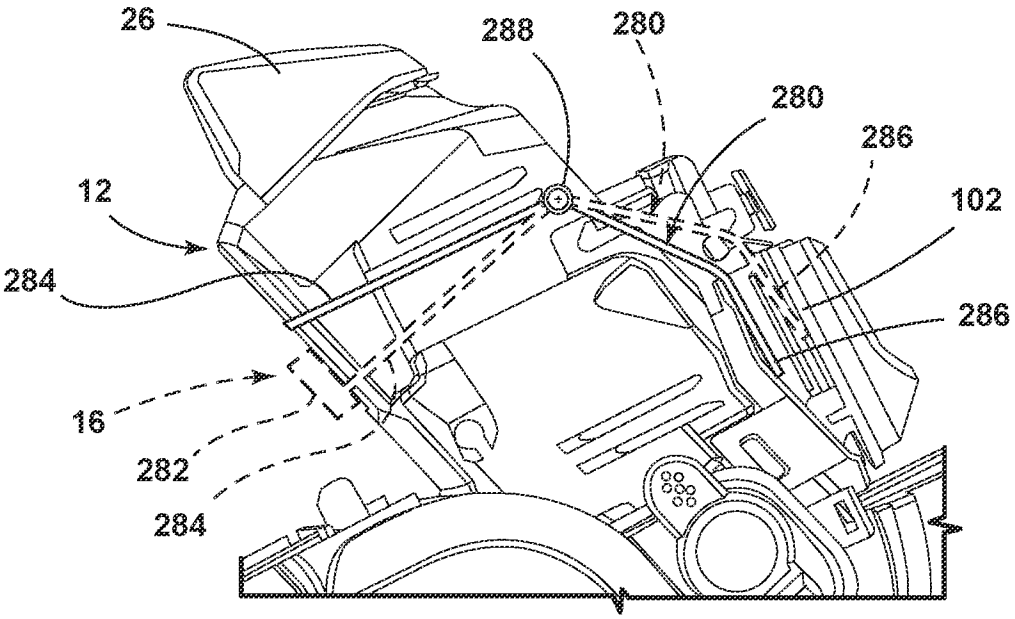
FIG. 12 is a side elevational view of a base of a handheld extraction cleaner system that includes a mechanical shutoff, according to the present disclosure.

With reference to FIG. 12, a mechanical shutoff 280 may be included on the base 12 in accordance with one non-limiting aspect of the present disclosure. The shutoff 280 may be a mechanical key configured to selectively lock or prevent actuation of the spray actuator 102. The shutoff 280 may be an extension that sits under the spray actuator 102 to physically prevent the spray actuator 102 from being depressed and thereby actuating the fluid delivery system 24 when the dry cleaning head 16 is coupled to the base 12.

The dry cleaning head 16 may include an actuator 282 (e.g., an override feature), which is shown schematically and may be included as a projection on a rear face of the dry cleaning head 16. When the dry cleaning head 16 is coupled to the base 12, the actuator 282 may push against the shutoff 280, causing a spray de-activating lever 284 to pivot about a pivot axis 288, bringing a spray button blocking arm 286 into an engagement position (shown in dashed line) with an underside of the spray button 102. With the spray button blocking arm 286 abutting the underside of the spray button 102, the user is unable to depress the spray button 102 to activate the fluid delivery system 24 to spray a fluid. When the dry cleaning head 16 is removed, the dry cleaning head actuator 282 is no longer present and thus is not pushing against the lever 284, allowing the spray de-activating arm 286 to rotate back into the disengaged position (shown in solid line), thereby allowing the user to depress the spray button 102 to spray a cleaning fluid.

Figure 13:
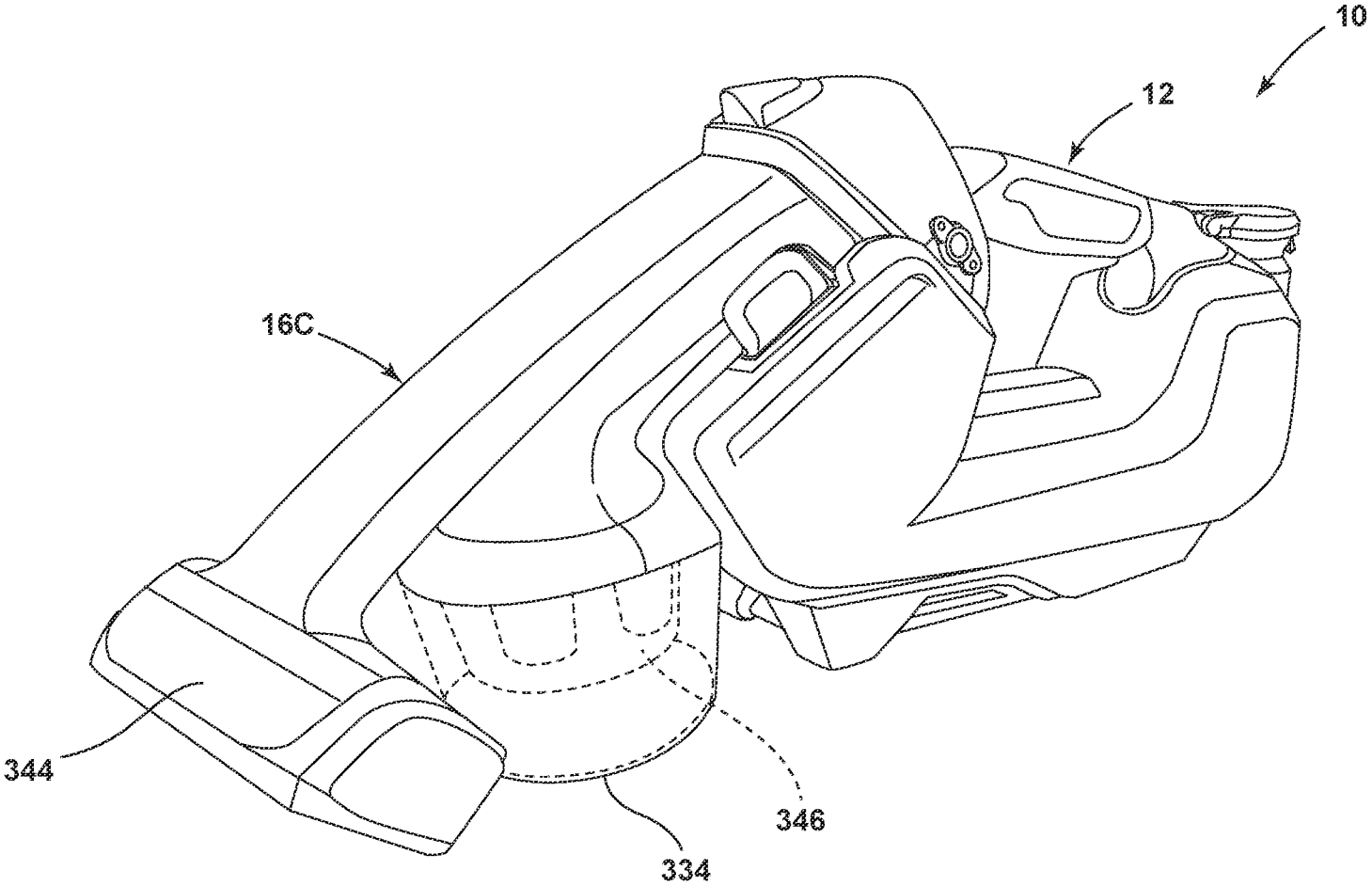
FIG. 13 is a side perspective view of a handheld extraction cleaner system with a third dry cleaning head, according to the present disclosure.

Referring to FIG. 13, the handheld extraction cleaner system 10 is illustrated with the third dry cleaning head 16C coupled with the base 12 in accordance with one non-limiting aspect of the present disclosure. The dry cleaning head 16C may include a recovery tank 334 and a suction nozzle 344 outboard of the recovery tank 334. The recovery tank 334 may be rotatably secured to an underside of the suction nozzle 344 and include a separator 346 to facilitate separating debris from the suction air stream provided by the base. The present disclosure fully contemplates any of the spray disabling/prevention features described herein being operable in a similar manner with this dry cleaning head 16C.

Figure 14:
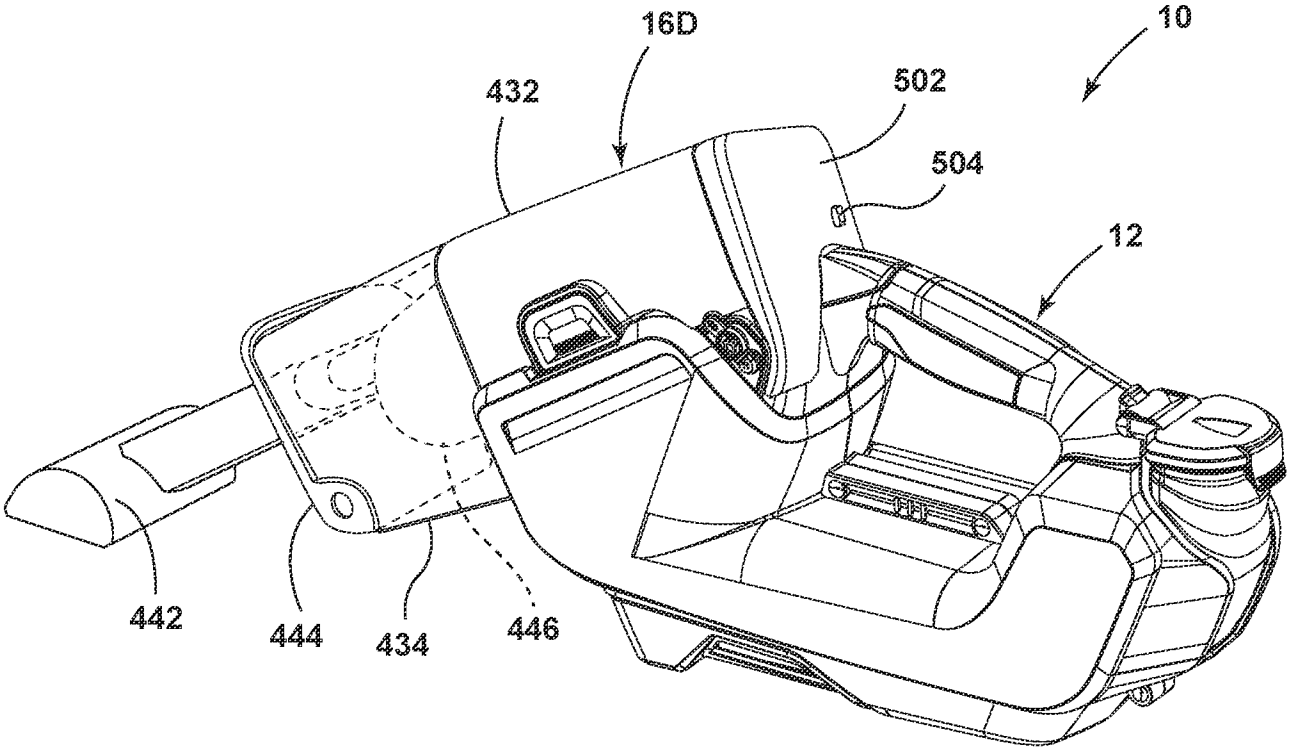
FIG. 14 is a side perspective view of a handheld extraction cleaner system with a fourth dry cleaning head, according to the present disclosure.
Figure 15:
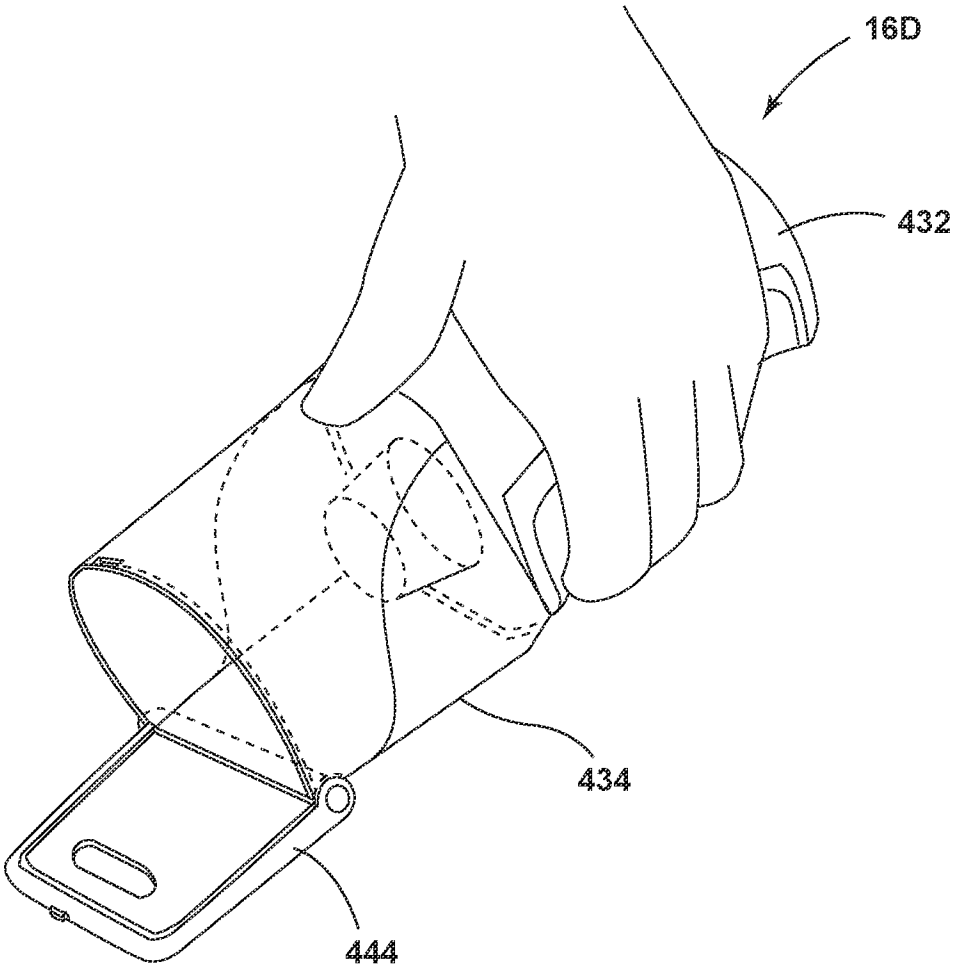
FIG. 15 is a side perspective view that illustrates emptying a fourth dry cleaning head, according to the present disclosure.

With reference to FIGS. 14 and 15, the handheld extraction cleaner system 10 is illustrated with the fourth dry cleaning head 16D in accordance with one non-limiting aspect of the present disclosure. FIG. 15 illustrates a perspective view of a user emptying the fourth dry cleaning head 16D in accordance with one non-limiting aspect of the present disclosure. The dry cleaning head 16D may include a housing 432 and a recovery tank 434 interconnected with the base 12 via the housing 432.

A removable part 442 may be included on a hinged door 444 at a front of the recovery tank 434 to facilitate extracting debris from a cleaning surface using the suction air stream generated with the base 12. The removable part 442 may be similarly attachable to the suction nozzle 44 (see FIG. 3). The door 444 may be hinged to releasably open and close to permit easy removal of collected debris.

The recovery tank 434 may additionally include a separator 446 configured to separate debris from the suction air stream. The housing 432 may be configured in the illustrated manner to include a user interface cover or cap 502 configured to cover an entirety of the user interface 104 (see FIG. 8). The cap 502 may include a power actuator extension or push button 504 configured to facilitate actuating the power actuator 106 without exposing the spray actuator 102 so as to effectively disable and/or prevent use of the spray actuator 102. The cap 502, alternatively, may include an aperture in place of the button 504 for enabling a finger of the user to fit through and actuate the power actuator 106 (i.e., access the power actuator 106). The present disclosure fully contemplates any of the spray disabling/prevention features described herein being operable in a similar manner with this dry cleaning head 16D.

Figure 16:
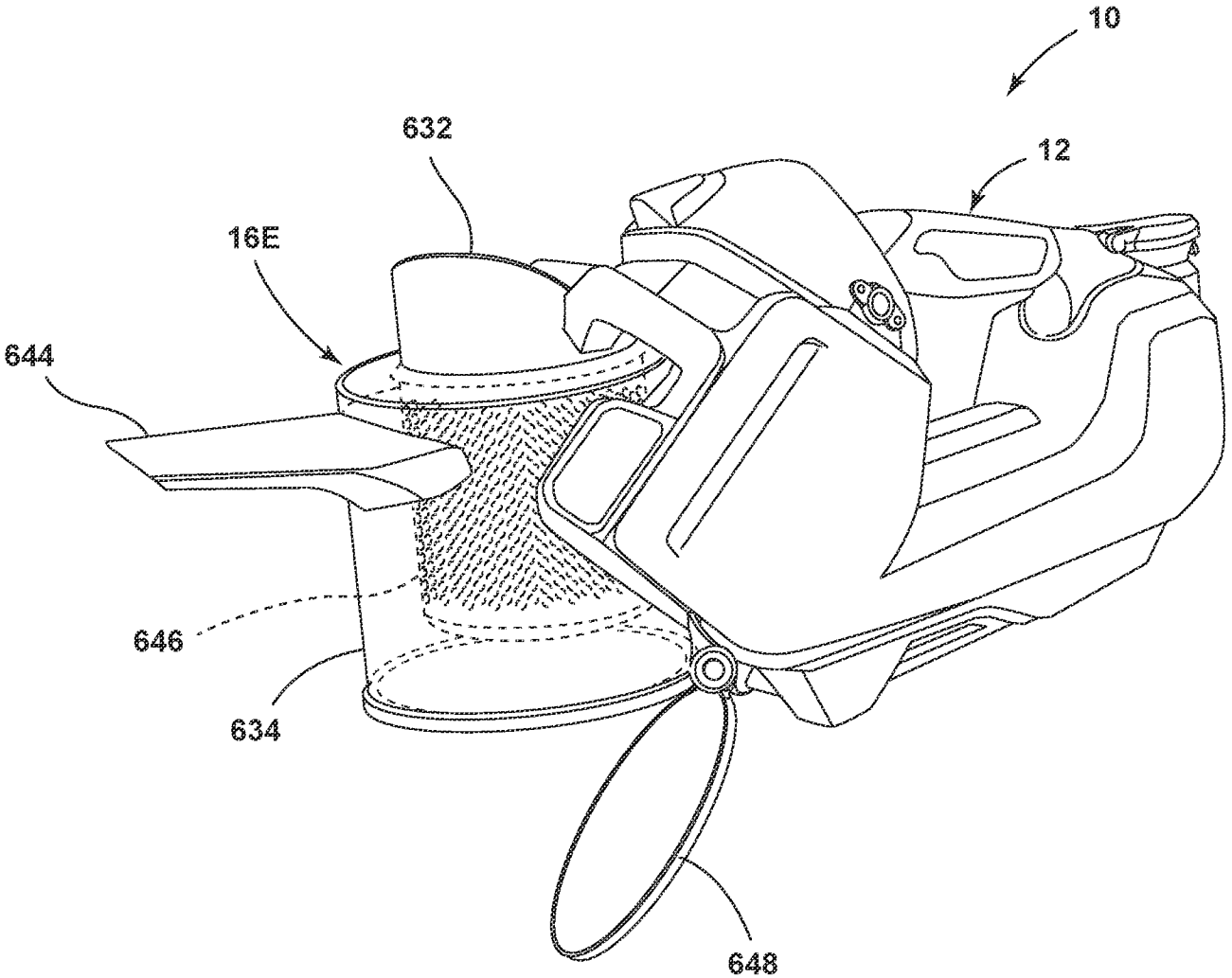
FIG. 16 is a side perspective view of a handheld extraction cleaner system with a fifth dry cleaning head, according to the present disclosure.

FIG. 16 illustrates a perspective view of the handheld extraction cleaner system 10 with the fifth dry cleaning head 16E in accordance with one non-limiting aspect of the present disclosure. The dry cleaning head 16E may include a housing 632 and a recovery tank 634 interconnected with the base 12 via the housing 632. A suction nozzle 644 may be included at an upper portion of the recovery tank 634 to extend out therefrom for cleaning hard-to-reach areas. The recovery tank 634 may include a separator 646 configured to facilitate separating the recovered debris from the suction air stream and a hinged door 648. The present disclosure fully contemplates any of the spray disabling/prevention features described herein being operable in a similar manner with this dry cleaning head 16E.

Referring to FIGS. 17-21, an additional or alternative configuration of the extraction cleaner system 10 utilizes a dry vacuum tool 700 or dry vacuum accessory 700, configured to provide similar functions as the dry cleaning heads 16 set forth herein. The dry vacuum tool 700 is an accessory that may be selectively coupled to the extraction cleaner system 10, which has an accessory hose 702. Multiple configurations of the extraction cleaner system 10 can include the accessory hose 702, including different portable cleaning apparatuses and upright cleaning apparatuses, collectively referred to herein as cleaning apparatuses 704. In various configurations, the cleaning apparatus 704 that supports the dry vacuum tool 700 includes the base housing 12 with the carry handle 114, which allows a user to pick up and carry the portable cleaning apparatus 704. A non-limiting example of a portable deep cleaner includes U.S. Pat. No. 9,474,424, the contents of which are incorporated herein by reference in their entirety.

In additional examples, the cleaning apparatus 704 that supports the dry vacuum tool 700 can be in the form of an upright deep cleaner having an accessory hose 702, a non-limiting example of which can be found in U.S. Pat. No. 10,188,252, the contents of which are incorporated herein by reference in their entirety. It is also contemplated that the dry vacuum tool 700 may be used with upright cleaning apparatuses 704 or other configurations of cleaning apparatuses 704 without departing from the teachings herein. The cleaning apparatuses 704 are generally non-limiting examples of the extraction cleaner system 10, which is often used to clean rugs, carpeting, drapes, upholstered surfaces, etc.

Figure 17:
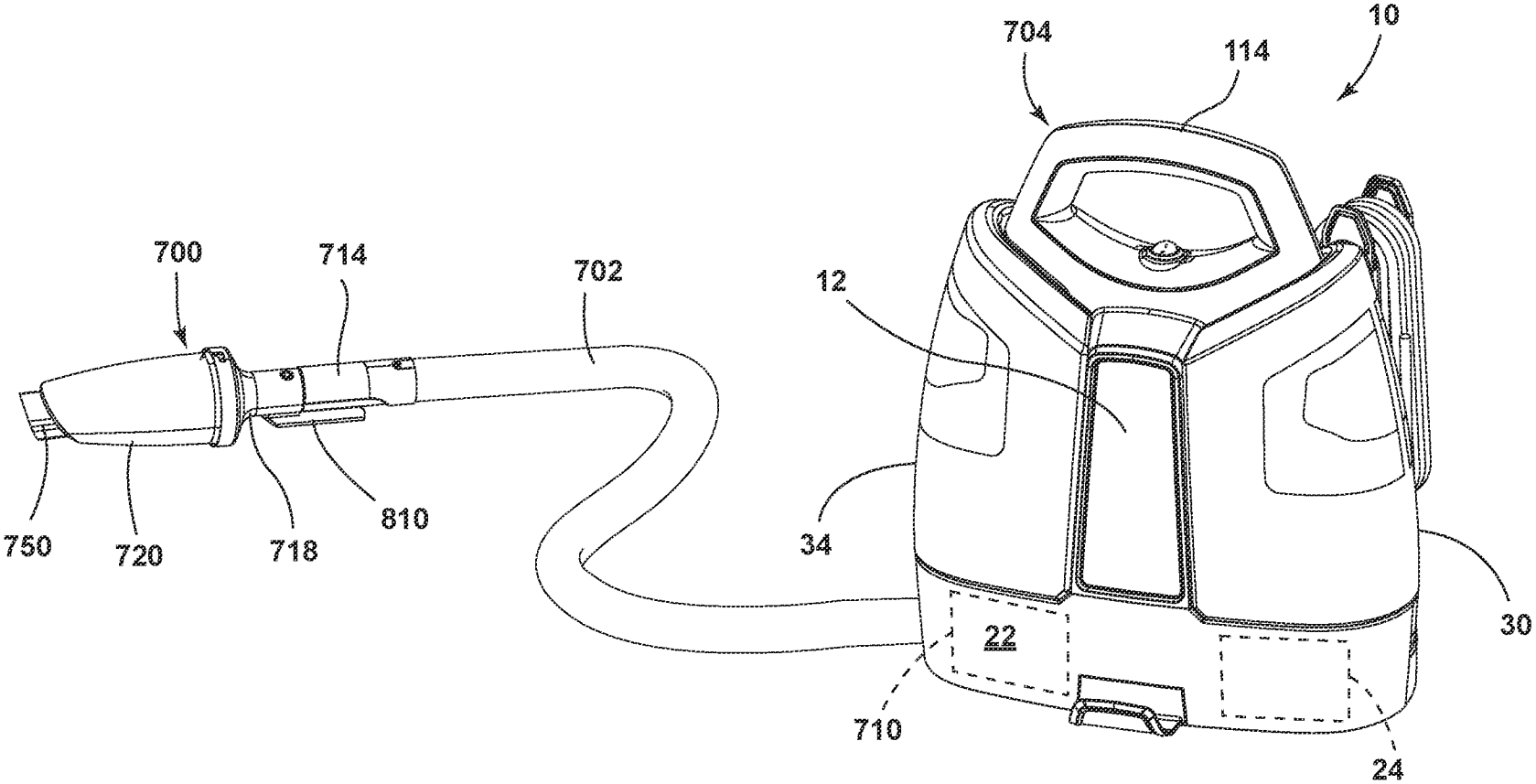
FIG. 17 is a side perspective view of a cleaning apparatus with a dry vacuum tool accessory, according to the present disclosure.

Referring still to FIG. 17, each configuration of the cleaning apparatus 704 includes the base 12, which may also be referred to as a housing 12 or a base housing 12, a suction assembly 710, and the fluid delivery system 24. The suction assembly 710 and the fluid delivery system 24 may collectively be referred to as a fluid directing and recovery system. The fluid directing and recovery system is configured to direct fluids in multiple directions and is also configured to direct both liquids and air. Different tools may be utilized with the cleaning apparatus 704 and can utilize one or both of the suction assembly 710 and the fluid delivery system 24.

The suction assembly 710 is generally utilized for extracting and storing dispensed fluid and/or debris material from the surface to be cleaned. The suction assembly 710 includes the suction source 22, such as a motorized fan assembly, configured to draw air and materials into the dry vacuum tool 700 or the recovery tank 34 operably coupled with the base housing 12. The suction assembly 710 typically operates to produce a suction or vacuum effect to draw the debris material from the surface to be cleaned into the recovery tank 34. In various aspects, the suction assembly 710 may also be used to draw fluid within the recovery tank 34. The dry vacuum tool 700 is in fluid communication with the suction source 22 for generating the vacuum effect.

The fluid delivery system 24 is utilized for storing and delivering the fluid to the surface to be cleaned. In various aspects, the fluid delivery system 24 is configured to direct fluid, such as liquid from the cleaning solution tank, or supply tank 30, for use in the cleaning process. The cleaning apparatus 704 includes the supply tank 30, which is configured to hold and store the fluid. The fluid may be water, a cleaning solution, or a combination thereof. For example, many household cleaning tasks can be performed using water in combination with a liquid cleaning solution that contains surfactants, stabilizers, frequent fragrances, or other active and inactive ingredients. The fluid can include any practicable cleaning fluid or combination of cleaning fluids, including but not limited to, water compositions, concentrated detergents, diluted detergents, or combinations thereof. The cleaning apparatus 704 may optionally include a heater to warm the liquid that is dispensed.

Referring still to FIG. 17, the cleaning apparatus 704 may be used with the dry vacuum tool 700 that is selectively coupled the cleaning apparatus 704 by the accessory hose 702 and which is manually maneuverable by the user. Each of the suction assembly 710 and the fluid delivery system 24 is operable when the dry vacuum tool 700 is coupled to the base housing 12 and when the dry vacuum tool 700 is not coupled to the base housing 12. When not used with the dry vacuum tool 700 or another accessory, the cleaning apparatus 704 utilizes the suction assembly 710 and the fluid delivery system 24 for various cleaning functions.

The dry vacuum tool 700 is configured to utilize various features and functions of the cleaning apparatus 704, including the suction assembly 710. When the dry vacuum tool 700 is used with the cleaning apparatus 704, the suction assembly 710 is used with the dry vacuum tool 700 separate from the functions of the cleaning apparatus 704. The fluid delivery system 24 may be coupled with the dry vacuum tool 700 but may be prevented from dispensing liquid to the dry vacuum tool 700 or the surface to be cleaned, thereby blocking the function of the fluid delivery system 24. The cleaning apparatus 704 may include valves or similar features to direct fluid communication between the dry vacuum tool 700 and the base housing 12, as well as to and from other locations of the cleaning apparatus 704 when the dry vacuum tool 700 is not coupled to the base housing 12.

Figure 18:
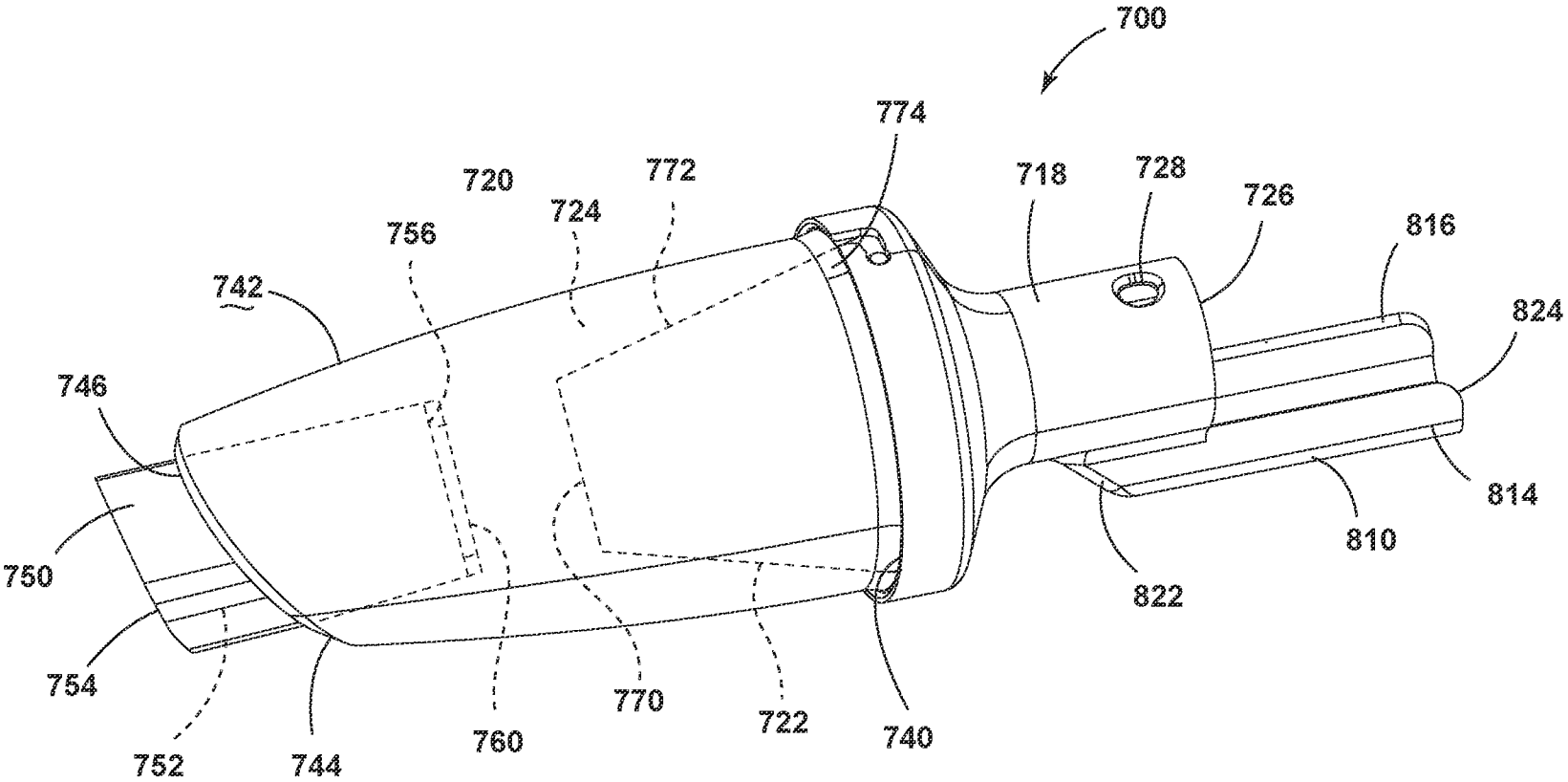
FIG. 18 is a side perspective view of a dry vacuum tool for a cleaning apparatus, according to the present disclosure.
Figure 19:
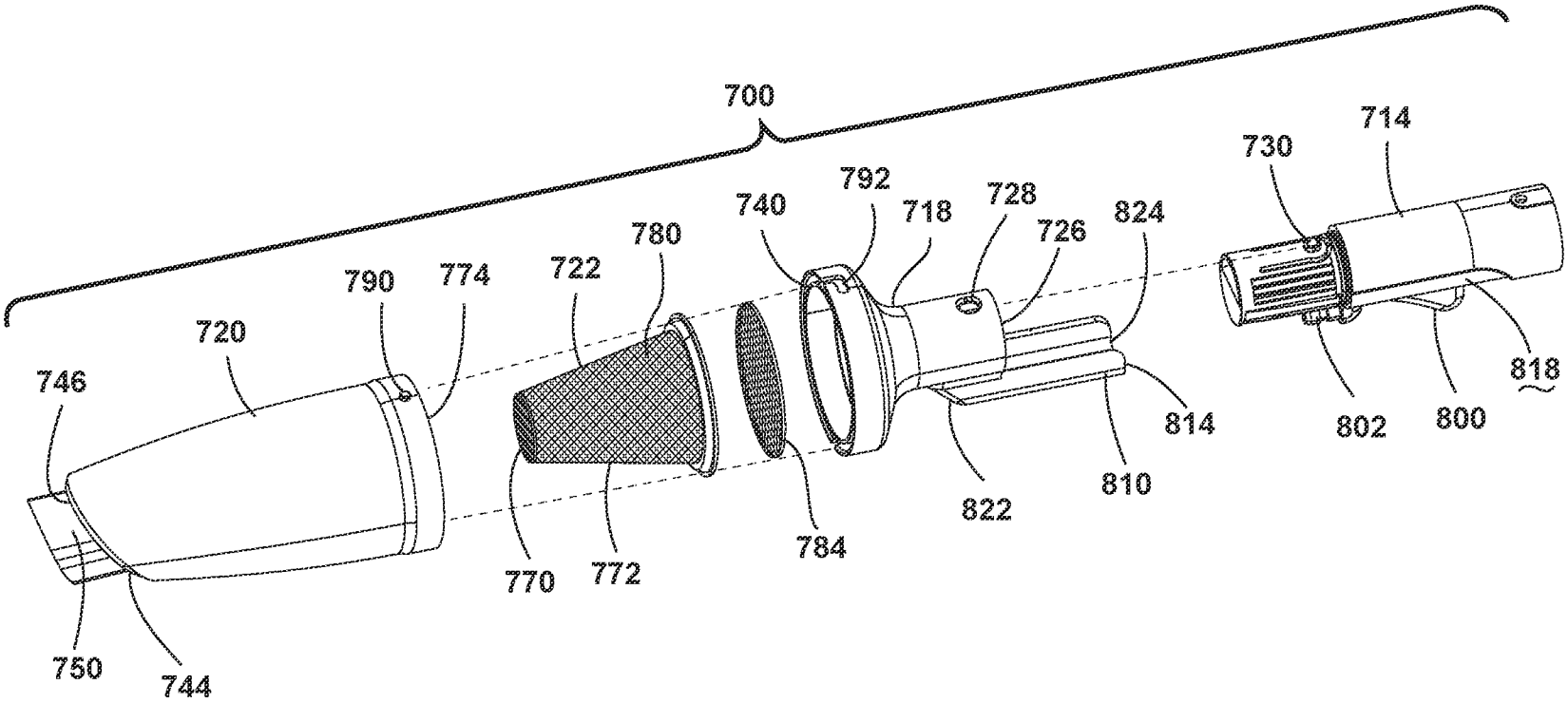
FIG. 19 is a side perspective exploded view of a dry vacuum tool and a wand for a cleaning apparatus, according to the present disclosure.

Referring still to FIG. 17, and again to FIGS. 18 and 19, the accessory hose 702 is coupled with the dry vacuum tool 700 to provide fluid communication between the cleaning apparatus 704 and the dry vacuum tool 700. A wand 714 is coupled to a distal end of the accessory hose 702 and is configured to be inserted into a support body 718 of the dry vacuum tool 700 to couple the dry vacuum tool 700 to the wand 714. A specific alignment between the dry vacuum tool 700 and the wand 714 may be advantageous for maximizing fluid communication between the dry vacuum tool 700 and the suction assembly 710.

The wand 714 is configured to provide a grasping location, where the user may grasp the wand 714 to move the dry vacuum tool 700 relative to the surface to be cleaned and provide the cleaning function. The dry vacuum tool 700 is configured to collect, capture, or trap lint, hair, debris, and other similar materials to be collectively referred to herein as debris materials or dry debris materials. Generally, the dry vacuum tool 700 is utilized for dry messes or primarily dry messes. Accordingly, blocking the delivery of the fluid from the fluid delivery system 24 may be advantageous for preventing dry messes from becoming a combination of wet and dry messes, which may affect the function of the dry vacuum tool 700.

The dry vacuum tool 700 includes the support body 718 for engaging the wand 714, a secondary or intermediate recovery tank 720 coupled to the support body 718, and a separator 722 disposed within an interior 724 of the intermediate recovery tank 720. The support body 718 includes an open, proximal receiving end 726, which defines an opening for receiving the wand 714. The support body 718 defines an aperture 728 proximate to the opening for the wand 714, which is configured to receive a protrusion 730 on the wand 714 to secure the engagement between the dry vacuum tool 700 and the wand 714.

The support body 718 includes a distal receiving end 740 configured to receive the intermediate recovery tank 720. The intermediate recovery tank 720 defines the hollow interior 724 for housing the separator 722 and collected debris material. The intermediate recovery tank 720 has a generally conical or frusto-conical shape, which may also be slightly curved or rounded. This shape may provide a narrower dry vacuum tool 700, which maximizes the maneuverability of the dry vacuum tool 700 relative to the surface to be cleaned. Further, the intermediate recovery tank 720 may have a smooth outer surface 742, which may be advantageous for moving the intermediate recovery tank 720 over the surface to be cleaned and minimizing any catching of the intermediate recovery tank 720 of the surface. The intermediate recovery tank 720 may have other shapes (e.g., rectangular, trapezoidal, triangular, etc.) without departing from the teachings herein. Additional shapes or configurations may be advantageous for different opening styles (such as to remove captured debris materials), locating the separator 722, poke yoke assembly, etc.

The intermediate recovery tank 720 has a leading end 744 that defines an inlet 746 for capturing the debris material from the surface to be cleaned. In various aspects, the leading end 744 is angled relative to the support body 718. The angled or obliquely-oriented leading end 744 of the intermediate recovery tank 720 may be advantageous for engaging various surfaces and crevices to be cleaned.

Referring still to FIGS. 18 and 19, the dry vacuum tool 700 includes a cap 750 configured as a suction nozzle, which is coupled to the leading end 744 of the intermediate recovery tank 720. The cap 750 may be a separate component coupled to the intermediate recovery tank 720 or may be integrally formed with the intermediate recovery tank 720. The cap 750 extends through the leading end 744. The cap 750 is partially disposed within the interior 724 of the intermediate recovery tank 720 and partially extends outward, away from the leading end 744. The cap 750 defines a guide channel 752 for airflow directed into the intermediate recovery tank 720. The cap 750 has an inlet end 754 disposed outside the intermediate recovery tank 720 and an outlet end 756 disposed within the interior 724 of the intermediate recovery tank 720. The inlet end 754 of the cap 750 is generally smaller than the leading end 744 of the intermediate recovery tank 720, which may assist in moving the dry vacuum tool 700 over smaller surfaces and crevices to collect the dry debris materials.

The cap 750 includes a flap 760 coupled to the outlet end 756 and disposed within the interior 724 of the intermediate recovery tank 720. The flap 760 is configured to open when the vacuum effect is applied to draw debris material into the interior 724. When the suction effect is stopped, the flap 760 is configured to close to retain the debris material within the interior 724 of the intermediate recovery tank 720 and prevent the release of the debris material through the inlet 746.

In various aspects, a biasing member may be configured to bias the flap 760 to a closed state. In such examples, the biasing member, such as a spring, magnets, or other biasing features, biases the flap 760 toward the closed state and permits the flap 760 to rotate to an opened state to open the guide channel 752 when the vacuum effect or suction air stream is active. Accordingly, the vacuum effect is sufficient for overcoming the biasing force of the biasing member. Upon cessation of the suction air stream, the flap 760 returns to covering the guide channel 752. It is also contemplated that a biasing force from the materials of the flap 760 and/or gravitational forces may be used to close the flap 760.

The dry vacuum tool 700 includes the separator 722, which is positioned within the interior 724 of the intermediate recovery tank 720. The separator 722 generally defines a shape to match and seal the intermediate recovery tank 720. In the illustrated example with the conical intermediate recovery tank 720, the separator 722 also defines a conical or frusto-conical shape. The separator 722 includes an end wall 770 and a sidewall 772. The end wall 770 is disposed proximate to the outlet end 756 of the cap 750, and the sidewall 772 extends from the end wall 770 to proximate a coupling end 774 of the intermediate recovery tank 720 that engages the support body 718. The sidewall 772 is spaced from an inner surface 776 of the intermediate recovery tank 720 and defines an opening that is generally co-axial with an opening defined by the coupling end 774 of the intermediate recovery tank 720.

The end wall 770 of the separator 722 may be a solid component or may be a pre-filter, such as a mesh screen, while the sidewall 772 includes or forms a fine filter that defines apertures 780 to allow airflow therethrough and facilitates separation of debris from the air suction stream. In various examples, the sidewall 772 of the separator 722 is constructed of a fine mesh material. Accordingly, the separator 722 includes two components, which are the pre-filter and the fine filter that separate the debris materials from the airstream and retain the debris materials within the intermediate recovery tank 720. The apertures 780 of the sidewall 772 are sufficiently small to allow air to flow therethrough but prevent the debris material collected by the dry vacuum tool 700 from passing through the separator 722. In this way, the separator 722 is configured to retain the captured debris material within the interior 724 of the intermediate recovery tank 720 and allow the airflow to continue along an airflow path 782 through the dry vacuum tool 700, the wand 714, and the accessory hose 702 to be exhausted from the cleaning apparatus 704.

Further, an additional filter element 784 may be included between the separator 722 and the airflow path 782 through the accessory hose 702 (e.g., a hose air path). The additional filter element 784 may be coupled to the separator 722 and/or disposed within the support body 718. This additional filter element 784 assists with preventing the debris material from leaving the dry vacuum tool 700 and, ultimately, prevents the capture of the debris material in the primary recovery tank 34 of the extraction cleaner system 10. The pre-filter and the fine filter of the separator 722 and the additional filter element 784 are advantageous for capturing the debris material in the dry vacuum tool 700 and preventing the debris material from reaching the accessory hose 702 or the primary recovery tank 34. Often, after utilizing other functions of the extraction cleaner system 10, liquid can be in the primary recovery tank 34 from a previous cleaning process. This liquid, when mixed with dry debris, can form a mud-like mixture, which can be difficult to clean. The additional filter element 784 assists with capturing the dry debris material that may have traveled through the separator 722.

Figure 20:
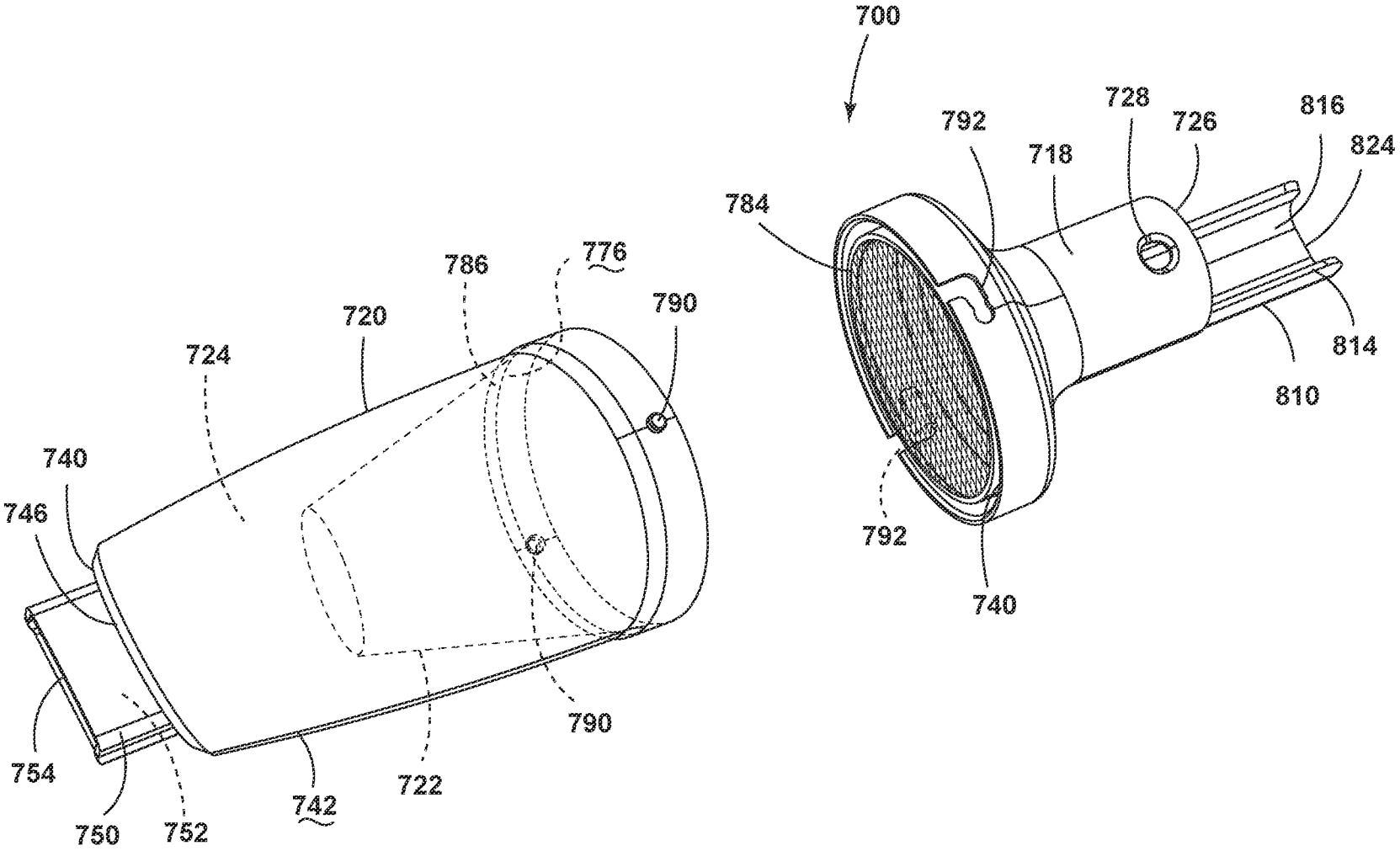
FIG. 20 is a partially exploded side perspective view of a dry vacuum tool for a cleaning apparatus, according to the present disclosure.

Referring still to FIGS. 18 and 19, and again to FIG. 20, the intermediate recovery tank 720 generally defines a standoff or a ledge 786 on the inner surface 776 thereof, and the separator 722 is configured to rest on the ledge 786 to align the opening of the separator 722 with the opening in the coupling end 774 of the intermediate recovery tank 720. The ledge 786 and the separator 722 may have mating features or mating profiles to couple the separator 722 to the intermediate recovery tank 720. The opening of the separator 722 and the opening defined by the coupling end 774 of the intermediate recovery tank 720 are coaxial with an opening into an interior of the support body 718, which is generally defined by the distal receiving end 740 of the support body 718. The additional filter element 784 may be disposed on the separator 722 or included in the interior of the support body 718 to extend across the opening defined by the distal receiving end 740.

The intermediate recovery tank 720 also includes protrusions 790, which are configured to engage with receiving slots 792 on the support body 718. The protrusions 790 are configured to be inserted into the receiving slots 792. The intermediate recovery tank 720 is then configured to be twisted or rotated to move the protrusions 790 further along the L-shaped receiving slots 792. This insertion and rotation couples the intermediate recovery tank 720 to the support body 718. This engagement also allows efficient and convenient removal of the intermediate recovery tank 720 with minimal force, which may be advantageous for retaining the debris material within the interior 724 of the dry vacuum tool 700 as an intermediate recovery tank 720 is removed from the support body 718. Other engagements between the intermediate recovery tank 720 and the support body 718 are also contemplated without departing from the teachings herein. Other engagements include but are not limited to, a hinge, latches, snap engagements, an interference fit, mating threads, flanges, clips, etc. For example, a hinged connection between the intermediate recovery tank 720 and the support body 718 may be advantageous for cleaning the debris materials from the intermediate recovery tank 720 by minimizing the number of parts to be handled by the user to execute the debris clean-out task, as disclosed herein. In various aspects, the dry vacuum tool 700 may include a gasket disposed between the support body 718 and the separator 722 and/or the intermediate recovery tank 720. The gasket may improve the suction effect within the dry vacuum tool 700.

Figure 21:
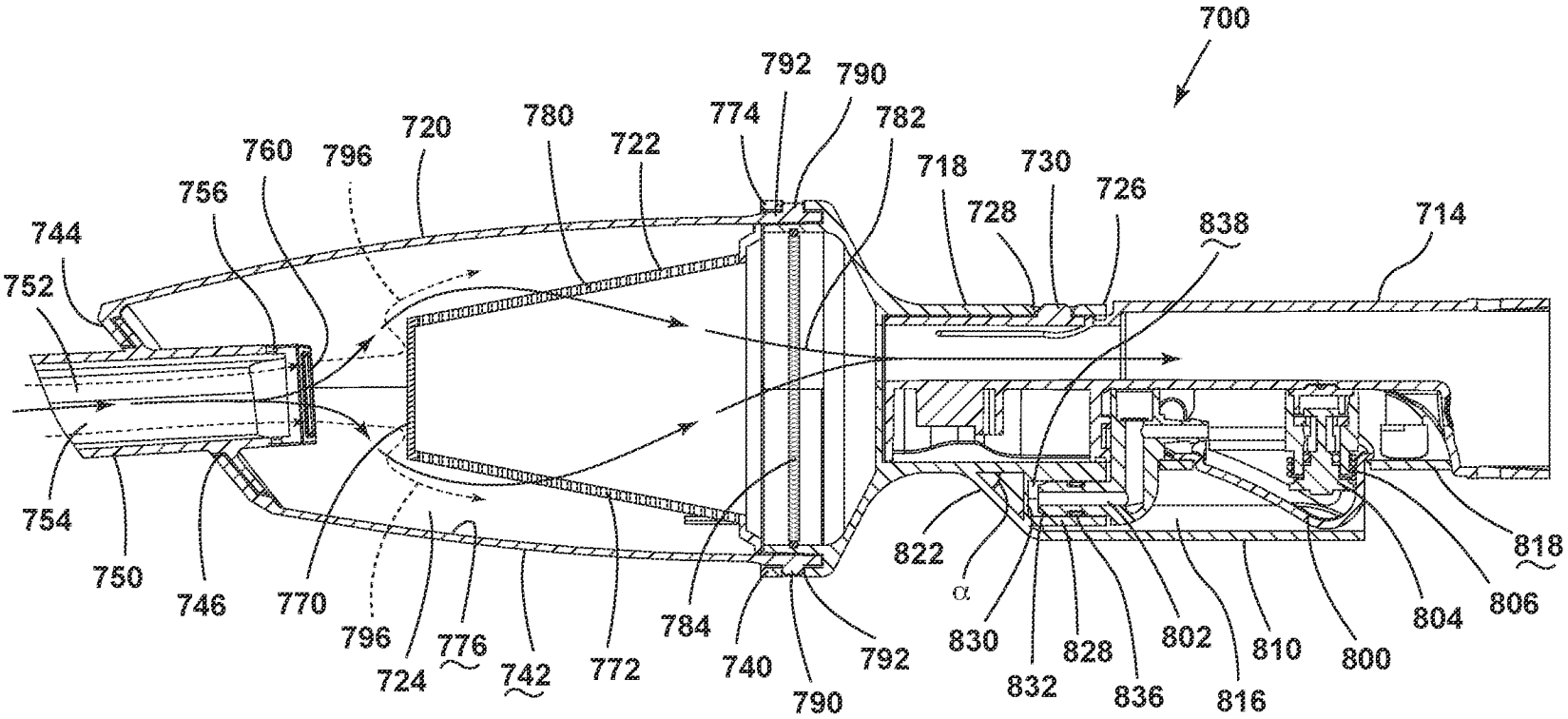
FIG. 21 is a side cross-sectional view of a dry vacuum tool accessory and a wand of a cleaning apparatus, where the dry vacuum tool accessory has a guard, according to the present disclosure.
Figure 22:
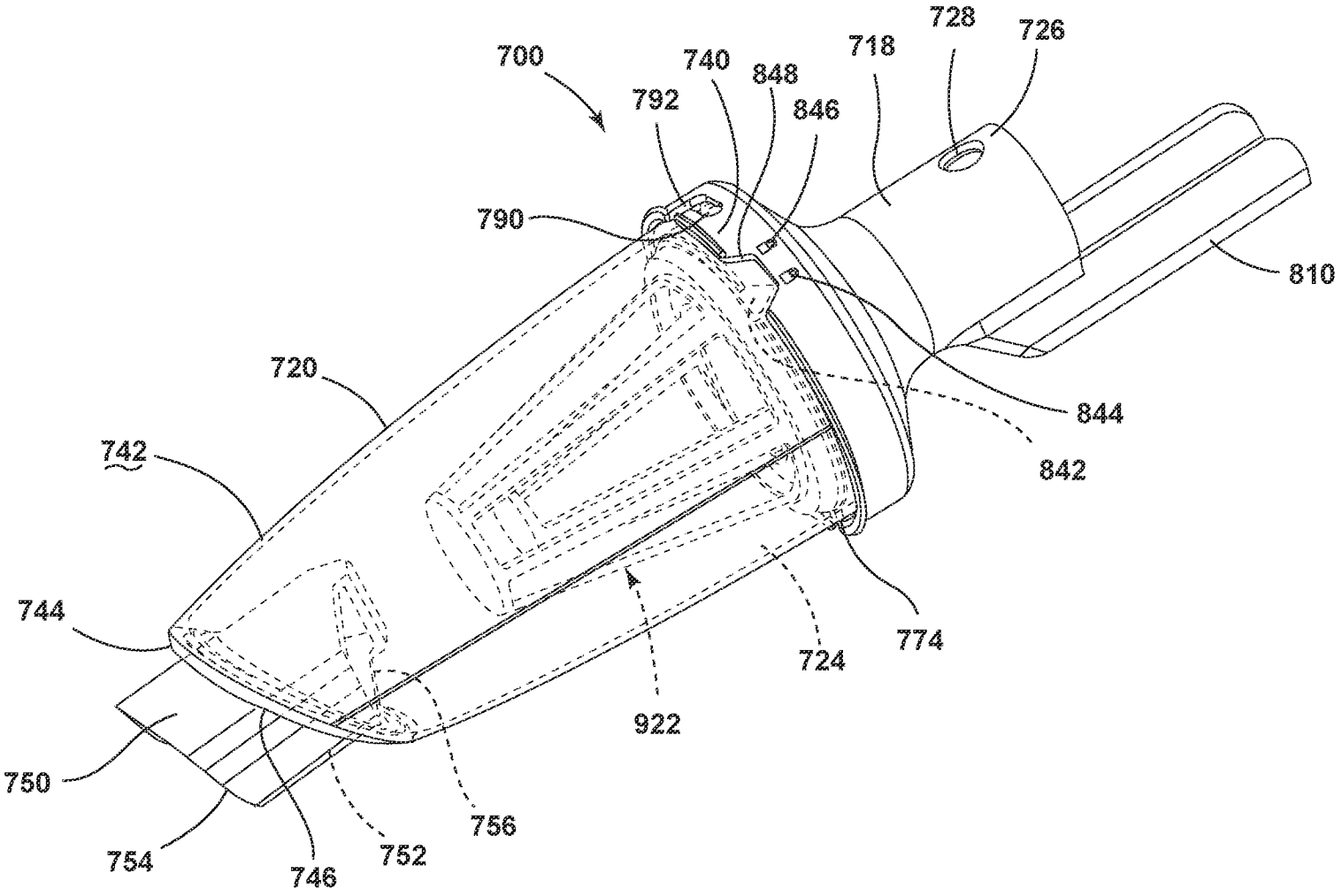
FIG. 22 is a side perspective view of a dry vacuum tool for a cleaning apparatus, according to the present disclosure.

Referring now to FIG. 21, the dry vacuum tool 700 is generally a bulk, in-line collector utilized for dry messes that have components disposed in a generally linear arrangement. In this way, the inlet 746, the guide channel 752, the end wall 770 of the separator 722, and the opening into the support body 718 are linearly aligned. The linear arrangement of these components may be advantageous to reduce the size and increase the maneuverability of the dry vacuum tool 700. The linear arrangement removes a side-by-side spacing between the inlet 746 and the intermediate recovery tank 720 found on many cyclonic collectors, where a more protruding recovery tank can interfere with maneuverability of the accessory over the surface to be cleaned. The linear arrangement of the illustrated dry vacuum tool 700 balances debris collection volume and the maneuverability to maximize the cleaning experience of the user.

The dry vacuum tool 700 is in fluid communication with the suction assembly 710 via the accessory hose 702 and the wand 714 to provide the vacuum effect to collect the debris material into the intermediate recovery tank 720. Air and debris materials are drawn into the intermediate recovery tank 720. The air flows through the sidewall 772 of the separator 722 (e.g., the fine filter), the filter elements 784, and the accessory hose 702, while the debris materials are retained within the intermediate recovery tank 720 for collection and, subsequently, disposal. The airflow path is illustrated as solid arrows 782 and the debris movement path is illustrated as dashed arrows 796.

The accessory hose 702 provides fluid communication between the fluid delivery system 24 and the wand 714. This configuration allows for various accessories coupled to the wand 714 to utilize the vacuum effect of the suction assembly 710 and/or dispense fluid from the fluid delivery system 24. The wand 714 includes a fluid trigger 800 and a fluid outlet 802. The trigger 800 is generally a push button that is operably coupled with a valve 804 that is configured to allow or prevent fluid communication between the supply tank 30 and the fluid outlet 802 on the wand 714. Accordingly, a liquid flow path is defined from the supply tank 30 through the fluid delivery system 24, through the accessory hose 702, and to the fluid outlet 802.

The valve 804 is operably coupled with a biasing member 806, which may be a coil spring. The biasing member 806 is configured to bias the valve 804 to a closed state, which prevents liquid from flowing through the fluid outlet 802. The valve 804 is configured to be actuated upon a force being applied to the trigger 800. Adjustment of the trigger 800 into the wand 714 is configured to actuate the valve 804 to an opened state, providing fluid communication to the fluid outlet 802.

Referring still to FIG. 21, as previously noted, the dry vacuum tool 700 is utilized primarily for dry debris materials, which may be affected by the use of liquid. Accordingly, the dry vacuum tool 700 is configured to block liquid from the fluid delivery system 24 and/or prevent actuation to release the liquid from the fluid delivery system 24. In this way, the dry vacuum tool 700 is utilized with the cleaning apparatus 704 that provides fluid communication between accessories and each of the suction assembly 710 and the fluid delivery system 24, however, the dry vacuum tool 700 utilized the function of the suction assembly 710 and blocks the function of the fluid delivery system 24.

The support body 718 includes a guard 810, which may also be referred to as a trigger guard 810, that extends from the support body 718 and beyond the proximal receiving end 726. The guard 810 is disposed on an opposing side of the support body 718 relative to the aperture 728. Generally, the guard 810 extends from a location between the proximal receiving end 726 and where the support body 718 begins to widen to receive the intermediate recovery tank 720. In the illustrated example, the guard 810 extends from a centralized location of a cylindrical portion of the support body 718 that receives the wand 714.

The guard 810 extends at an acute angle $\alpha$ from the support body 718 and then extends generally parallel to the cylindrical portion of the support body 718. The guard 810 includes an outer wall 814, which defines a U-shape. The outer wall 814 defines a receiving space 816 that is configured to receive the fluid outlet 802 and the trigger 800. The guard 810 may extend from an outer surface 818 of the wand 714, around the trigger 800, and to the surface 818 of the wand 714 on the opposing side of the trigger 800. In this way, the trigger 800 is substantially or fully covered by the outer wall 814. The guard 810 extends over the trigger 800 to block the actuation of the trigger 800 and, consequently, prevent the fluid communication between the supply tank 30 and the fluid outlet 802. The outer wall 814 may also be referred to as an outer shield 814, shielding or blocking the trigger 800.

In the illustrated configuration, the outer wall 814 has a closed distal end 822 and an open proximal end 824, however, it is contemplated that either or both ends 822, 824 may be closed or open without departing from the teachings herein. The closed distal end 822 is sloped and extends at the acute angle $\alpha$ from the support body 718. The sloped configuration of the closed distal end 822 may assist with reducing corners and/or reducing the size of the guard 810 that may catch on the surface to be cleaned. The open proximal end 824 aligns with an end of the trigger 800 at a location where the trigger 800 engages the wand 714. The trigger 800 generally forms a triangular shape, and the guard 810 extends to the thicker end of the trigger 800 disposed closer to the accessory hose 702.

Referring still to FIG. 21, the guard 810 also includes an inner wall 828 defined within the receiving space 816 of the outer wall 814. The inner wall 828 is defined proximate to the closed distal end 822 of the outer wall 814. The inner wall 828 extends from a closed end 830 coupled to the sloped distal end 822 of the outer wall 814 to generally align with the open proximal end 824 of the support body 718. The inner wall 828 and the support body 718 define an insertion channel 832 for receiving the fluid outlet 802. The fluid outlet 802 generally defines an L-shape, with a portion disposed adjacent to the proximal receiving end 726 of the support body 718 and a portion that extends parallel to the support body 718 in the insertion channel 832.

Generally, the fluid outlet 802 includes a seal 836, such as an O-ring, which is configured to engage an inner surface 838 of the inner wall 828. This engagement provides a seal about the fluid outlet 802 that prevents any fluid from exiting or being released from the insertion channel 832. Accordingly, if any liquid is inadvertently released from the fluid outlet 802, the fluid is retained in the insertion channel 832 rather than being released to an adjacent surface. The guard 810 blocks the fluid outlet 802 to end the liquid flow path and prevent the liquid from being dispensed to the surface to be cleaned. Further, the sealing engagement between the inner surface 838 and the seal 836 may close the insertion channel 832, which can cause an increase in pressure that prevents fluid from flowing to the fluid outlet 802 when the pressure increases to a predefined level within the insertion channel 832.

Referring again to FIGS. 17-21, the dry vacuum tool 700 provides dual protection from the release of liquid onto dry messes. The guard 810 of the dry vacuum tool 700 is configured to extend over one or both of the fluid outlet 802 and the trigger 800. The outer wall 814 of the guard 810 is configured to block the trigger 800 to prevent actuation of the trigger 800. This is advantageous for preventing the release of fluid from the supply tank 30. Further, the inner wall 828 provides the insertion channel 832 that is configured to catch or capture any fluid that may be released from the fluid delivery system 24 after engagement with the dry vacuum tool 700. In this way, actuation of the trigger 800 may be prevented and the release of any fluid from the fluid outlet 802 may also be prevented. This allows the dry vacuum tool 700 to utilize the suction effect without delivering liquid to the surface to be cleaned. The addition of a liquid to certain dry messes can form a mud-like substance within the dry vacuum tool 700, and preventing the release of the liquid, consequently, reduces or prevents the formation of the mud-like substance.

In operation, the wand 714 is inserted into the support body 718 of the dry vacuum tool 700. As the wand 714 is inserted into the proximal receiving end 726 of the support body 718, the fluid outlet 802 is disposed within the insertion channel 832 and the trigger 800 is disposed within the receiving space 816. The suction assembly 710 may then be activated to provide the vacuum effect to the dry vacuum tool 700, allowing for collection of debris material with the dry vacuum tool 700. The dry vacuum tool 700 is moved across or adjacent to the surface to be cleaned, and the vacuum effect draws the debris material into the interior 724 of the intermediate recovery tank 720. The accessory hose 702 increases the maneuverability of the dry vacuum tool 700.

The air and collected debris material are drawn into the intermediate recovery tank 720 toward the end wall 770 of the separator 722. The air and the debris material are directed from the end wall 770 to a space between the sidewall 772 of separator 722 and the intermediate recovery tank 720. The airflow into the intermediate recovery tank 720 is generally normal to the end wall 770 of the separator 722. The debris material may "bounce" or be redirected off the end wall 770 to the space between the sidewall 772 and the inner surface 776 of the intermediate recovery tank 720 to allow for additional collection of debris material. The debris materials being directed to the space between the sidewall 772 of the separator 722 and the intermediate recovery tank 720 also results in more even capture of the debris material within the intermediate recovery tank 720 around the separator 722. Additionally, the dry vacuum tool 700 is advantageous for preventing the dry debris material from entering the accessory hose 702 and the primary recovery tank 34, which may contain water or wet debris that can form a mud-like mixture when combined with dry debris materials. The dry vacuum tool 700 contains the captured dry debris materials in the self-contained intermediate recovery tank 720.

The air is drawn through the apertures 780 in the sidewall 772 of the separator 722 while the debris material is too large to pass to the separator 722 and is, therefore, retained in the intermediate recovery tank 720. The air is drawn along an airflow passage through the support body 718, the wand 714, and the accessory hose 702 to ultimately be exhausted. During this operation of the suction assembly 710, the fluid delivery system 24 may be active and the function of delivery liquid may be prevented by the guard 810 of the support body 718. The suction assembly 710 may then be deactivated. The intermediate recovery tank 720 can be removed from the support body 718 and the debris materials may be disposed. The blocking of the trigger 800 and the fluid outlet 802 prevent liquid from being dispensed from the cleaning apparatus 704, thereby preventing the liquid from combining with the dry mess.

Referring to FIGS. 22-26, the dry vacuum tool 700 may include additional feedback features for providing feedback to the user on whether the secondary recovery tank 720 is locked to the support body 718 or unlocked for removal from the support body 718. The secondary recovery tank 720 includes an indicator 842 on the coupling end 774 of the secondary recovery tank 720. The indicator 842 is illustrated as an arrow or pointer but may have other configurations without departing from the teachings herein.

The distal receiving end 740 of the support body 718 includes a locked icon 844 and an unlocked icon 846. The support body 718 defines a notch 848 at the distal receiving end 740. The icons 844, 846 are disposed adjacent to the notch 848. When the recovery tank 720 is initially moved and inserted into the support body 718, the protrusions 790 are inserted into the receiving slots 792 and the indicator 842 is moved into the notch 848. The indicator 842 is disposed adjacent to one edge of the notch 848 and aligned with the unlocked icon 846. As the recovery tank 720 is rotated, the indicator 842 moves across the notch 848 to be disposed adjacent to the opposing side of the notch 848 and aligned with the locked icon 844. The alignment of the indicator 842 with the icons 844, 846 provides additional feedback on whether the recovery tank 720 is fully locked to the support body 718.

Additionally, the dry vacuum tool 700 illustrated in FIGS. 22-26 includes an additional configuration for a separator 922, which may differ from the separator 722 illustrated in FIGS. 18-21. The separator 922 generally defines a shape to match and seal with the intermediate recovery tank 720. Accordingly, in the illustrated configuration the separator 922 includes a conical or frusto-conical shape with alternative configurations contemplated with different configurations of the secondary recovery tank 720. The separator 922 includes two components, which are configured as a filter cover 924 and a filter 926. The filter cover 924 may be a pre-filter, such as a mesh screen, and the filter 926, which may be a fine mesh material.

Figure 23:
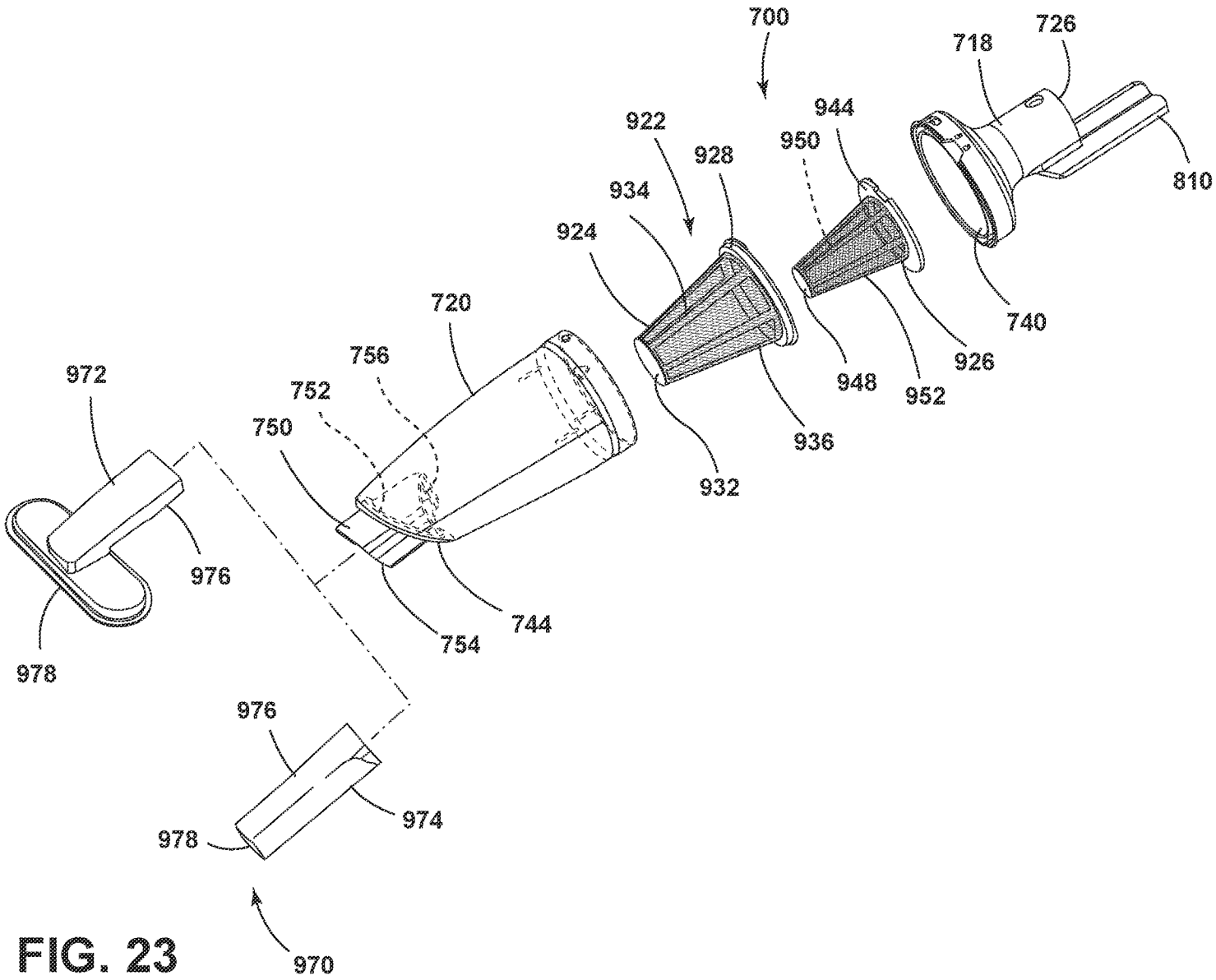
FIG. 23 is a side perspective exploded view of a dry vacuum tool for a cleaning apparatus and tool accessories, according to the present disclosure.
Figure 24:
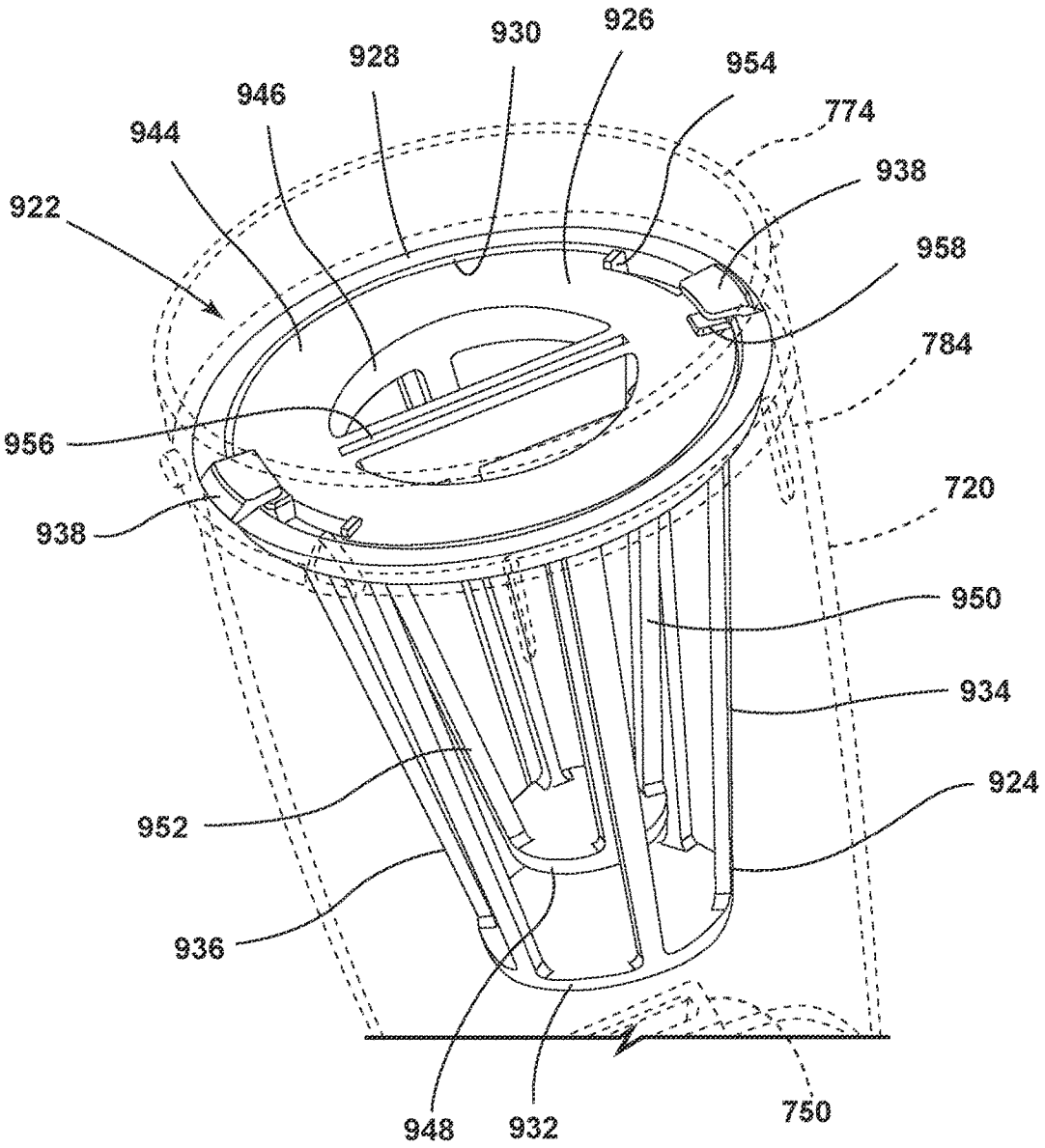
FIG. 24 is a partial side perspective view of an intermediate recovery tank with a separator for a dry vacuum tool of a cleaning apparatus, according to the present disclosure.
Figure 25:
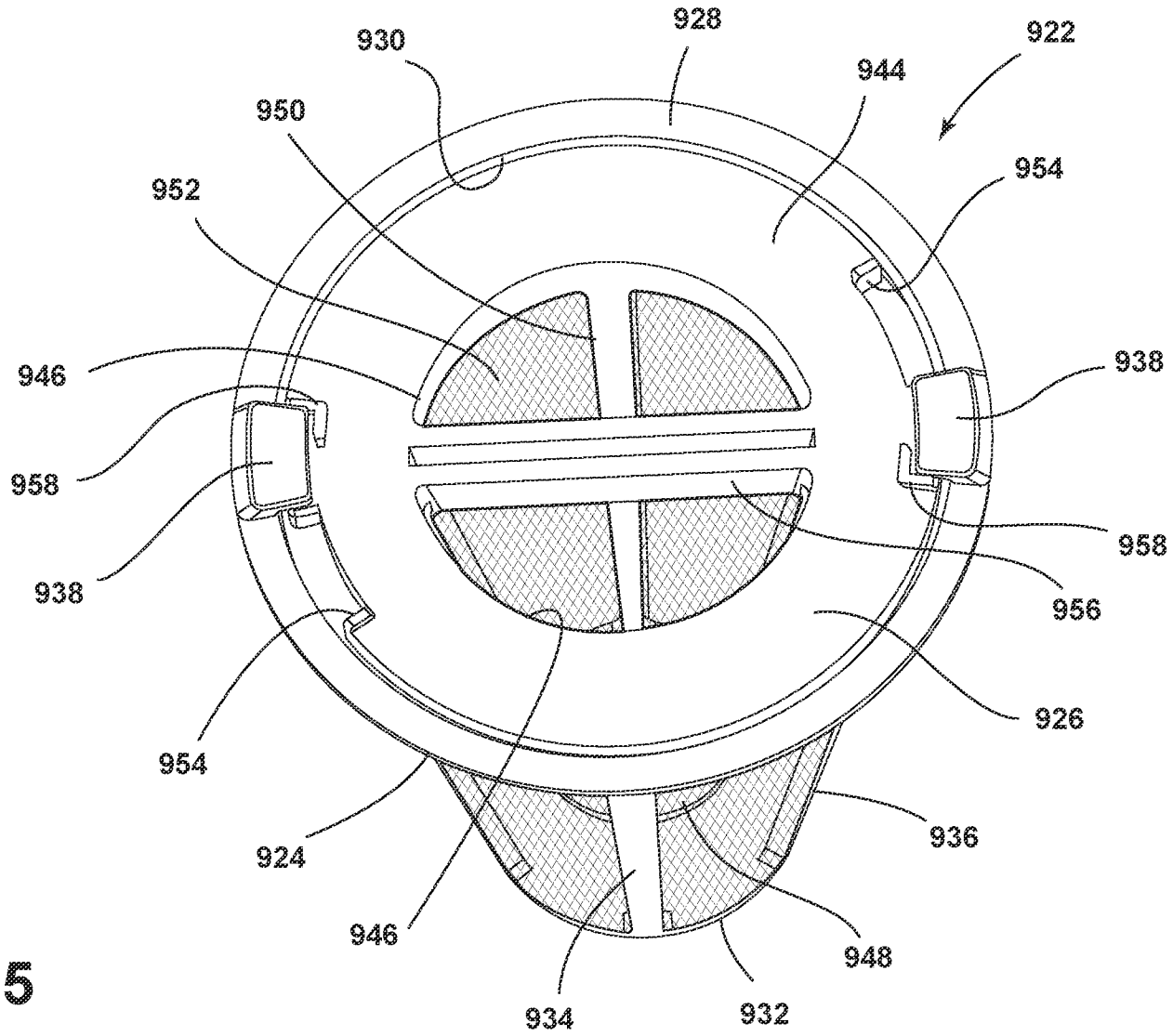
FIG. 25 is a top perspective view of a tool separator having a filter cover and a filter, according to the present disclosure.

Referring still to FIGS. 23-25, each of the filter cover 924 and the filter 926 separates the debris material from the airflow to retain the debris material within the recovery tank 720 while allowing the air to be exhausted from the dry vacuum tool 700 and/or the cleaning apparatus 704. The filter cover 924 and the filter 926 generally have corresponding shapes as the filter 926 is disposed within the filter cover 924. In the illustrated configuration, each of the filter cover 924 and the filter 926 defines a generally conical or frusto-conical shape to match and seal with the recovery tank 720. However, it is contemplated that different shapes for one or both of the filter cover 924 and the filter 926 are contemplated depending on the configuration of the recovery tank 720 and the overall configuration of the dry vacuum tool 700.

The filter cover 924 is coupled with the recovery tank 720, such as via the ledge 786 or similar structures. The filter cover 924 includes a rim 928 defining an opening 930 and a distal end wall 932 with supports 934 extending between the rim 928 and the end wall 932. Generally, the rim 928 and the end wall 932 are parallel with one another. In examples where both the rim 928 and the end wall 932 define a circular shape, such as the illustrated example, the rim 928 and the end wall 932 are coaxial with one another to form the bulk, in-line configuration of the dry vacuum tool 700.

The supports 934 extend between the rim 928 and the end wall 932 to provide additional support for the filter cover 924. A sidewall 936 of the filter cover 924 is formed from the supports 934 and a filter or mesh material. Generally, the filter material, such as a course mesh, extends between adjacent supports 934 and from the rim 928 to the end wall 932. The rim 928 includes engagement tabs 938 for engaging the filter 926. The engagement tabs 938 are illustrated as being diametrically opposed to one another.

Referring still to FIGS. 23-25, the filter 926 has a substantially similar or the same shape as the filter cover 924 with a smaller size to be positioned within the filter cover 924. The filter 926 includes an engagement portion 944 which generally defines a circular shape with one or more openings 946 to allow the airflow therethrough. The engagement portion 944 is positioned within the opening 930 defined by the rim 928 of the filter cover 924. The filter 926 includes an end plate 948, which is disposed proximate to and spaced from the end wall 932 of the filter cover 924. Supports 950 extend between the end plate 948 and the engagement portion 944 to provide additional support for the filter 926. A sidewall 952 of the filter 926 generally includes a filter material, such as a fine mesh filter, filling spaces defined between adjacent supports 950 from the engagement portion 944 to the end plate 948.

When the filter 926 is installed in the filter cover 924, the supports 934 of the filter cover 924 align with the supports 950 of the filter 926 to reduce turbulence in the airflow through the separator 922. The engagement portion 944 of the filter 926 includes notches 954, which are positioned to engage the engagement tabs 938 of the filter cover 924. The filter 926 also includes a cross member 956. The cross member 956 and the openings 946 defined between the engagement portion 944 and the cross member 956 provide a grasping location for the user to grasp and rotate the filter 926 relative to the filter cover 924.

The filter 926 can be inserted into the filter cover 924 with the engagement tabs 938 disposed within the notches 954. The user may then rotate the filter 926 to slide the engagement tabs 938 over the engagement portion 944 to abut stopping features 958. This configuration provides an interlocking engagement between the filter cover 924 on the filter 926 to retain the filter 926 within the filter cover 924 and, consequently, in position within the recovery tank 720. The cross member 956 generally extends between the two engagement tabs 938 when the filter 926 is fully installed in the filter cover 924.

The separator 922 with the filter cover 924 and the filter 926 includes two different mesh materials, which may be advantageous for providing two different types of filtering for the debris material within the airflow. The pre-filter or filter cover 924 may separate larger debris materials from the airflow, while the fine mesh filter 926 may further filter debris materials and smaller debris from the airflow.

The separator 922 operates in a similar manner to the separator 722 described with respect to FIG. 21. Air and the debris material are drawn into the intermediate recovery tank 720. The airflow into the intermediate recovery tank 720 is generally normal to the end wall 932 of the separator 922. The debris material may "bounce" or be redirected off the end wall 932 to the space between the sidewall 936 and the inner surface 776 of the intermediate recovery tank 720 to allow for additional collection of debris material. The air is drawn through the sidewall 928 of the filter cover 924 and the sidewall 952 of the filter 926 while the debris material is too large to pass to the separator 722 and is, therefore, retained in the intermediate recovery tank 720 and/or between the filter cover 924 and the filter 926. The air is drawn through the support body 718, the wand 714, and the accessory hose 702 to ultimately be exhausted.

Figure 26:
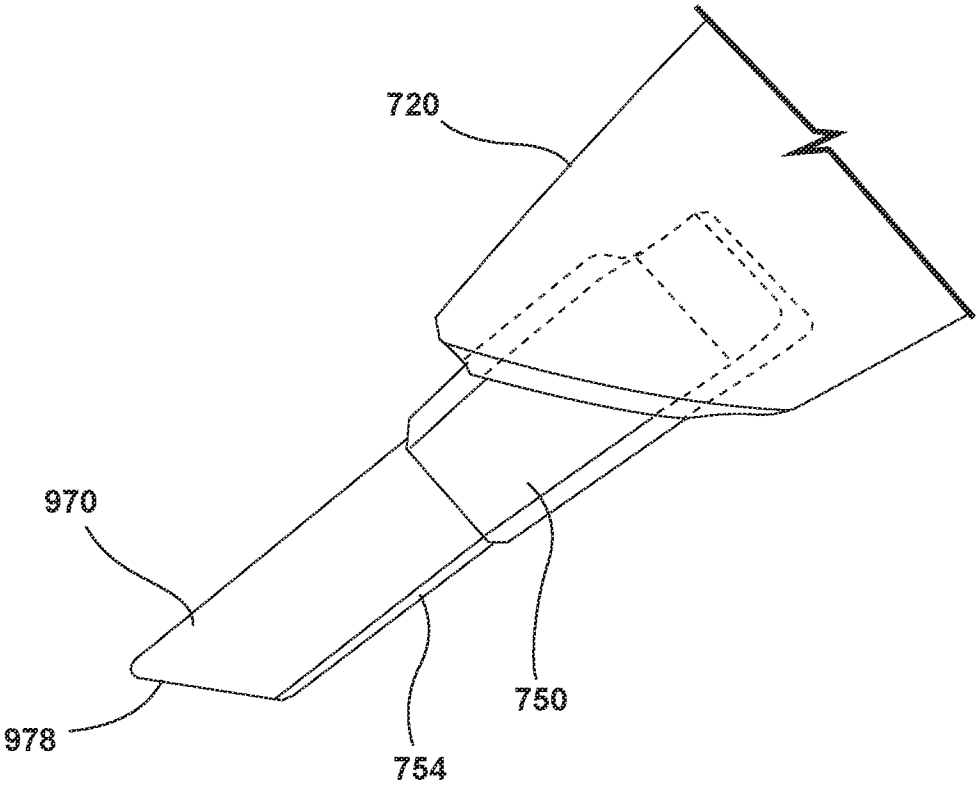
FIG. 26 is a partial side perspective view of a dry vacuum tool with a crevice tool accessory, according to the present disclosure.

With further reference to FIGS. 23 and 26, the dry vacuum tool 700 may be utilized with multiple tool accessories 970, which are illustrated as a wide upholstery accessory 972 for maximizing surface area engaged by the dry vacuum tool 700 and a crevice accessory 974 for providing the suction effect at smaller, harder-to-reach places (e.g., crevices, cracks, etc.). In various aspects, the tool accessories 970 each include an engagement tube 976, which is selectively inserted into the guide channel 752 of the cap 750. The engagement tube 976 may form an interference fit with the cap 750, such that the insertion of the tube within the cap 750 retains the accessory 970 in position. Additionally or alternatively, the engagement tube 976 may have features that can engage and disengage from corresponding or mating features on the cap 750. Each of the accessories 970 has an at least partially hollow interior that is in fluid communication with the interior 724 of the recovery tank 720 to draw the air and debris material through an accessory inlet 978 to be captured in the recovery tank 720.

With reference to FIGS. 27-31, an additional or alternative configuration of a dry vacuum tool 1000 for the cleaning apparatus 704 is illustrated. Similar to the dry vacuum tool 700 described herein, the dry vacuum tool 1000 includes a support body 1018, which is selectively coupled with an intermediate or secondary recovery tank 1020 that has a separator 1022 disposed within an interior 1024 thereof. The support body 1018 includes a proximal receiving end 1026 for receiving the wand 714 and a distal receiving end 1040 for engaging the secondary recovery tank 1020.

In the illustrated configuration, the separator 1022 and the secondary recovery tank 1020 each have a generally conical or frusto-conical shape. However, these components may have different shapes, which may be advantageous for different purposes as described herein. The secondary recovery tank 1020 has a leading end 1044 that defines an inlet 1046 for capturing debris material from the surface being cleaned. The leading end 1044 may be angled relative to the support body 1018.

Figure 27:
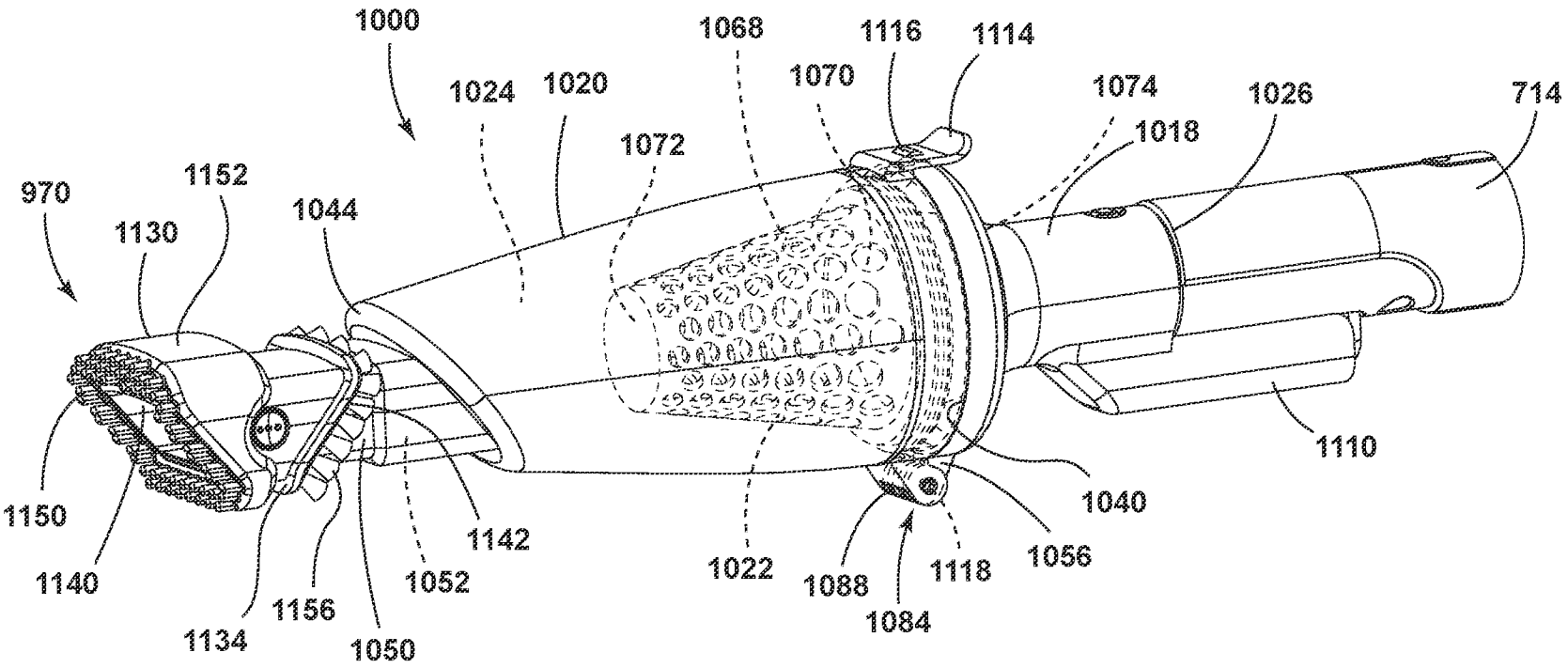
FIG. 27 is a side perspective view of a dry vacuum tool for a cleaning apparatus with a reversible tool accessory in a first use position, according to the present disclosure.
Figure 28:
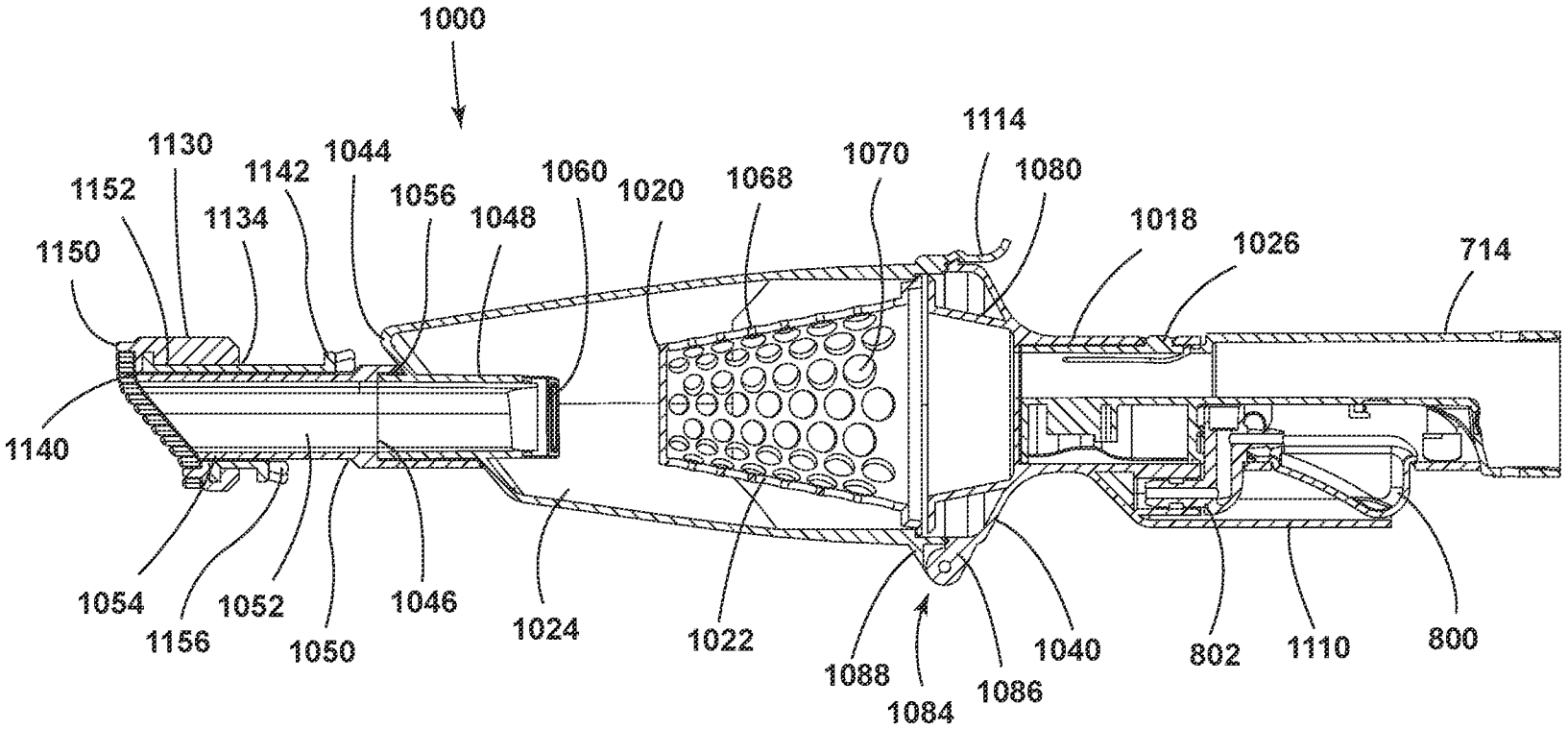
FIG. 28 is a side cross-sectional view of a dry vacuum tool accessory and a wand of a cleaning apparatus, where the dry vacuum tool accessory has a guard and a reversible tool accessory, according to the present disclosure.
Figure 29:
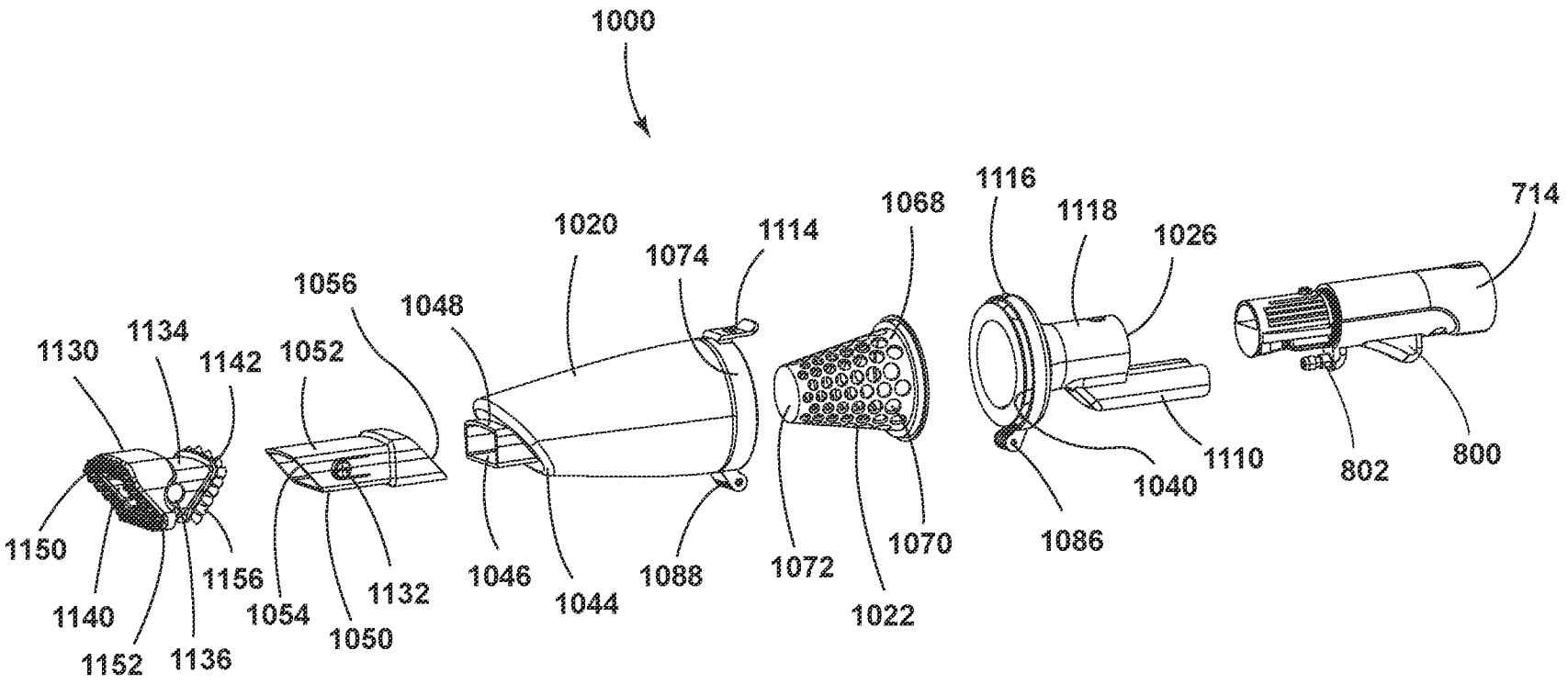
FIG. 29 is a side perspective exploded view of a dry vacuum tool for a cleaning apparatus, a wand, and a reversible accessory, according to the present disclosure.

Referring still to FIGS. 27-29, in various aspects, the leading end 1044 of the secondary recovery tank 1020 includes a receiving nozzle 1048, which extends outwardly from the leading end 1044. The receiving nozzle 1048 defines the inlet 1046 and guides captured debris material to the interior 1024 of the intermediate recovery tank 1020. The dry vacuum tool 1000 also includes a suction nozzle or cap 1050 coupled to the receiving nozzle 1048 of the leading end 1044. The cap 1050 is generally positioned around the receiving nozzle 1048, such that the receiving nozzle 1048 is disposed within a guide channel 1052 of the cap 1050. In this configuration, the cap 1050 may abut the leading end 1044 to form a continuous path into the interior 1024 of the recovery tank 1020 with the receiving nozzle 1048.

The cap 1050 includes an inlet end 1054 for engaging or being positioned adjacent to a surface to be cleaned and an outlet end 1056, which receives the receiving nozzle 1048. In various examples, the receiving nozzle 1048 also extends at least partially into the interior 1024 of the secondary recovery tank 1020. In such examples, a flap 1060 is coupled to the receiving nozzle 1048. The flap 1060 is generally biased to a closed position to reduce or prevent debris materials from traveling back through the inlet 1046. In alternative examples, the cap 1050 may extend inside the receiving nozzle 1048, or the receiving nozzle 1048 may be omitted, such that the cap 1050 extends into the interior 1024 and includes the flap 1060, similar to the dry vacuum tool 700.

Referring still to FIGS. 27-29, the dry vacuum tool 1000 includes the separator 1022, which is selectively positioned within the interior 1024 of the intermediate recovery tank 1020. In the illustrated configuration, the separator 1022 includes a sidewall 1068 defining openings 1070 and an end wall 1072, which is generally a solid component (e.g., free of apertures). The openings 1070 are larger apertures, which may reduce or prevent larger, bulkier debris materials from passing through the separator 1022. Further, as illustrated, the openings 1070 are smaller closer to the end wall 1072 and gradually increase in size toward a coupling end 1074 of the recovery tank 1020. In certain aspects, the openings 1070 may form a pre-filter component and the separator 1022 may also include a fine filter for retaining smaller debris materials within the recovery tank 1020. The fine filter may be positioned in an interior defined by the sidewall 1068 (similar to the filter 926 within the filter cover 924 in FIGS. 22-25) or may be integrated into sidewall 1068. Moreover, the separator 1022 may include the additional filter element 784 (see FIGS. 19 and 20).

The separator 1022 is coupled to the recovery tank 1020 and operates in a similar manner as the separator 722 in FIGS. 18-21 and the separator 922 in FIGS. 22-25. Air and the debris material are drawn into the intermediate recovery tank 1020. The airflow into the intermediate recovery tank 1020 is generally normal to the end wall 1072 of the separator 1022. The debris material may "bounce" or be redirected off the end wall 1072 to the space between the sidewall 1068 and an inner surface of the intermediate recovery tank 1020 to allow for additional collection of debris material. The air is drawn through the sidewall 1068 of the separator 1022 while the debris material is retained in the intermediate recovery tank 1020.

The support body 1018 includes a conduit 1080 disposed adjacent to the coupling end 1074 of the recovery tank 1020 and the separator 1022. As described herein, the recovery tank 1020 may be rotatably coupled to the support body 1018, which may change a distance between the separator 1022 and the wand 714. The conduit 1080 guides the airflow from the recovery tank 1020 and toward the wand 714.

Figure 30:
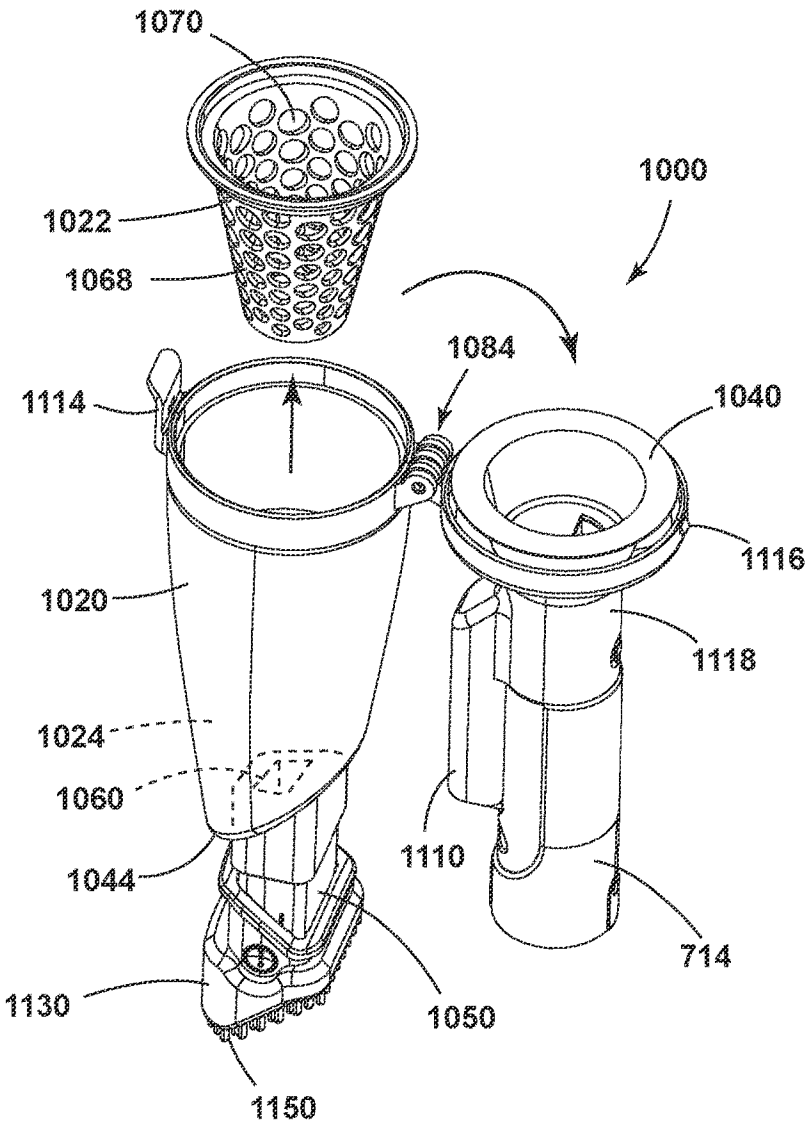
FIG. 30 is a side perspective view of a dry vacuum tool in an opened position for removing a separator, according to the present disclosure.

Referring to FIG. 30, the recovery tank 1020 is rotatably coupled to the support via a hinge assembly 1084. A first hinge member 1086 is coupled to or integrally formed with the support body 1018, and a second hinge member 1088 is coupled to or integrally formed with the recovery tank 1020. The first and second hinge members 1086, 1088 cooperate to form the hinge assembly 1084. Generally, the hinge assembly 1084 is disposed on the same side of the support body 1018 as a guard 1110, which is utilized to block the trigger 800 with a similar structure and function as the guard 810 described herein (see FIGS. 18-25).

On an opposing side from the hinge assembly 1084, the recovery tank 1020 includes an engagement tab 1114, which is generally elastically deformable to snap fit over a protrusion 1116 on the support body 1018. The engagement tab 1114 can engage the protrusion 1116 to lock the recovery tank 1020 to the support body 1018 in a closed state and disengage from the protrusion 1116 to allow removal of the separator 1022 and, consequently, the debris material. Accordingly, the user may rotate the recovery tank 1020, which remains connected to the support body 1018, to clean the debris material from the recovery tank 1020. This configuration has fewer separate components for the user to handle, providing a more convenient and efficient debris clean-out process. Moreover, one more of the support body 1018, the recovery tank 1020, and the hinge assembly 1084 may have a detent 1118 or detents 1118 for retaining the recovery tank 1020 in the fully rotated and opened position. In certain aspects, the detents 1118 can be spring-loaded to hold the recovery tank 1020 in the opened position. This may be advantageous for retaining the recovery tank 1020 in an open and locked position to clean the debris material from the recovery tank 1020.

Figure 31:
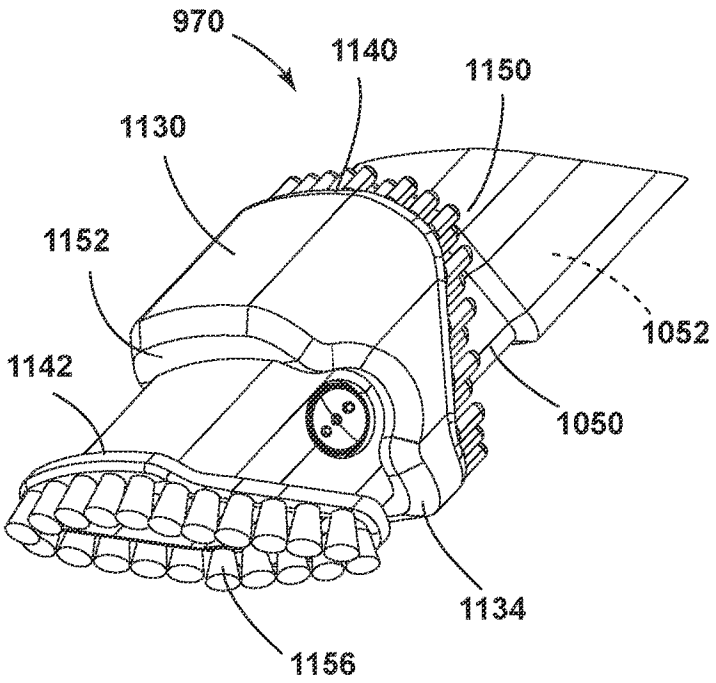
FIG. 31 is a side perspective view of a dry vacuum tool for a cleaning apparatus with a reversible tool accessory in a second use position, according to the present disclosure.

Referring again to FIG. 27, as well as FIG. 31, the cap 1050 has an elongated configuration for supporting one or more tool accessories 970, such as a two-way or reversible accessory 1130. The cap 1050 includes one or more detents 1132 for engaging the reversible accessory 1130 and retaining the reversible accessory 1130 on the cap 1050. The reversible tool accessory 1130 is configured to couple to the cap 1050 to provide different cleaning functions for the dry vacuum tool 1000.

The reversible tool accessory 1130 has a coupling body 1134 defining one or more apertures 1136 for receiving the detents 1132 of the cap 1050. Generally, the detents 1132 elastically deform inward as the reversible accessory 1130 is being positioned on the cap 1050 and then fit into the apertures 1136 on the coupling body 1134. The user may press the detents 1132 inward to then remove the reversible accessory 1130.

The coupling body 1134 defines a hollow interior with opposing open ends 1140, 1142 to provide an accessory inlet and a receiving space for the cap 1050. Depending on the position of the reversible tool accessory 1130, either open end 1140, 1142 may receive the cap 1050 or define the accessory inlet. The interior of the tool accessory 1130 is in fluid communication with the interior 1024 of the recovery tank 1020 for capturing the debris materials.

In a first use position, as illustrated in FIG. 27, the tool accessory 1130 provides a pet hair cleaning function. The tool accessory 1130 includes bristle projections 1150 coupled to the coupling body 1134 and arranged around the open ends 1140, which forms the accessory inlet. The bristle projections 1150 can be constructed of any practicable material, such as an elastomeric material that can engage the surface being cleaned, agitate or disrupt the pet hair and other debris material from the surface, and allow the collection of the pet hair in the recovery tank 1020. The bristle projections 1150 attract or otherwise disrupt the engagement between the pet hair and the surface being cleaned, allowing the suction effect to draw the pet hair away from the surface being cleaned. The bristle projections 1150 are illustrated as being integrally formed with a connector 1152 extending around the coupling body 1134, however, the coupling body 1134 may define the bristle projections 1150 without departing from the teachings herein.

As illustrated in FIG. 31, in a second use position, the tool accessory 1130 provides a dusting function. In the second use position, the tool accessory 1130 is rotated about 180 degrees, such that the open end 1140 by the bristle projections 1150 receives the cap 1050 and the opposing open end 1142 defines the accessory inlet. The detents 1132 are positioned within the apertures 1136 when the tool accessory 1130 is in the second use position to retain the tool accessory 1130 on the cap 1050.

At the second open end 1142, the reversible tool accessory 1130 includes dusting bristles 1156, which may be constructed of nylon, microfiber material, cloth, feathers, or other practicable materials. The dusting bristles 1156 are configured to agitate and move dust and similar particles from the surface being cleaned to be captured in the secondary recovery tank 1020. The dusting bristles 1156 can be coupled with or integrally formed with a connector extending around the coupling body 1134 or coupled directly to the coupling body 1134 without departing from the teachings herein.

The user can use the same reversible accessory 1130 with the dry vacuum tool 1000 by positioning the reversible accessory 1130 in the first use position and the second use position. One of the bristle projections 1150 and the dusting bristles 1156 can be used for the cleaning function, while the other of the bristle projections 1150 and the dusting bristles 1156 extend along an outside of the cap 1050 to not impinge on the cleaning function. Additional tool accessories 970 may be utilized without departing from the teachings herein.

Referring once again to FIGS. 1-31, the extraction cleaner system 10 may have a variety of configurations for providing the dry vacuum function and blocking the function of the fluid delivery system 24. Additionally or alternatively, other accessories 970, 1130 or the wet cleaning head 18 may be utilized and interchanged with the dry vacuum tool 700, 1000 or the dry cleaning head 16, respectively, to provide a single cleaning apparatus 704 that provides both wet and dry cleaning functions. One cleaning apparatus 704 with both wet and dry cleaning functions streamlines the cleaning process for users, particularly for vehicle cleaning processes. One cleaning apparatus 704 can be used to provide multiple cleaning functions rather than multiple cleaning devices each with a single function. Accordingly, the cleaning apparatuses 704 and the extraction cleaner system 10 described herein streamline the cleaning process for the user.

Use of the present device may provide for a variety of images. For example, the dry cleaning head 16 and the wet cleaning head 18 may be interchanged to provide the extraction cleaner system 10 with wet and dry cleaning functions. Additionally, the dry cleaning head 16, may block or prevent the function of the fluid delivery system 24. Further, the cleaning apparatus 704 can be utilized with the dry vacuum tool 700 to provide increased maneuverability over various surfaces and in various spaces or crevices. Additionally, the linear configuration of the components of the dry vacuum tool 700 may reduce the size of the dry vacuum tool 700. Moreover, the dry vacuum tool 700 may be selectively coupled to the cleaning apparatus 704 to utilize the suction assembly 710, which generates the vacuum effect for drawing debris material into the intermediate recovery tank 720. Moreover, the dry vacuum tool 700 includes the guard 810, which is configured to provide dual protection for preventing the actuation of the trigger 800 and the release of liquids from the fluid delivery system 24 to the surface to be cleaned. Also, preventing the release of liquid reduces or prevents the formation of the mud-like substance in the dry vacuum tool 700 caused by liquid combining with certain dry messes, which increases the ease of cleaning the dry vacuum tool 700. Additional benefits or advantages may also be realized and/or achieved.

The device disclosed herein is further summarized in the following paragraphs and is further characterized by combinations of any and all various aspects described herein.

Clause 1. A handheld extraction cleaner system comprising: a wet cleaning head including a wet suction nozzle; a dry cleaning head including a dry suction nozzle; a handheld base including a modular receiver, a suction source, and a fluid delivery system, the modular receiver configured to interchangeably couple to the wet and dry cleaning heads, the suction source configured to generate a suction air stream through the wet suction nozzle when the wet cleaning head is coupled to the modular receiver and through the dry suction nozzle when the dry cleaning head is coupled to the modular receiver, the fluid delivery system including a fluid distributor configured to dispense a cleaning solution on a cleaning surface; and wherein at least one of the handheld base and the dry cleaning head is configured to facilitate disabling or preventing the fluid delivery system from dispensing the cleaning solution when the modular receiver is coupled to the dry cleaning head.

Clause 2. The handheld extraction cleaner system according to any clause wherein the handheld base includes a control system configured to control the fluid delivery system to dispense the cleaning solution in response to user actuation of a spray actuator, and wherein the at least one of the handheld base and the dry cleaning head is configured to disable or prevent use of the spray actuator when the dry cleaning head is coupled to the handheld base.

Clause 3. The handheld extraction cleaner system according to any clause wherein the dry cleaning head includes a cover configured to cover the spray actuator.

Clause 4. The handheld extraction cleaner system according to any clause wherein the spray actuator is included on a user interface of the control system, the user interface being exposed on the handheld base proximate to a carry handle of the handheld base.

Clause 5. The handheld extraction cleaner system according to any clause wherein the cover is included on a housing of the dry cleaning head configured to extend at least partially over the handheld base to overlay the spray actuator.

Clause 6. The handheld extraction cleaner system according to any clause wherein a housing of the dry cleaning head is configured to fit over and cover the fluid distributor, the fluid distributor being disposed forwardly of the spray actuator.

Clause 7. The handheld extraction cleaner system according to any clause wherein the dry cleaning head includes a dry separator and a recovery tank, the dry suction nozzle configured to recover debris from the cleaning surface via the suction air stream, the dry separator configured to separate the debris from the suction air stream, the recovery tank configured to collect the debris separated from the suction air stream; and a housing includes a flange operable with a release on the recovery tank to removably connect the recovery tank thereto.

Clause 8. The handheld extraction cleaner system according to any clause wherein the control system is configured to disable use of the spray actuator in response to a sensor on the handheld base detecting the dry cleaning head being coupled to the modular receiver.

Clause 9. The handheld extraction cleaner system according to any clause wherein the sensor is a pressure sensor.

Clause 10. The handheld extraction cleaner system according to any clause wherein the sensor is an optical sensor.

Clause 11. The handheld extraction cleaner system according to any clause wherein the sensor is a proximity sensor.

Clause 12. The handheld extraction cleaner system according to any clause wherein the control system is configured to disable use of the spray actuator in response to a switch on the handheld base engaging a key or a ramp on the dry cleaning head.

Clause 13. The handheld extraction cleaner system according to any clause wherein the handheld base includes a mechanical shutoff configured to block the spray actuator.

Clause 14. The handheld extraction cleaner system according to any clause wherein the dry cleaning head includes a housing and a dry recovery tank, and the housing is configured to interconnect the dry recovery tank with the handheld base.

Clause 15. The handheld extraction cleaner system according to any clause wherein the dry cleaning head includes a dry separator configured to separate debris entrained in the suction air stream through the dry suction nozzle from the suction air stream, and the dry recovery tank includes a tank connector configured to removably connect the dry separator to the dry recovery tank.

Clause 16. The handheld extraction cleaner system according to any clause wherein the dry separator includes a housing connector configured to removably couple the dry separator to the housing.

Clause 17. The handheld extraction cleaner system according to any clause wherein the dry separator is disposed within the dry recovery tank forwardly of the housing.

Clause 18. The handheld extraction cleaner system according to any clause wherein the housing includes a conduit configured to provide an airflow passageway between the dry separator and the handheld base.

Clause 19. The handheld extraction cleaner system according to any clause wherein the cleaning head includes a filter configured to cover the conduit.

Clause 20. The handheld extraction cleaner system according to any clause wherein the dry cleaning head includes a dry separator configured to cyclonically separate dry debris entrained in the suction air stream through the dry suction nozzle.

Clause 21. The handheld extraction cleaner system according to any clause wherein the dry cleaning head includes a dry recovery tank configured to collect debris entrained in the suction air stream through the dry suction nozzle, and a screen configured to empty the dry recovery tank when pressed.

Clause 22. The handheld extraction cleaner system according to any clause wherein the dry cleaning head includes a dry separator configured to separate debris entrained in the suction air stream through the dry suction nozzle from the suction air stream, and a dry recovery tank configured to collect the debris separated from the suction air stream, and wherein a leading end of the dry recovery tank forms the dry suction nozzle.

Clause 23. The handheld extraction cleaner system according to any clause wherein the dry cleaning head includes a tank inlet flap configured to rotatably cover and uncover the dry suction nozzle.

Clause 24. The handheld extraction cleaner system according to any clause further including a biasing member configured to bias the tank inlet flap toward covering the dry suction nozzle.

Clause 25. The handheld extraction cleaner system according to any clause wherein the dry suction nozzle couples to an accessory tool, the accessory tool configured to extend outboard of the dry suction nozzle.

Clause 26. The handheld extraction cleaner system according to any clause wherein the dry cleaning head includes a dry recovery tank configured to collect debris entrained in the suction air stream through the dry suction nozzle, and the dry recovery tank is configured to be removably coupled to an underside of the dry suction nozzle.

Clause 27. The handheld extraction cleaner system according to any clause wherein the dry cleaning head includes a dry recovery tank configured to collect debris entrained in the suction air stream through the dry suction nozzle, and the dry recovery tank includes a release configured to removably couple the dry recovery tank to the dry suction nozzle.

Clause 28. The handheld extraction cleaner system according to any clause wherein the dry cleaning head includes a dry recovery tank configured to collect debris entrained in the suction air stream through the dry suction nozzle, and the dry recovery tank includes a threaded connector configured to removably couple the dry recovery tank to the dry suction nozzle.

Clause 29. The handheld extraction cleaner system according to any clause wherein the dry cleaning head includes a dry recovery tank configured to collect debris entrained in the suction air stream through the dry suction nozzle, and the dry recovery tank includes a hinged empty door configured to articulate between an open position and a closed position, the open position opening the dry recovery tank to remove the collected debris, the closed position closing the dry recovery tank to retain the collected debris.

Clause 30. The handheld extraction cleaner system according to any clause wherein the wet cleaning head includes a wet separator configured to separate debris entrained in the suction air stream through the wet suction nozzle from the suction air stream, and the wet separator is configured to provide a tortuous pathway for separating the debris from the suction air stream.

Clause 31. The handheld extraction cleaner system according to any clause wherein the wet cleaning head includes a wet recovery tank configured to collect the separated debris, wherein the wet recovery tank includes a baffle wall that separates a wet collection chamber of the wet recovery tank from the tortuous pathway, and a tank inlet to the wet recovery tank includes an opening through the baffle wall whereby the separated debris from the suction air stream transfers into the wet collection chamber tank through the opening.

Clause 32. The handheld extraction cleaner system according to any clause wherein the dry cleaning head includes a dry separator configured to separate debris entrained in the suction air stream through the dry suction nozzle from the suction air stream, and a dry recovery tank configured to collect the debris separated from the suction air stream, and the dry separator is configured to provide a non-tortuous pathway for separating the debris from the suction air stream.

Clause 33. The handheld extraction cleaner system according to any clause wherein the dry separator includes a mesh screen and a filter configured to cooperate in separating the debris from the suction air stream.

Clause 34. A handheld extraction cleaner base comprising: a modular receiver configured to interchangeably couple to a wet cleaning head and a dry cleaning head; a suction source configured to generate a suction air stream operable with the wet and dry cleaning heads to provide suction for recovering debris from a cleaning surface; a fluid delivery system configured to dispense a cleaning solution on the cleaning surface; and a control system configured to disable or prevent use of the fluid delivery system when the modular receiver is coupled to the dry cleaning head.

Clause 35. The handheld extraction cleaner base according to any clause wherein the control system is configured to disable use of the fluid delivery system in response to a sensor of the handheld extraction cleaner base detecting the dry cleaning head being coupled to the modular receiver.

Clause 36. The handheld extraction cleaner base according to any clause wherein the sensor is a pressure sensor.

Clause 37. The handheld extraction cleaner base according to any clause wherein the sensor is an optical sensor.

Clause 38. The handheld extraction cleaner base according to any clause wherein the sensor is a proximity sensor.

Clause 39. The handheld extraction cleaner base according to any clause wherein the control system is configured to disable use of the fluid delivery system in response to a switch on the handheld extraction cleaner base engaging a key or a ramp on the dry cleaning head.

Clause 40. The handheld extraction cleaner base according to any clause further including a mechanical shutoff configured to block a spray actuator of the fluid delivery system.

Clause 41. The handheld extraction cleaner base according to any clause wherein the control system is configured to control a pump of the fluid delivery system to dispense the cleaning solution through a fluid distributor of the fluid delivery system in response to user actuation of a spray actuator.

Clause 42. The handheld extraction cleaner base according to any clause wherein the spray actuator is included as part of a user interface of the control system, the user interface being disposed forwardly of a carry handle of the handheld extraction cleaner base.

Clause 43. The handheld extraction cleaner base according to any clause wherein the user interface includes a power actuator operable to vary an amount of suction provided by the suction source.

Clause 44. The handheld extraction cleaner base according to any clause wherein the power actuator is operable both when the wet cleaning head is coupled to the modular receiver, and when the dry cleaning head is coupled to the modular receiver.

Clause 45. The handheld extraction cleaner base according to any clause wherein the control system is configured to disable the suction source and the fluid delivery system when neither of the wet cleaning head and the dry cleaning head are coupled to the base.

Clause 46. A cleaning head comprising: a coupler configured to removably couple the cleaning head to a handheld base, the handheld base including a suction source configured to generate a suction air stream and a fluid delivery system configured to dispense a cleaning solution; a suction nozzle configured to recover debris from a cleaning surface via the suction air stream; a separator configured to separate the recovered debris from the suction air stream; a recovery tank configured to collect the separated debris; and an override configured to disable or prevent use of the fluid delivery system when the cleaning head is connected to the handheld base.

Clause 47. The cleaning head according to any clause wherein the override is a cover configured to block use of a spray actuator included on the handheld base.

Clause 48. The cleaning head according to any clause wherein the cover is included as part of a housing configured to interconnect the recovery tank with the handheld base.

Clause 49. The cleaning head according to any clause wherein the fluid delivery system includes a fluid distributor configured to dispense the cleaning solution, and a portion of the housing covers the fluid distributor of the fluid delivery system when the cleaning head is connected to the handheld base.

Clause 50. The cleaning head according to any clause wherein the override is an actuator configured to actuate a switch or a sensor included on the handheld base.

Clause 51. The cleaning head according to any clause wherein the override is a key or a ramp included on a housing connected to the suction nozzle.

Clause 52. The cleaning head according to any clause wherein the cleaning head includes a housing configured to interconnect the recovery tank with the handheld base.

Clause 53. The cleaning head according to any clause further including a tank connector configured to removably connect the separator to the recovery tank.

Clause 54. The cleaning head according to any clause further including a housing connector configured to removably couple the separator to the housing.

Clause 55. The cleaning head according to any clause wherein the separator is disposed within the recovery tank forwardly of the housing.

Clause 56. The cleaning head according to any clause wherein the housing includes a conduit configured to provide an airflow passageway between the separator and the handheld base.

Clause 57. The cleaning head according to any clause further including a filter configured to cover the conduit.

Clause 58. The cleaning head according to any clause wherein the separator is configured to cyclonically separate the recovered debris.

Clause 59. The cleaning head according to any clause further including a screen configured to surround the separator and empty the recovery tank when pressed.

Clause 60. The cleaning head according to any clause wherein a leading end of the recovery tank forms the suction nozzle.

Clause 61. The cleaning head according to any clause further including a tank inlet flap configured to rotatably cover and uncover the suction nozzle.

Clause 62. The cleaning head according to any clause further including a biasing member configured to bias the tank inlet flap toward covering the suction nozzle.

Clause 63. The cleaning head according to any clause wherein the suction nozzle couples to an accessory tool, the accessory tool configured to extend outboard of the suction nozzle.

Clause 64. The cleaning head according to any clause wherein the recovery tank is configured to be removably coupled to an underside of the suction nozzle.

Clause 65. The cleaning head according to any clause wherein the recovery tank includes a release configured to removably couple the recovery tank to the suction nozzle.

Clause 66. The cleaning head according to any clause wherein the recovery tank includes a threaded connector configured to removably couple the recovery tank to the suction nozzle.

Clause 67. The cleaning head according to any clause wherein the recovery tank includes a hinged empty door configured to articulate between an open position and a closed position, the open position opening the recovery tank to remove the collected debris, the closed position closing the recovery tank to retain the collected debris.

Clause 68. The cleaning head according to any clause wherein the separator is configured to provide a non-tortuous pathway for separating the recovered debris from the suction air stream.

Clause 69. The cleaning head according to any clause wherein the separator includes a mesh screen and a filter configured to cooperate in separating the recovered debris from the suction air stream.

Clause 70. The cleaning head according to any clause wherein the override is a cap configured to cover an entirety of a user interface included on the handheld base.

Clause 71. The cleaning head according to any clause wherein the cap is included as part of a housing configured to interconnect the recovery tank with the handheld base.

Clause 72. The cleaning head according to any clause wherein the cap includes an aperture configured to permit a user to reach through to actuate a power actuator of the user interface.

Clause 73. The cleaning head according to any clause wherein the cap includes a push button configured to permit a user to actuate a power actuator of the user interface concealed behind the housing.

Clause 74. A portable cleaning apparatus comprising a suction assembly operably coupled with a housing; a fluid delivery system is operably coupled with the housing, the fluid delivery system having a supply tank for storing a liquid; a wand coupled to the housing via an accessory hose, wherein the wand includes a trigger and a fluid outlet, and wherein actuation of the trigger provides fluid communication between the fluid delivery system and the fluid outlet for directing the liquid from the supply tank to a surface to be cleaned; and a dry vacuum tool including: a support body selectively coupled to the wand, Wherein the support body includes a guard that extends over the fluid outlet and the trigger to prevent the actuation of the trigger; an intermediate recovery tank coupled to the support body, Wherein the intermediate recovery tank defines an inlet in fluid communication with the suction assembly for drawing debris into an interior of the intermediate recovery tank; and a separator disposed within the interior of the intermediate recovery tank, wherein the separator is configured to retain the debris within the intermediate recovery tank and allow airflow to be directed through the separator to the accessory hose.

Clause 75. The portable cleaning apparatus according to any clause wherein a dry vacuum tool includes a cap disposed at least partially within an interior of an intermediate recovery tank. The cap defines a guide channel for debris that is drawn into the intermediate recovery tank.

Clause 76. The portable cleaning apparatus according to any clause wherein a cap includes a flap configured to prevent debris from being released from an intermediate recovery tank through an inlet.

Clause 77. The portable cleaning apparatus according to any clause wherein the separator includes an end wall proximate to a cap. A guide channel is linearly aligned with the end wall of the separator.

Clause 78. The portable cleaning apparatus according to any clause wherein the guard includes an outer shield that defines a receiving space. The guard defines a closed distal end and an open proximal end.

Clause 79. The portable cleaning apparatus according to any clause wherein the wand is disposed in a receiving space with a fluid outlet proximate to a closed distal end and a trigger proximate to an open proximal end.

Clause 80. The portable cleaning apparatus according to any clause wherein the guard includes an inner wall disposed within a receiving space proximate to a closed distal end. A fluid outlet is disposed within an insertion channel defined by the inner wall.

Clause 81. A cleaning apparatus comprising a housing; a suction assembly operably coupled with the housing; a fluid delivery system operably coupled with the housing and configured to store a liquid; a wand coupled to the housing via an accessory hose, wherein the wand includes a trigger and a fluid outlet, and wherein actuation of the trigger provides fluid communication between the fluid delivery system and the fluid outlet for releasing the liquid; and a vacuum tool selectively coupled to the wand, wherein the vacuum tool is in fluid communication with the suction assembly to generate a vacuum effect, the vacuum tool including a support body that defining an open end for receiving the wand, wherein the support body includes a guard that extends beyond the open end to extend over the trigger to prevent the actuation of the trigger; an intermediate recovery tank coupled to the support body, wherein the intermediate recovery tank defines an inlet in fluid communication with the suction assembly for drawing debris into the intermediate recovery tank with the vacuum effect; and a separator disposed within the interior of the intermediate recovery tank to retain the debris within the interior.

Clause 82. The cleaning apparatus according to any clause wherein the trigger is at least substantially disposed within a receiving space defined by a guard.

Clause 83. The cleaning apparatus according to any clause wherein the guard defines a closed end and extends over a fluid outlet. The fluid outlet is disposed proximate to the closed end to prevent a release of liquid to a surface to be cleaned.

Clause 84. The cleaning apparatus according to any clause wherein the guard includes an outer wall and an inner wall. A fluid outlet is disposed within an insertion channel defined by the inner wall.

Clause 85. The cleaning apparatus according to any clause wherein an airflow path is defined through a vacuum tool and through an accessory hose, and wherein a liquid flow path is defined from a fluid delivery system to a fluid outlet, and further wherein the guard is configured to block the fluid outlet to end the liquid flow path and prevent liquid from being dispensed to a surface to be cleaned.

Clause 86 The cleaning apparatus according to any clause wherein the separator includes an end wall, And where the inlet of an intermediate recovery tank, the end wall of the separator, and an opening into an accessory hose are linearly aligned.

Clause 87. The cleaning apparatus according to any clause wherein each of an intermediate recovery tank and a separator defines at least one of a conical shape and a frustoconical shape.

Clause 88. The cleaning apparatus according to any clause wherein the vacuum tool includes: a cap coupled to an intermediate recovery tank, and wherein the cap includes a flap configured to prevent debris from being released from the intermediate recovery tank through an inlet.

Clause 89. The cleaning apparatus according to any clause wherein the fluid outlet and a trigger are at least substantially disposed within a receiving space defined by a guard.

Clause 90. A dry vacuum tool for a cleaning apparatus, the cleaning apparatus has a liquid delivery system, and the dry vacuum tool comprising: a support body including a proximal receiving end configured to receive a wand of the cleaning apparatus; and a guard extending beyond the proximal receiving end, wherein the guard is configured to extend over a fluid outlet and a fluid trigger of the wand to prevent actuation of the fluid trigger and release of liquid from the fluid outlet; an intermediate recovery tank coupled to a distal receiving end of the support body, wherein the intermediate recovery tank defines an interior and an inlet in fluid communication with the interior for capturing debris within the recovery tank with a vacuum effect; and a separator disposed within the interior of the intermediate recovery tank, wherein the separator is configured to retain the debris within the interior.

Clause 91. The dry vacuum tool according to any clause wherein the separator has an end wall, and wherein the inlet of an intermediate recovery tank, the end wall, and a proximal receiving end of a support body are disposed in a linear arrangement.

Clause 92. The dry vacuum tool according to any clause wherein the guard includes an outer wall that defines a receiving space and an inner wall within the receiving space, and wherein the inner wall defines an insertion channel for receiving a fluid outlet.

Clause 93. The dry vacuum tool according to any clause wherein an opening into an insertion channel that is defined by an inner wall is aligned with a proximal receiving end of a support body.

Clause 94. A handheld extraction cleaner system, comprising: a wet cleaning head including a wet suction nozzle; a dry cleaning head including a dry suction nozzle; and a handheld base including: a modular receiver configured to interchangeably couple to the wet cleaning head and the dry cleaning head; a suction source configured to generate a suction air stream through the wet suction nozzle when the wet cleaning head is coupled to the modular receiver and through the dry suction nozzle when the dry cleaning head is coupled to the modular receiver; and a fluid delivery system including a fluid distributor configured to dispense a cleaning solution on a surface to be cleaned, wherein at least one of the handheld base and the dry cleaning head is configured to at least partially prevent the fluid delivery system from dispensing the cleaning solution when the dry cleaning head is coupled to the modular receiver.

Clause 95. The handheld extraction cleaner system according to any clause wherein the dry cleaning head includes a housing with a cover, and wherein the fluid delivery system includes a spray actuator, and further wherein the cover extends over the handheld base to overlay the spray actuator when the dry cleaning head is coupled to the handheld base.

Clause 96. The handheld extraction cleaner system according to any clause wherein the handheld base includes a switch, and wherein the dry cleaning head includes an actuator configured to actuate the switch to disable the fluid delivery system when the dry cleaning head is coupled to the handheld base.

Clause 97. The handheld extraction cleaner system according to any clause wherein the switch is at least one of a pressure sensor, an optical sensor, a magnetic sensor, and a proximity sensor.

Clause 98. The handheld extraction cleaner system according to any clause wherein the handheld base includes a spray actuator operably coupled with the fluid delivery system and a mechanical shutoff, and wherein the dry cleaning head includes an actuator configured to engage and move the mechanical shutoff to abut an underside of the spray actuator and prevent actuation of the spray actuator.

Clause 99. The handheld extraction cleaner system according to any clause wherein the dry cleaning head includes a separator disposed in the suction air stream to separate the debris from the suction air stream and a dry recovery tank configured to collect the debris.

Clause 100. The handheld extraction cleaner system according to any clause wherein the dry cleaning head includes a housing, and wherein the housing extends over the handheld base with the fluid distributor configured to be retained in an enclosure of the housing.

Clause 101. A modular handheld extraction cleaner, comprising: a base including: a suction source configured to generate a suction air stream for recovering debris from a surface to be cleaned; a fluid delivery system configured to dispense a cleaning solution from a fluid distributor to the surface to be cleaned; and a modular receiver; and a dry cleaning head selectively coupled to the modular receiver, wherein the dry cleaning head includes: a dry suction nozzle in fluid communication with the suction source to draw the debris into the at least one dry cleaning head with the suction air stream; a recovery tank for capturing the debris from the suction air stream; and an override feature for preventing the cleaning solution from being dispensed when the dry cleaning head is coupled to the modular receiver.

Clause 102. The modular handheld extraction cleaner according to any clause wherein the dry cleaning head includes a housing, and wherein the override feature is a blocking feature extending from the housing to abut the fluid distributor.

Clause 103. The modular handheld extraction cleaner according to any clause wherein the base includes a spray actuator, the cleaning solution configured to be dispensed upon actuation of the spray actuator, and wherein the override feature is a cover extending over the spray actuator.

Clause 104. The modular handheld extraction cleaner according to any clause wherein the base includes a switch, and wherein the override feature is an actuator configured to actuate the switch to disable the fluid delivery system.

Clause 105. The modular handheld extraction cleaner according to any clause wherein the dry cleaning head includes a housing, and wherein the actuator is a key extending from an end of the housing to actuate the switch.

Clause 106. The modular handheld extraction cleaner according to any clause wherein the base includes a user interface, and wherein the override feature is a cap configured to cover at least a substantial portion of the user interface.

Clause 107. The modular handheld extraction cleaner according to any clause wherein the user interface includes a power actuator, and wherein the cap defines an aperture that aligns with the power actuator for accessing the power actuator through the cap.

Clause 108. The modular handheld extraction cleaner according to any clause further comprising: a wet cleaning head interchangeably coupled to the modular receiver, wherein the wet cleaning head has a wet suction nozzle in fluid communication with the suction source, and wherein the fluid delivery system is configured to dispense the cleaning fluid when the wet cleaning head is coupled to the modular receiver.

Clause 109. A handheld extraction cleaner, comprising: a dry cleaning head including a dry suction nozzle and a recovery tank; and a base including: a suction source configured to generate a suction air stream for recovering debris from a surface to be cleaned through the dry suction nozzle, the debris being collected from the suction air stream in the recovery tank; a fluid delivery system including a spray actuator, the fluid delivery system configured to dispense a cleaning solution on the surface to be cleaned upon actuation of the spray actuator; a modular receiver configured to selectively couple with the dry cleaning head; and a control system configured to disable use of the spray actuator when the dry cleaning head is coupled to the modular receiver.

Clause 110. The handheld extraction cleaner according to any clause wherein the control system includes a switch, and wherein actuation of the switch is configured to disable the fluid delivery system.

Clause 111. The handheld extraction cleaner according to any clause wherein the control system includes a sensor, and wherein the control system is configured to disable the fluid delivery system in response to the sensor detecting the dry cleaning head being coupled to the modular receiver.

Clause 112. The handheld extraction cleaner according to any clause further comprising: a wet cleaning head interchangeably coupled with the modular receiver and in selective fluid communication with the suction source.

Clause 113. The handheld extraction cleaner according to any clause wherein the control system includes a first switch configured to interact with the dry cleaning head when the dry cleaning head is coupled to the modular receiver and a second switch configured to interact with the wet cleaning head when the wet cleaning head is coupled to the modular receiver.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure, as shown in the exemplary embodiments, is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts, or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A handheld extraction cleaner system, comprising:

a wet cleaning head including a wet suction nozzle;

a dry cleaning head including a dry suction nozzle; and a handheld base including:

a modular receiver configured to interchangeably couple to the wet cleaning head and the dry cleaning head;

a suction source configured to generate a suction air stream through the wet suction nozzle when the wet cleaning head is coupled to the modular receiver and through the dry suction nozzle when the dry cleaning head is coupled to the modular receiver; and a fluid delivery system including a fluid distributor configured to dispense a cleaning solution on a surface to be cleaned, wherein the dry cleaning head is configured to prevent the fluid distributor from dispensing the cleaning solution to the surface to be cleaned when the dry cleaning head is coupled to the modular receiver, wherein the dry cleaning head is free of components of the fluid delivery system.

2. The handheld extraction cleaner system of claim 1, wherein the dry cleaning head includes a housing with a cover, and wherein the fluid delivery system includes a spray actuator, and further wherein the cover extends over the handheld base to overlay the spray actuator when the dry cleaning head is coupled to the handheld base.

3. The handheld extraction cleaner system of claim 2, wherein the housing extends over the handheld base with the fluid distributor configured to be retained in an enclosure of the housing.

4. The handheld extraction cleaner system of claim 1, wherein the handheld base includes a switch, and wherein the dry cleaning head includes an actuator configured to actuate the switch to disable the fluid delivery system when the dry cleaning head is coupled to the handheld base.

5. The handheld extraction cleaner system of claim 4, wherein the switch is at least one of a pressure sensor, an optical sensor, a magnetic sensor, and a proximity sensor.

6. The handheld extraction cleaner system of claim 4, wherein the dry cleaning head includes a housing, and wherein the actuator is a key extending from an end of the housing to actuate the switch.

7. The handheld extraction cleaner system of claim 1, wherein the handheld base includes a spray actuator operably coupled with the fluid delivery system and a mechanical shutoff, and wherein the dry cleaning head includes an actuator configured to engage and move the mechanical shutoff to abut an underside of the spray actuator and prevent actuation of the spray actuator.

8. The handheld extraction cleaner system of claim 1, wherein the dry cleaning head includes a separator disposed in the suction air stream to separate debris from the suction air stream and a dry recovery tank configured to collect the debris.

9. The handheld extraction cleaner system of claim 1, wherein the dry cleaning head includes a housing and an override feature, and wherein the override feature is a blocking feature extending from the housing to abut the fluid distributor.

10. The handheld extraction cleaner system of claim 1, wherein the handheld base includes a user interface, and wherein the dry cleaning head includes a cap configured to cover at least a portion of the user interface.

11. The handheld extraction cleaner system of claim 10, wherein the user interface includes a power actuator, and wherein the cap defines an aperture that aligns with the power actuator for accessing the power actuator through the cap.

12. A handheld extraction cleaner system, comprising:

a wet cleaning head including a wet suction nozzle;

a dry cleaning head including a dry suction nozzle, wherein the dry cleaning head includes a housing with a cover; and a handheld base including:

a modular receiver configured to interchangeably couple to the wet cleaning head and the dry cleaning head;

a suction source configured to generate a suction air stream through the wet suction nozzle when the wet cleaning head is coupled to the modular receiver and through the dry suction nozzle when the dry cleaning head is coupled to the modular receiver; and a fluid delivery system including a fluid distributor configured to dispense a cleaning solution on a surface to be cleaned and a spray actuator, wherein the dry cleaning head is configured to at least partially prevent the fluid delivery system from dispensing the cleaning solution when the dry cleaning head is coupled to the modular receiver, and further wherein the cover extends over the handheld base to overlay the spray actuator when the dry cleaning head is coupled to the handheld base.

* * * * *